US007686702B2

(12) United States Patent
Hubley

(10) Patent No.: US 7,686,702 B2
(45) **Date of Patent: *Mar. 30, 2010**

(54) GOLF BALL RESTRAINING APPARATUS

(76) Inventor: Bruce Hubley, 163 Starlite Dr., San Mateo, CA (US) 94402

( * ) Notice: Subject to any disclaimer, the term of this patent is extended or adjusted under 35 U.S.C. 154(b) by 0 days.

This patent is subject to a terminal disclaimer.

(21) Appl. No.: 12/041,663

(22) Filed: Mar. 4, 2008

(65) Prior Publication Data

US 2008/0153616 A1 Jun. 26, 2008

Related U.S. Application Data

(60) Division of application No. 11/490,004, filed on Jul. 20, 2006, now abandoned, which is a continuation-in-part of application No. 11/004,450, filed on Dec. 4, 2004, now Pat. No. 7,118,489.

(51) Int. Cl.
*A63B 69/36* (2006.01)

(52) U.S. Cl. ..... 473/226; 473/219; 473/235

(58) Field of Classification Search ..... 473/180, 473/226, 228, 229, 235, 236, 286, 219
See application file for complete search history.

(56) References Cited

U.S. PATENT DOCUMENTS 1,585,446 A * 5/1926 Warwick ..... 124/5
1,877,820 A * 9/1932 Costello ..... 473/235
2,057,821 A * 10/1936 Costello ..... 473/235
2,094,766 A * 10/1937 Costello ..... 473/138
2,157,415 A * 5/1939 Jones ..... 473/235
3,749,407 A * 7/1973 Prochnow ..... 473/286
6,702,688 B2 * 3/2004 Hale ..... 473/226
7,118,489 B1 * 10/2006 Hubley ..... 473/226

* cited by examiner

*Primary Examiner*—Nini Legesse
(74) *Attorney, Agent, or Firm*—Perkins Coie LLP

(57) ABSTRACT

Apparatus 10 for a golf swing training device comprising a golf club 20 with a shaft 24 with a grip 22 at one end and a club head 26 at the other end of the shaft with a receptacle 12 attached to the face 14 of the club head with the receptacle opening on the front towards the intended target. In use, a ball 28 is placed in the receptacle 12 with the intention of releasing the ball from the receptacle at a desired point during the swing at a target. In practice, if during the back swing the receptacle 12 is incorrectly tilted, due to poor swing mechanics, the ball 28 will fall out. Also, if the bore of the receptacle 12 is not in alignment with the target line at the ball's 28 point of release the ball trajectory will be skewed from the target. As an additional element, the receptacle 12 can have a retainer 92 to impede the ball 28 from easily falling out and the receptacle can be removably attached at 36, 38 to the club face 14.

17 Claims, 51 Drawing Sheets

GOLF BALL RESTRAINING APPARATUS

RELATED APPLICATIONS

This application is a divisional of U.S. patent application Ser. No. 11/490,004 filed Jul. 20, 2006, now abandoned which is a continuation-in-part of U.S. patent application Ser. No. 11/004,450 filed Dec. 4, 2004, now U.S. Pat. No. 7,118,489, all of which are incorporated by reference.

BACKGROUND OF THE INVENTION

Field of the Invention

The present invention provides a golf swing training device comprising a shaft with a grip at one end and a club head at the other end of the shaft with a receptacle attached to the face of said club head with the receptacle opening on the front towards the intended target. The bore of the receptacle conforms substantially to the diameter of the ball. In use, a ball is placed in the receptacle with the intention of releasing the ball from the receptacle at a desired point during the swing at a target.

In practice, if during the back swing the receptacle is incorrectly tilted, due to poor swing mechanics, the ball will fall out. Also, if the bore of the receptacle is not in alignment with the target line at the ball's point of release the ball trajectory will be skewed from the target.

The present invention provides a golf swing training device that helps the golfer develop a back swing along the correct swing plane, at a slow pace, while rotating the hands and arms properly thus keeping the ball from falling out of the receptacle.

The present invention provides a golf swing training device that promotes the correct extension and rotation of the hands and arms along the target line, during the down swing, leading to a proper finish.

If the down swing is done correctly the ball will leave the receptacle at the bottom of the swing and fly directly down the target line in a manner that is predictable and repeatable. Any swing other than a correct swing will cause the ball to go left, right, lower or higher of the target line.

As an additional element the receptacle can have a restrainer to impede the ball from easily falling out and the receptacle can be removably attached to the club head.

Furthermore, in addition to the aforementioned restrainer the present invention provides that the receptacle may have the ability to use interchangeable parts, and be incrementally adjustable. The shape of the receptacle can be cylindrical, square, round, elongated, triangular, virtually any shape imaginable. The receptacle may use different release methods that don't rely on a restrainer and/or gravity to hold or release the ball, such as, magnetic, air, vacuum, electricity, etc. The receptacle can be used in other sports, such as baseball, tennis, hockey, etc.

SUMMARY OF THE PRESENT INVENTION

The present invention discloses a golf swing training device comprising a golf club with a shaft with a grip at one end and a club head at the other end of the shaft with a receptacle attached to the face of the club head with the receptacle opening on the front towards the intended target. The bore of the receptacle conforms substantially to the diameter of the ball. In use, a ball is placed in the receptacle with the intention of releasing the ball from the receptacle at a desired point during the swing at a target. In practice, if during the back swing the receptacle is incorrectly tilted, due to poor swing mechanics, the ball will fall out. Also, if the bore of the receptacle is not in alignment with the target line at the ball's point of release the ball trajectory will be skewed from the target.

Furthermore, the present invention provides a wedge whereby the golf club face can be of any pitch and with the wedge fixed to the club face provides zero loft or vertical face for attachment of the receptacle. In addition to using any club, such as a 3 or 4 iron, the present invention provides that the receptacle shape can be circular, oval, elongated or comprised of polygonal sides including triangle, square, rectangle and any shape imaginable with all the aforementioned sized to retain a golf ball therein.

Included in the various shapes, the present invention provides that the rim of the receptacle can be other than planar have a spiral or planar shape and the wall can be notched with a V or rectangular shape or spaced apart slits placed in the receptacle wall with the intervening receptacle wall section outwardly depending. As an additional element, the receptacle can have a restrainer to impede the ball from easily falling out and the receptacle can be removably attached to the club head.

The present invention is a small, transportable golf swing training device to train a golfer to correctly swing a golf club. On the back swing, the golfer learns to take a low and slow swing along the target line while rotating the hands and arms properly. On the down swing, a golfer learns to rotate the wrists through the hitting area while extending the hands along the target line and improving the follow-through. By practicing with the device, a golfer should experience an improved swing leading to longer and straighter shots.

To begin the back swing, the golfer must take a low and slow take away along the target line while rotating the hands and arms properly; otherwise, the golf ball will fall out of the receptacle that is attached to the face of the device. A correct takeaway keeps the golf ball in the receptacle throughout the back swing. On the down swing, a golfer learns to rotate the hands and arms through the hitting area while extending the hands along the target line. If done correctly, the ball will leave the receptacle at the bottom of the swing and fly directly down the target line. Any swing other than a correct swing will cause the ball to go left, right, higher or lower of the target line. To further assist the golfer, the device can be used with two one-inch wide ribbons placed parallel to each other on the floor. One ribbon, approximately 3 feet long, is used to line up the golfer's feet. The other ribbon, approximately 12 feet long, is aligned with the imagined position of the golf ball along the target line. In addition, for the golfer to assess the results of their swing, they can affix a transportable bulls-eye to a wall located down the line of the 12-foot ribbon. This gives the golfer visual feedback of the trajectory of the ball as it leaves the receptacle.

A primary object of the present invention is to provide a golfer with a swing training device to develop a correct back swing, target line swing release and follow through.

Another object of the present invention is to provide a golf swing training device comprising a shaft having a receptacle attached to the face of a club head.

Yet another object of the present invention is to provide a golf swing training device wherein said receptacle aperture faces the front of the club.

A further object of the present invention is to provide a restrainer to impede the ball easily rolling out.

Another object of the present invention is to provide a golf swing training device having an additional element in the form of one or more lengths of ribbon that aid in stance foot position and intended trajectory of the ball.

Yet another object of the present invention is to provide a golf swing training device that is easy to use.

Still yet another object of the present invention is to provide a golf swing training device that is cost effective to manufacture.

Yet another object of the present invention is to provide a transportable swing training device that fits in travel luggage.

Additional objects of the present invention will appear as the description proceeds.

The present invention overcomes the shortcomings of the prior art by providing a golf swing training device comprising a club head and shaft having a receptacle attached thereto with the receptacle opening on the front towards the intended target. In use a ball is placed in the receptacle with the intention of releasing the ball from the receptacle at a desired point during the swing at a target. In practice, if during the back swing the receptacle is tilted the ball will fall out or if when released the bore of the receptacle is not in alignment with the target, the ball trajectory is skewed from the target. The advantage of the present invention is it helps the golfer develop a back swing along the correct swing plane, at a slow pace, rolling the hands and arms open to keep the ball from falling out of the receptacle and to extend the hands and arms along the target line on downswing. If the swing is done correctly, the ball will leave the receptacle at the bottom of the swing and fly directly down the target line. Any swing other than a correct swing will cause the ball to go left, right, higher or lower of the target line.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
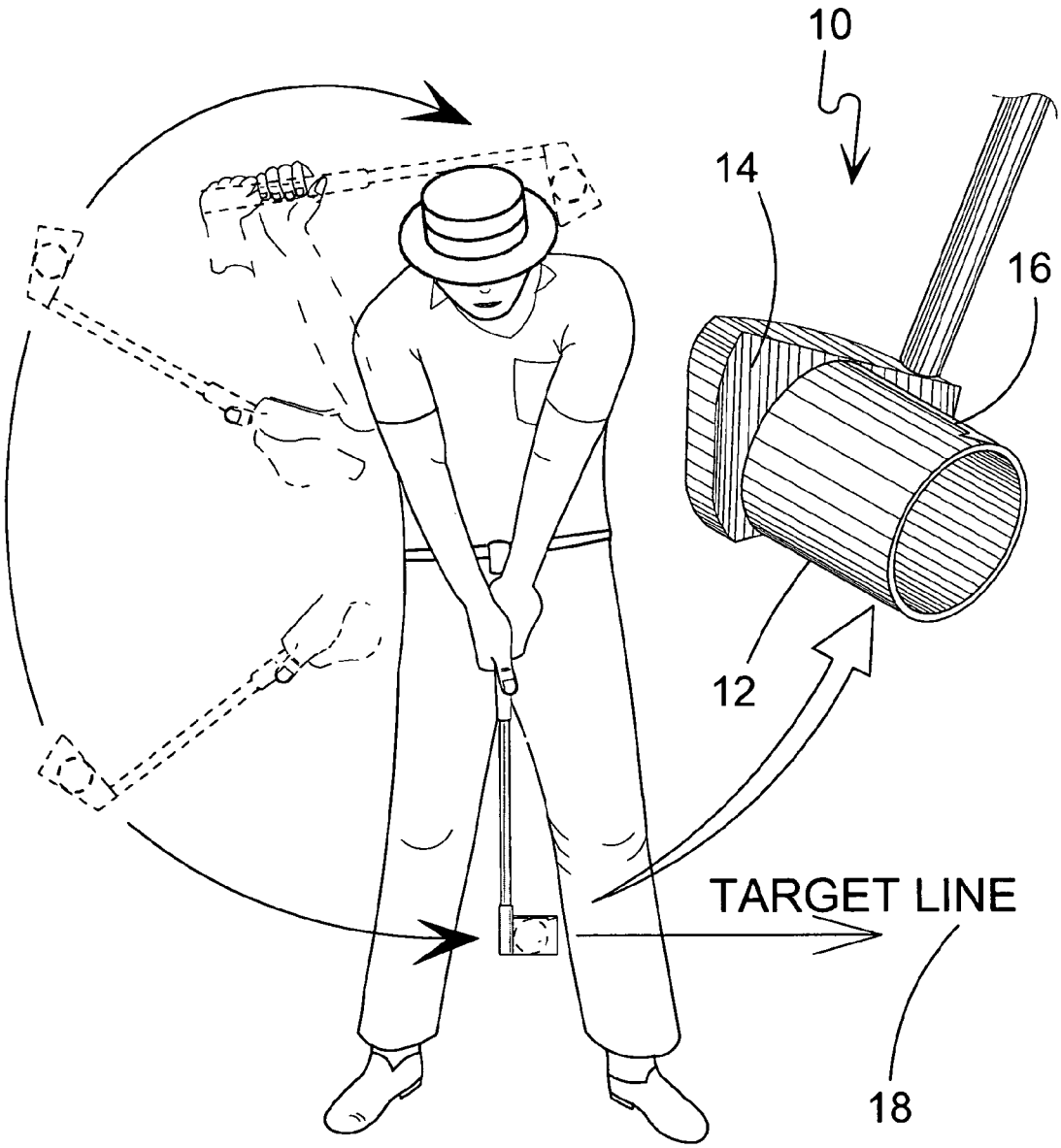
FIG. 1 is an illustrative view of the present invention in use.

With regard to reference numerals used, the following numbering is used throughout the drawings.

10 present invention
12 receptacle
14 face
16 arrow
18 target line
20 golf club
22 grip
24 shaft
26 club head
28 ball
30 long ribbon
32 short ribbon
34 golfer
36 male threads
38 female threads
40 ridge
41 target
42 clamp
44 clamp fasteners
46 clamp arm
48 double face tape
50 mounting frame
51 club head mounting frame member
52 receptacle mounted frame member
53 mounting frame hinge
54 slide stay
56 slide pivot
58 slide set screw
60 slide aperture
62 strap loop
64 frame mounting apertures
66 receptacle mounted bristles
68 safety strap anchor
70 adjuster strap
72 adjuster strap apertures
74 adjuster strap post
75 receptacle support
76 wedge
78 receptacle
80 receptacle aperture
82 receptacle style A
84 receptacle style B
86 receptacle style C
88 receptacle style D
90 receptacle style E
92 retainer
94 club face angle
96 zero degree loft
98 elongated receptacle style
102 restrainer button
104 actuator
106 wiring chase
108 batteries
110 trigger
200 shaft mounted golf swing training device
300 golf club-head mounted golf swing training device
400 golf club-head mounted golf swing training device
500 golf club-head mounted golf swing training device
600 golf club-head mounted golf swing training device
700 golf club-head mounted golf swing training device
800 golf club-head mounted golf swing training device

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a golf swing training device comprised of a receptacle 12 mounted to a club face 14 for placing a ball therein and dispensing the ball. The receptacle 12 has an exteriorly positioned marker or arrow 16 used as an alignment aid with a target. Also shown is the target line at 18.

Figure 2:
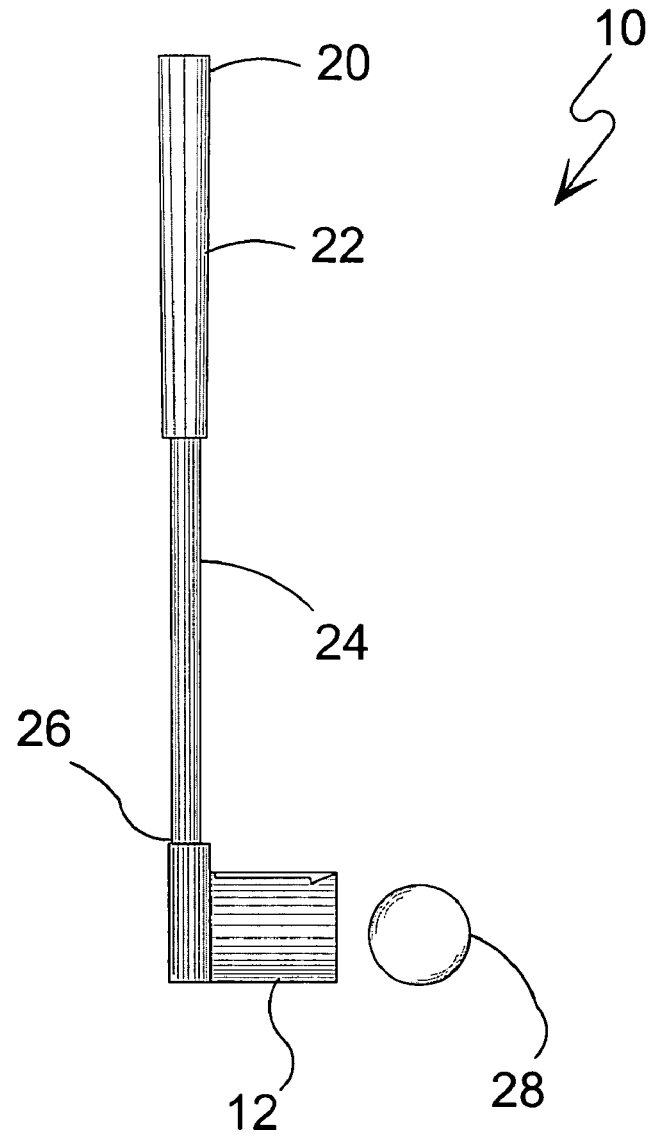
FIG. 2 is a side view of the present invention.

Turning to FIG. 2, shown therein is a side view of the present invention 10. Shown is the present invention 10 disclosing a small, transportable golf swing training device to train a golfer to correctly swing a golf club 20. On the back swing, the golfer learns to take a low and slow swing along the target line while rotating the wrists properly. On the down swing, a golfer learns to rotate the wrists through the hitting area while extending the hands along the target line and improving the follow-through. By practicing with the device, a golfer should experience an improved swing leading to longer and straighter shots. Also shown are the grip 22, shaft 24, club head 26, receptacle 12 and ball 28.

Figure 3:
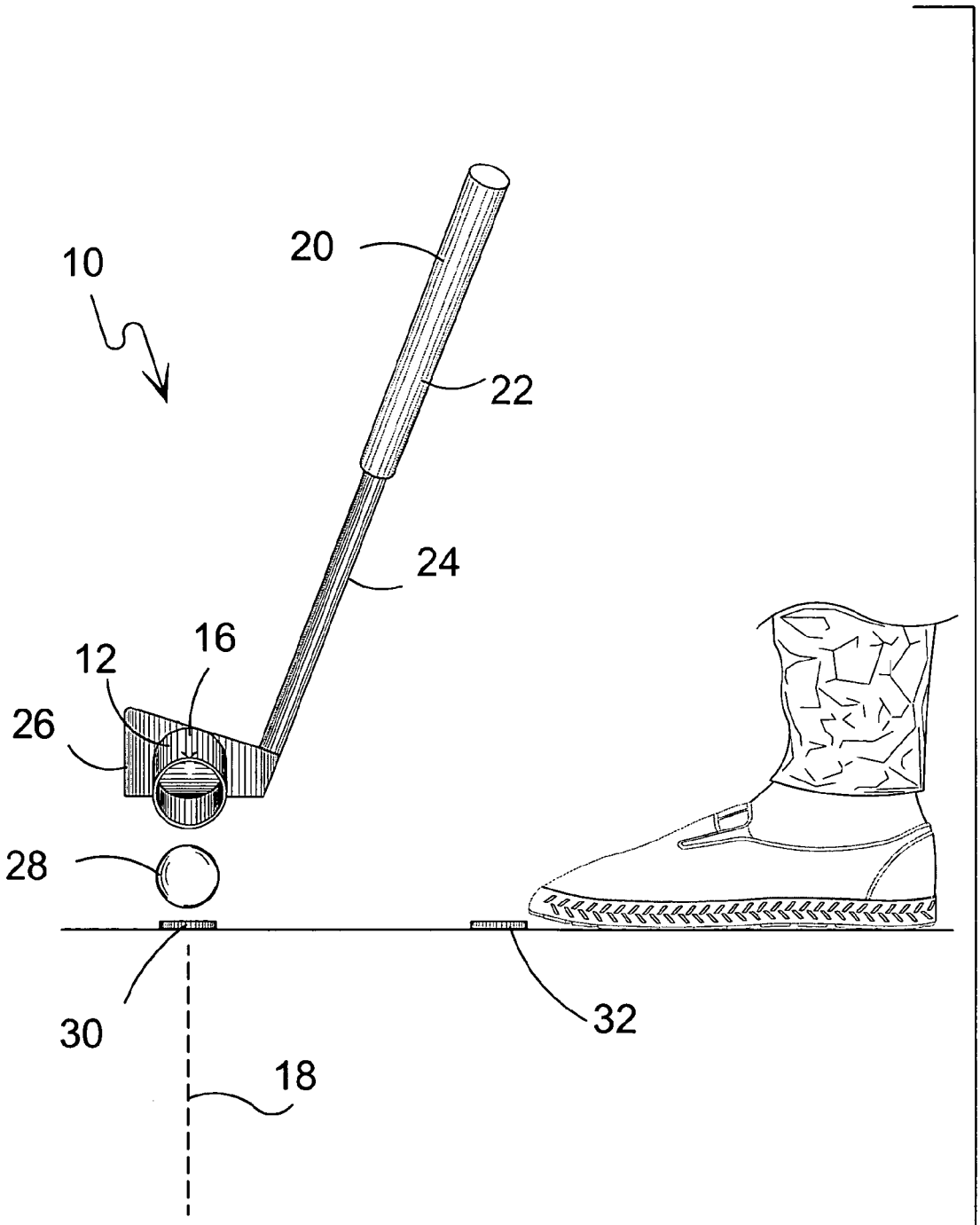
FIG. 3 is a frontal view of the present invention.

Turning to FIG. 3, shown therein is a frontal view of the present invention 10. Shown is the present invention 10 disclosing a small, transportable golf swing training device to train a golfer to correctly swing a golf club 20. On the back swing, the golfer learns to take a low and slow swing along the target line while rotating the wrists properly. On the down swing, a golfer learns to rotate the wrists through the hitting area while extending the hands along the target line and improving the follow-through. By practicing with the device 10, a golfer should experience an improved swing leading to longer and straighter shots. Also shown are a long target line ribbon 30, target line 18, a short stance ribbon 32 and other previously disclosed elements.

Figure 4:
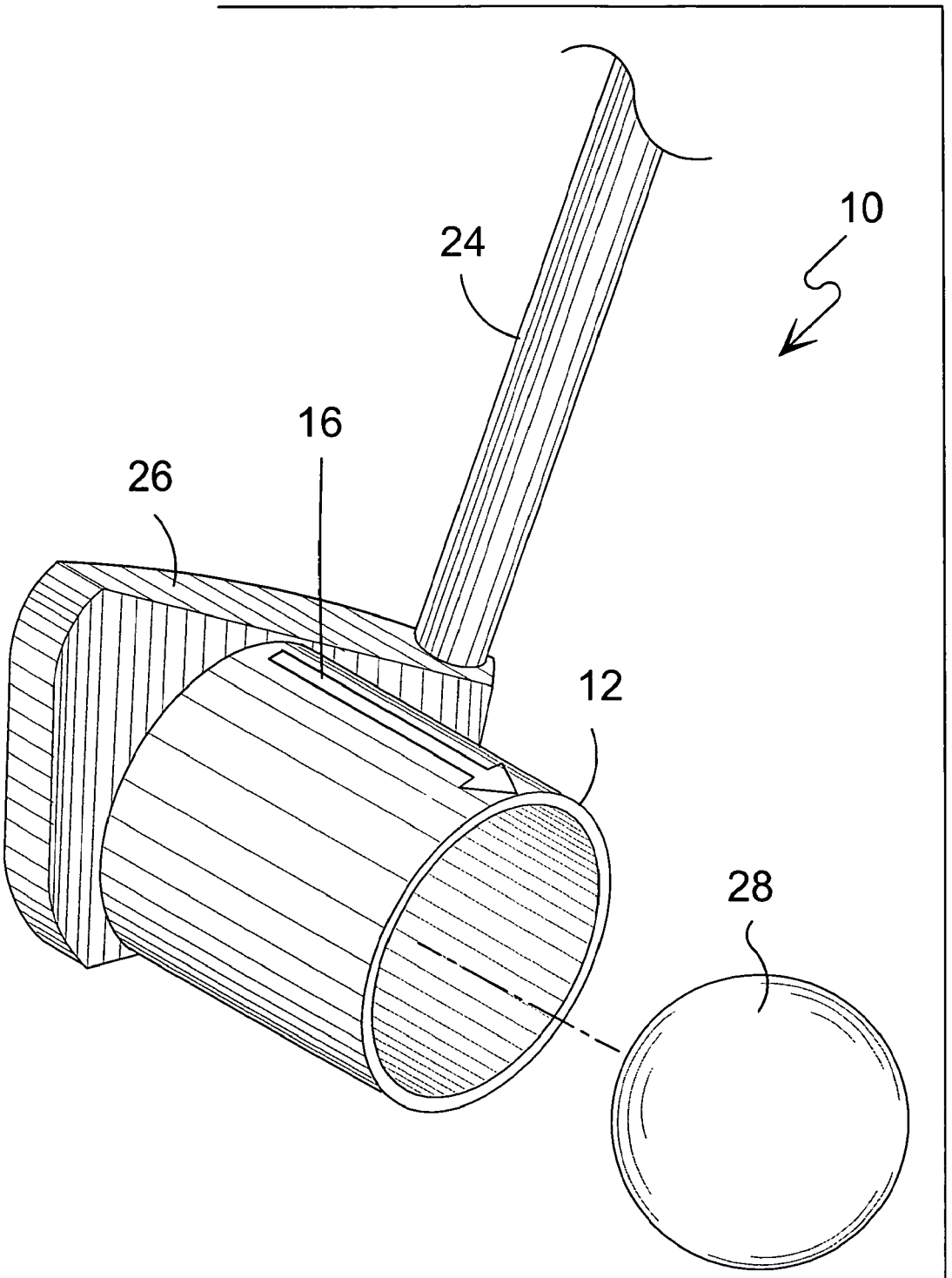
FIG. 4 is a detailed perspective view of the present invention.

Turning to FIG. 4, shown therein is a detailed perspective view of the present invention 10. Shown is the present invention 10 disclosing a small, transportable golf swing training device to train a golfer to correctly swing a golf club. On the back swing, the golfer learns to take a low and slow swing along the target line while rotating the wrists properly. On the down swing, a golfer learns to rotate the wrists through the hitting area while extending the hands along the target line and improving the follow-through. By practicing with the device 10, a golfer should experience an improved swing leading to longer and straighter shots. Other elements previously shown are also disclosed.

Figure 5:
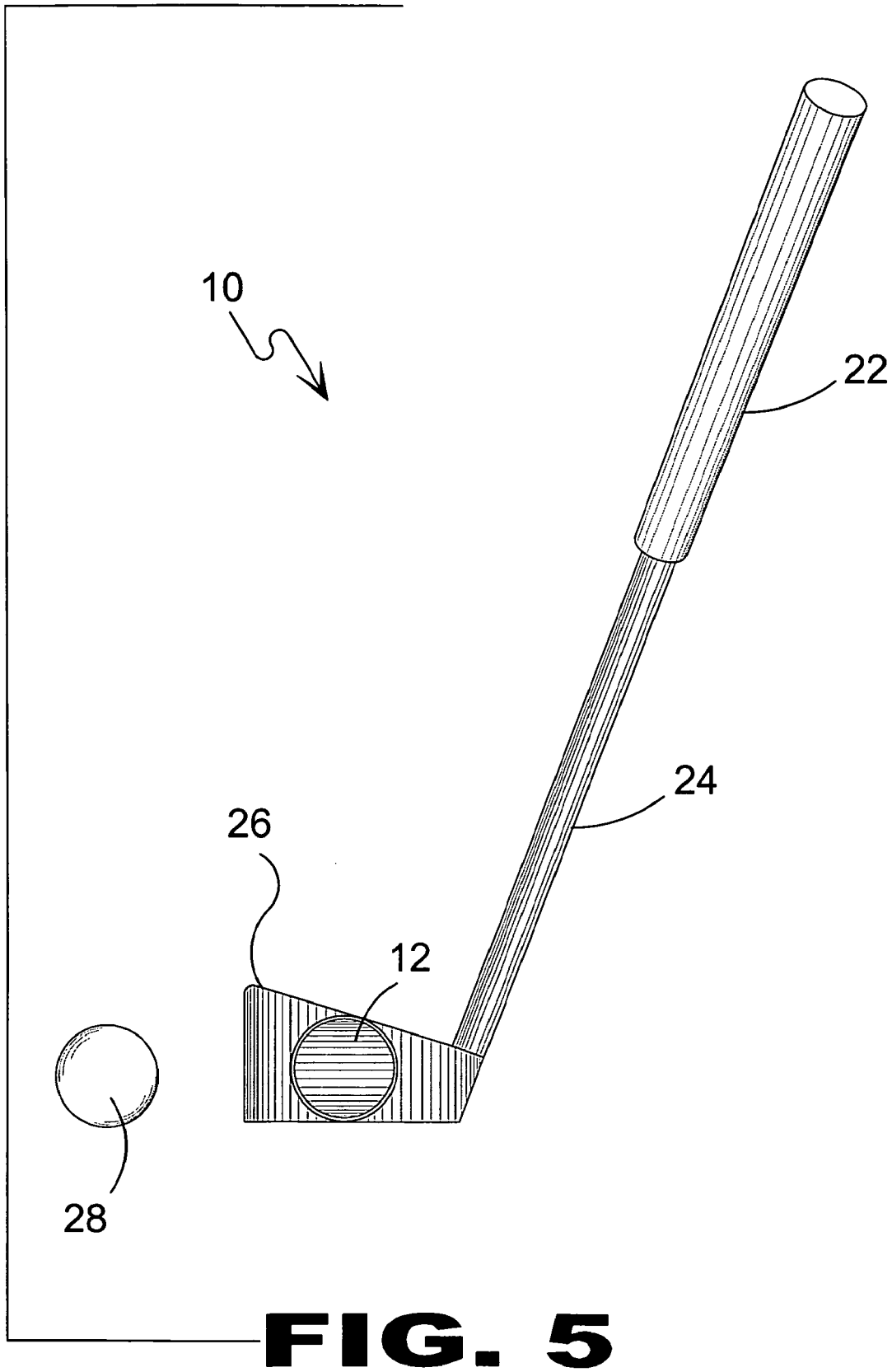
FIG. 5 is a frontal view of the present invention.

Turning to FIG. 5, shown therein is an exploded perspective view of the present invention 10. Shown is the present invention 10 disclosing a small, transportable golf swing training device to train a golfer to correctly swing a golf club. On the back swing, the golfer learns to take a low and slow swing along the target line while rotating the wrists properly. On the down swing, a golfer learns to rotate the wrists through the hitting area while extending the hands along the target line and improving the follow-through. By practicing with the device 10, a golfer should experience an improved swing leading to longer and straighter shots. Other elements previously shown are also disclosed.

Figure 6:
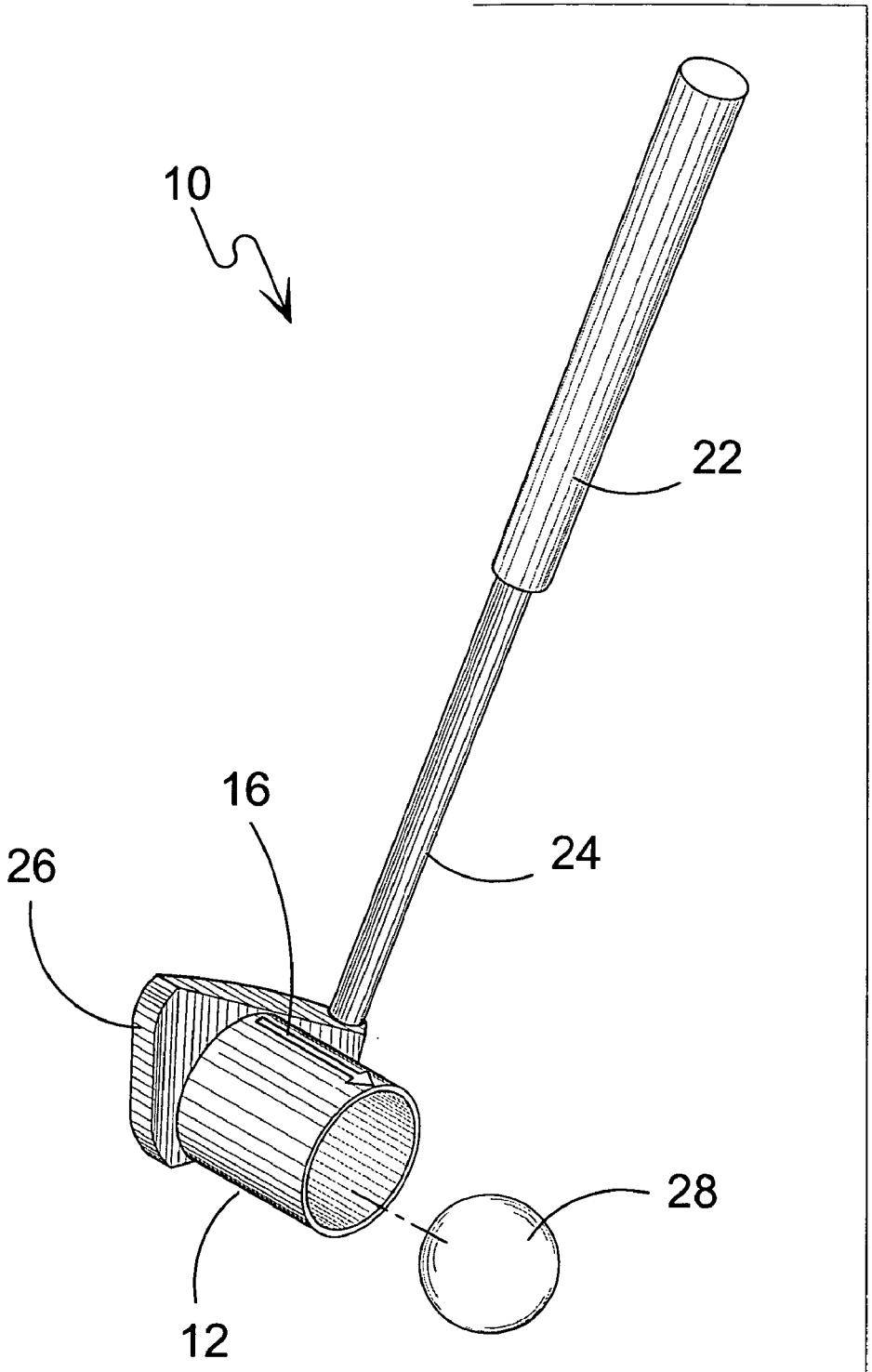
FIG. 6 is a perspective view of the present invention.

Turning to FIG. 6, shown therein is a perspective view of the present invention 10. Shown is the present invention 10 disclosing a small, transportable golf swing training device to train a golfer to correctly swing a golf club. On the back swing, the golfer learns to take a low and slow swing along the target line while rotating the wrists properly. On the down swing, a golfer learns to rotate the wrists through the hitting area while extending the hands along the target line and improving the follow-through. By practicing with the device 10, a golfer should experience an improved swing leading to longer and straighter shots. Other elements previously disclosed are also shown.

Figure 7:
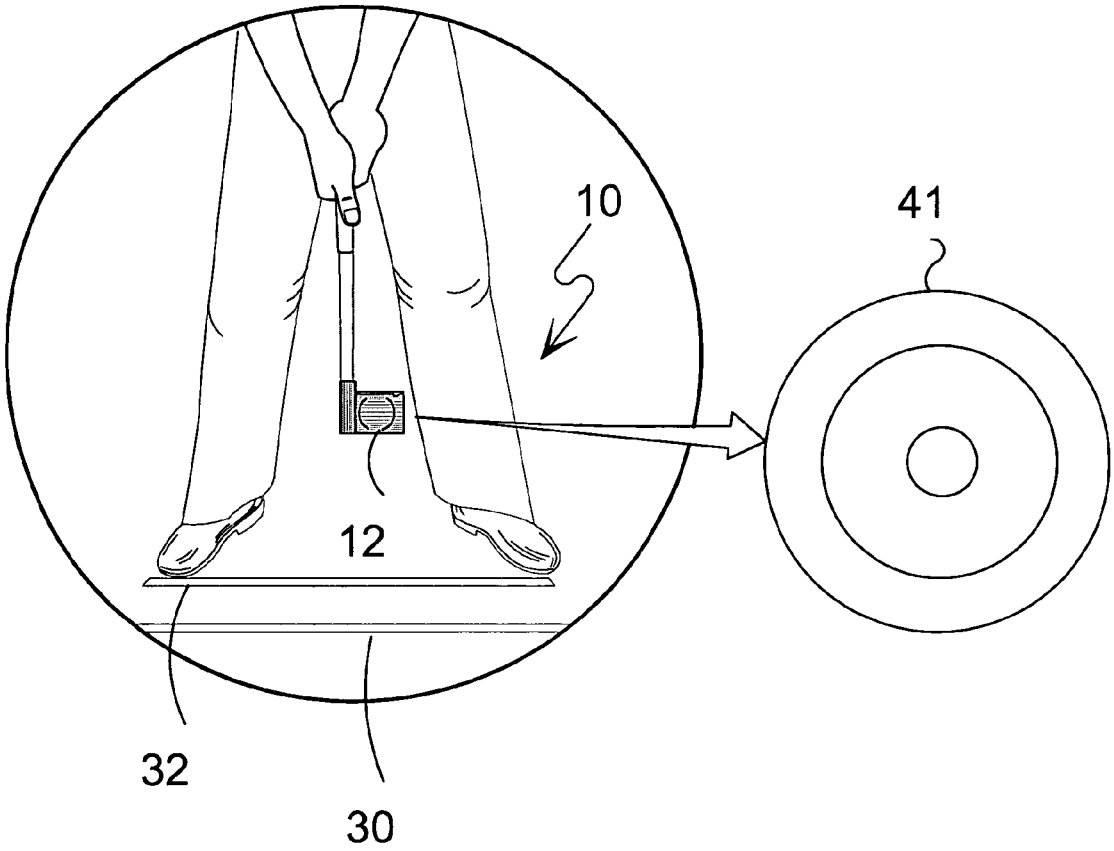
FIG. 7 is an illustrative view of the present invention.

Turning to FIG. 7, shown therein is an illustrative view of the present invention 10. Shown is the present invention 10 disclosing a small transportable golf swing training device to help a golfer learn to make a low, slow back swing, rotate the wrist properly and to extend the club head along the target line on the down swing. The device 10 is capable of slinging a plastic practice golf ball or a regulation golf ball forward toward a target. The device 10 also helps train a golfer to extend the hands down the target line. The device 10 comprises a receptacle 12 mounted to a club head, which is attached to a shaft with a grip. Also shown is portable target 41 placed down the line of the ribbon 30.

Figure 8:
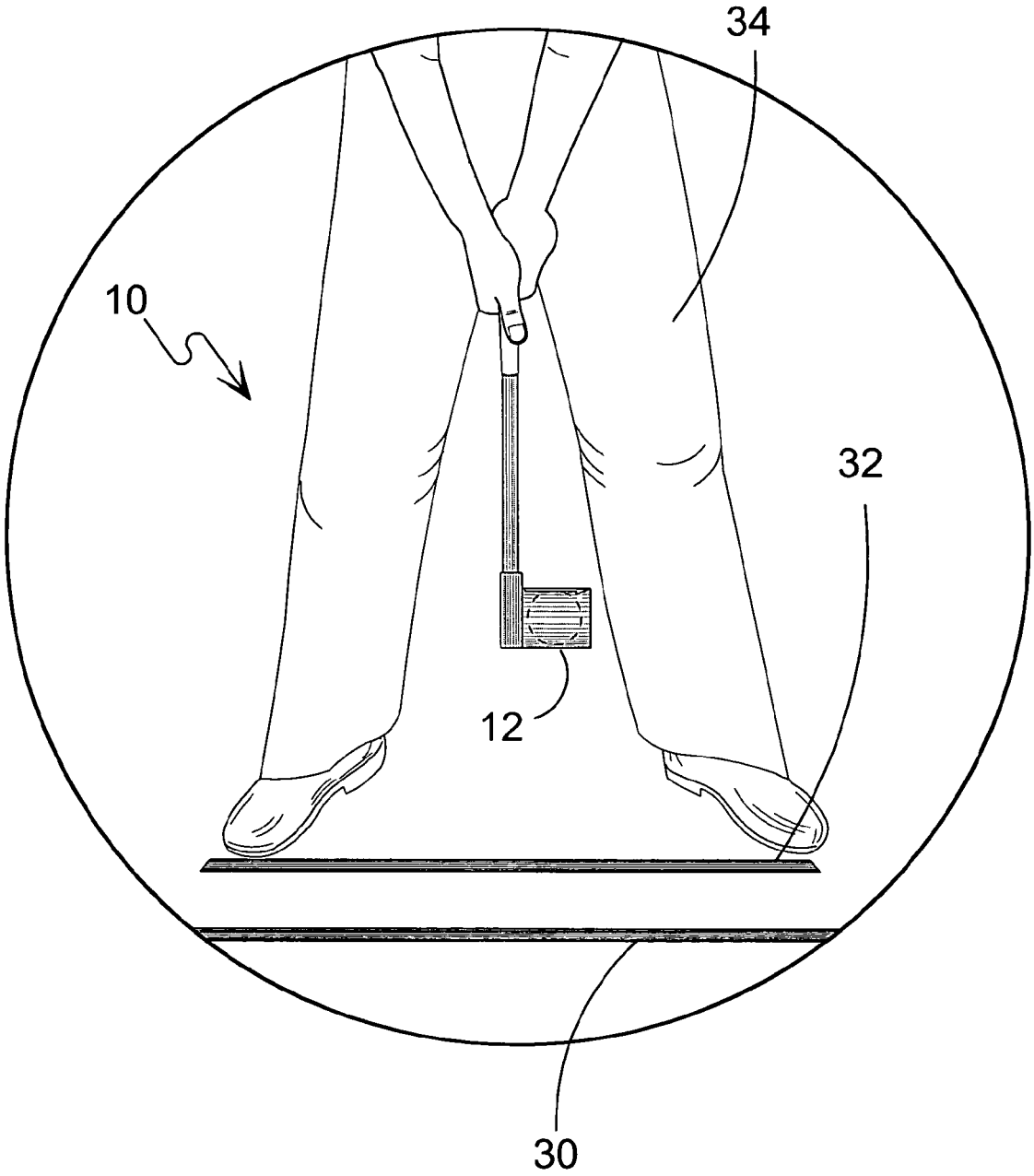
FIG. 8 is an illustrated view of the present invention.

Turning to FIG. 8, shown therein is an illustrated view of the present invention 10. To begin the back swing, the golfer 34 must take a low and slow takeaway along the target line while rotating the wrists properly; otherwise, the golf ball will fall out of the receptacle 12 that is attached to the face of the device. A correct takeaway keeps the golf ball in the receptacle 12 throughout the back swing. On the down swing, a golfer learns to rotate the wrists through the hitting area while extending the hands along the target line. If done correctly, the ball will leave the receptacle 12 at the bottom of the swing and fly directly down the target line. Any swing other than a correct swing will cause the ball to go left, right, higher or lower of the target line. To further assist the golfer, the device 10 can be used with two one-inch wide ribbons 30, 32 placed parallel to each other on the floor. One ribbon 32, approximately 3 feet long, is used to line up the golfer's feet. The other ribbon 30, approximately 12 feet long, is aligned with the imagined position of the golf ball along the target line. In addition, for the golfer 34 to assess the results of their swing, they can affix a transportable bulls-eye to a wall located down the line of the 12-foot ribbon 30. This gives the golfer 34 visual feedback of the trajectory of the ball as it leaves the receptacle 12.

Figure 9:
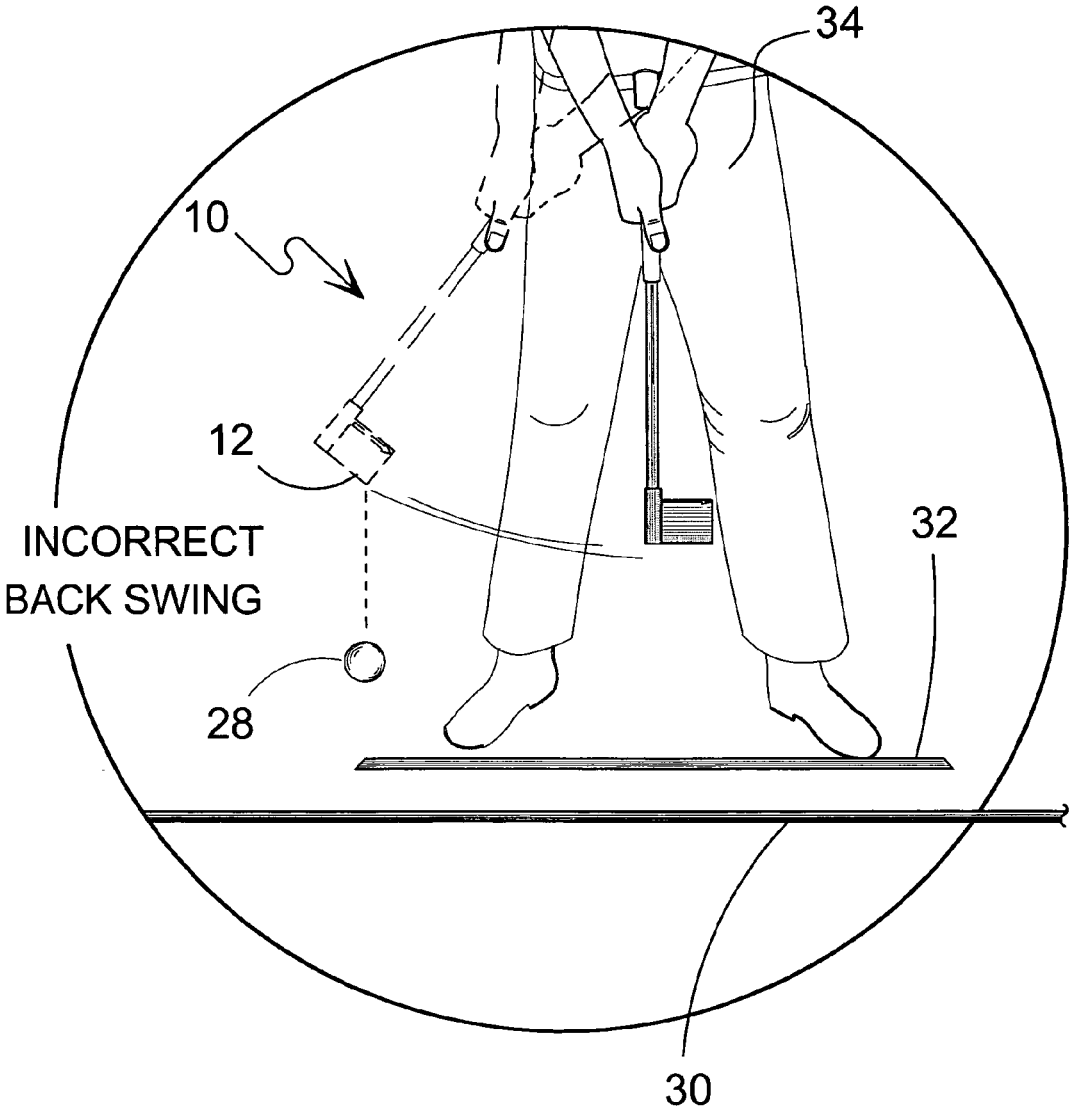
FIG. 9 is an illustrated view of the present invention.

Turning to FIG. 9, shown therein is an illustrated view of the present invention 10 showing an incorrect back swing. To begin the back swing, the golfer 34 must take a low and slow takeaway along the target line while rotating the wrists properly; otherwise, the golf ball 28 will fall out of the receptacle 12 that is attached to the face of the device. A correct takeaway keeps the golf ball 28 in the receptacle 12 throughout the back swing. On the down swing, a golfer 34 learns to rotate the wrists through the hitting area while extending the hands along the target line. If done correctly, the ball 28 will leave the receptacle 12 at the bottom of the swing and fly directly down the target line. Any swing other than a correct swing will cause the ball 28 to go left, right, higher or lower of the target line. To further assist the golfer 34, the device can be used with two one-inch wide ribbons 30, 32 placed parallel to each other on the floor. One ribbon 32, approximately 3 feet long, is used to line up the golfer's feet. The other ribbon 30, approximately 12 feet long, is aligned with the imagined position of the golf ball along the target line. In addition, for the golfer to assess the results of their swing, they can affix a transportable bulls-eye to a wall located down the line of the 12-foot ribbon. This gives the golfer 34 visual feedback of the trajectory of the ball 28 as it leaves the receptacle 12.

Figure 10:
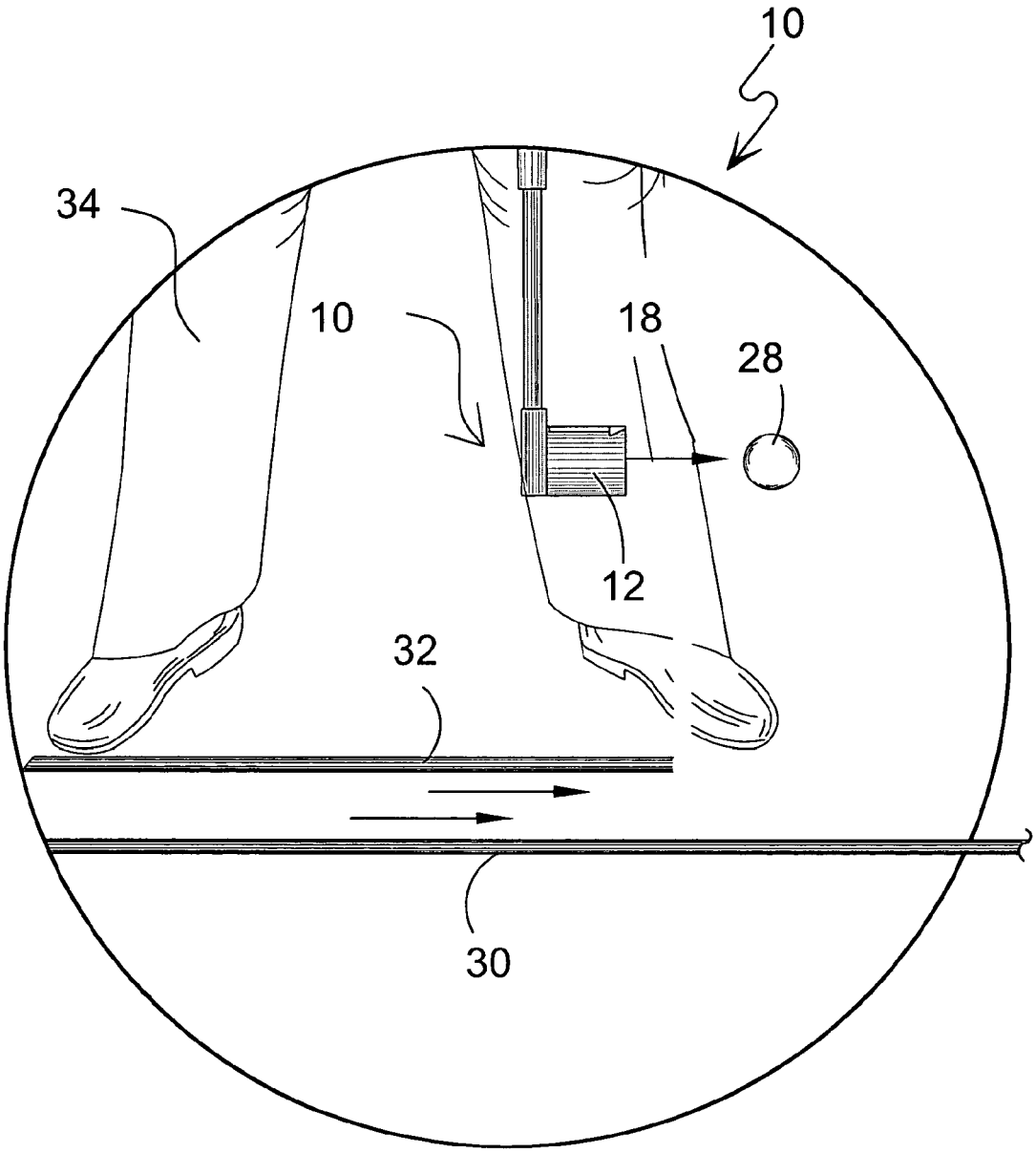
FIG. 10 is an illustrated view of the present invention.

Turning to FIG. 10, shown therein is an illustrated view of the present invention 10. To begin the back swing, the golfer 34 must take a low and slow takeaway along the target line 18 while rotating the wrists properly; otherwise, the golf ball will fall out of the receptacle 12 that is attached to the face of the device. A correct takeaway keeps the golf ball 28 in the receptacle 12 throughout the back swing. On the down swing, a golfer 34 learns to rotate the wrists through the hitting area while extending the hands along the target line. If done correctly, the ball 28 will leave the receptacle 12 at the bottom of the swing and fly directly down the target line 18. Any swing other than a correct swing will cause the ball to go left, right, higher or lower of the target line 18. To further assist the golfer, the device can be used with two one-inch wide ribbons placed parallel to each other on the floor. One ribbon 32, approximately 3 feet long, is used to line up the golfer's feet. The other ribbon 30, approximately 12 feet long, is aligned with the imagined position of the golf ball along the target line. In addition, for the golfer to assess the results of their swing, they can affix a transportable bulls-eye to a wall located down the line of the 12-foot ribbon. This gives the golfer 34 visual feedback of the trajectory of the ball 28 as it leaves the receptacle 12.

Figure 11:
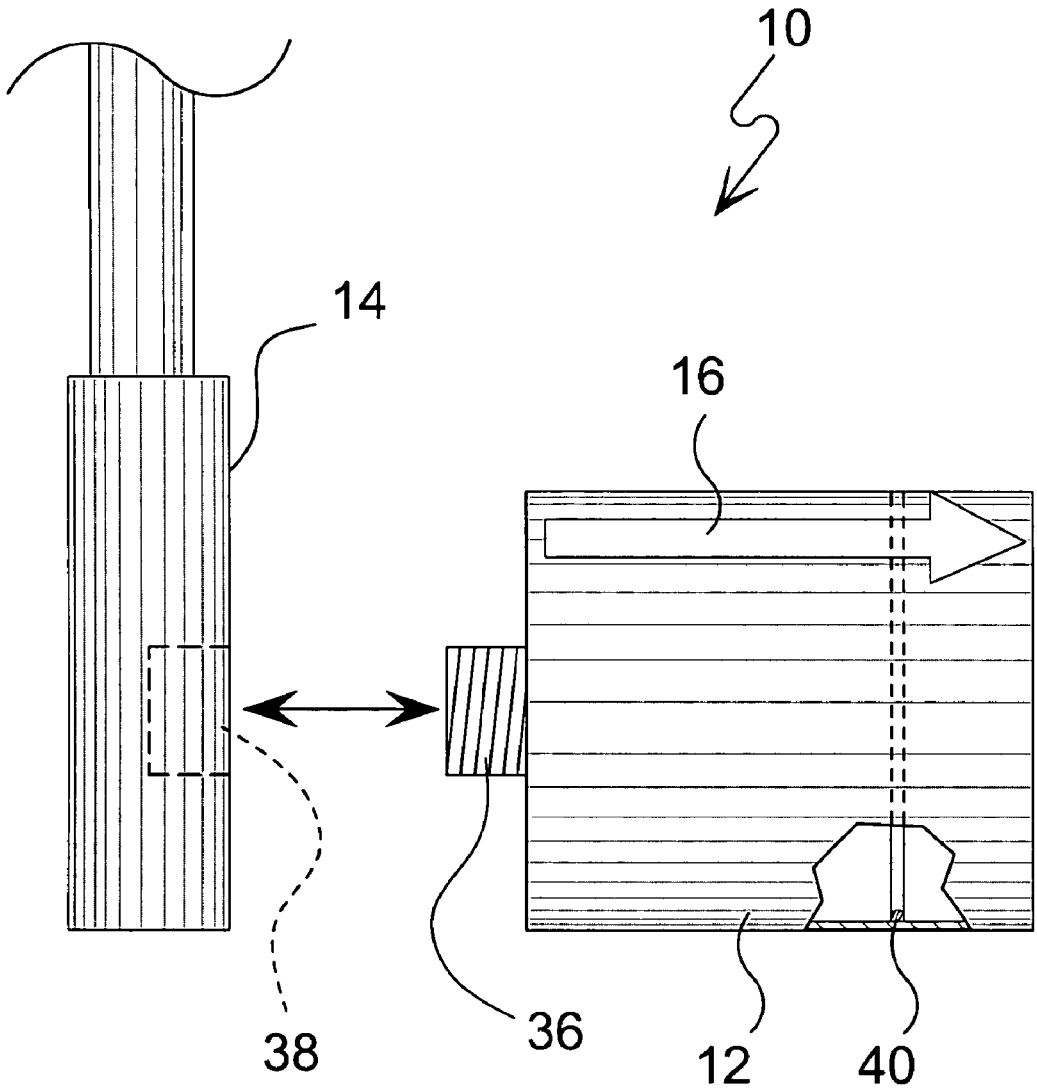
FIG. 11 is a side view of an additional element of the present invention.

Turning to FIG. 11, shown therein is a side view of an additional element of the present invention. Shown is an additional element of the present invention wherein the receptacle 12 is removably fastened to the club face 14. The receptacle 12 has a male threaded member 36 and the club head 14 has a female threaded bore 38. The receptacle 12 may incorporate a circumferentially positioned interior ridge 40 to retard the ball from easily falling out.

Figure 12:
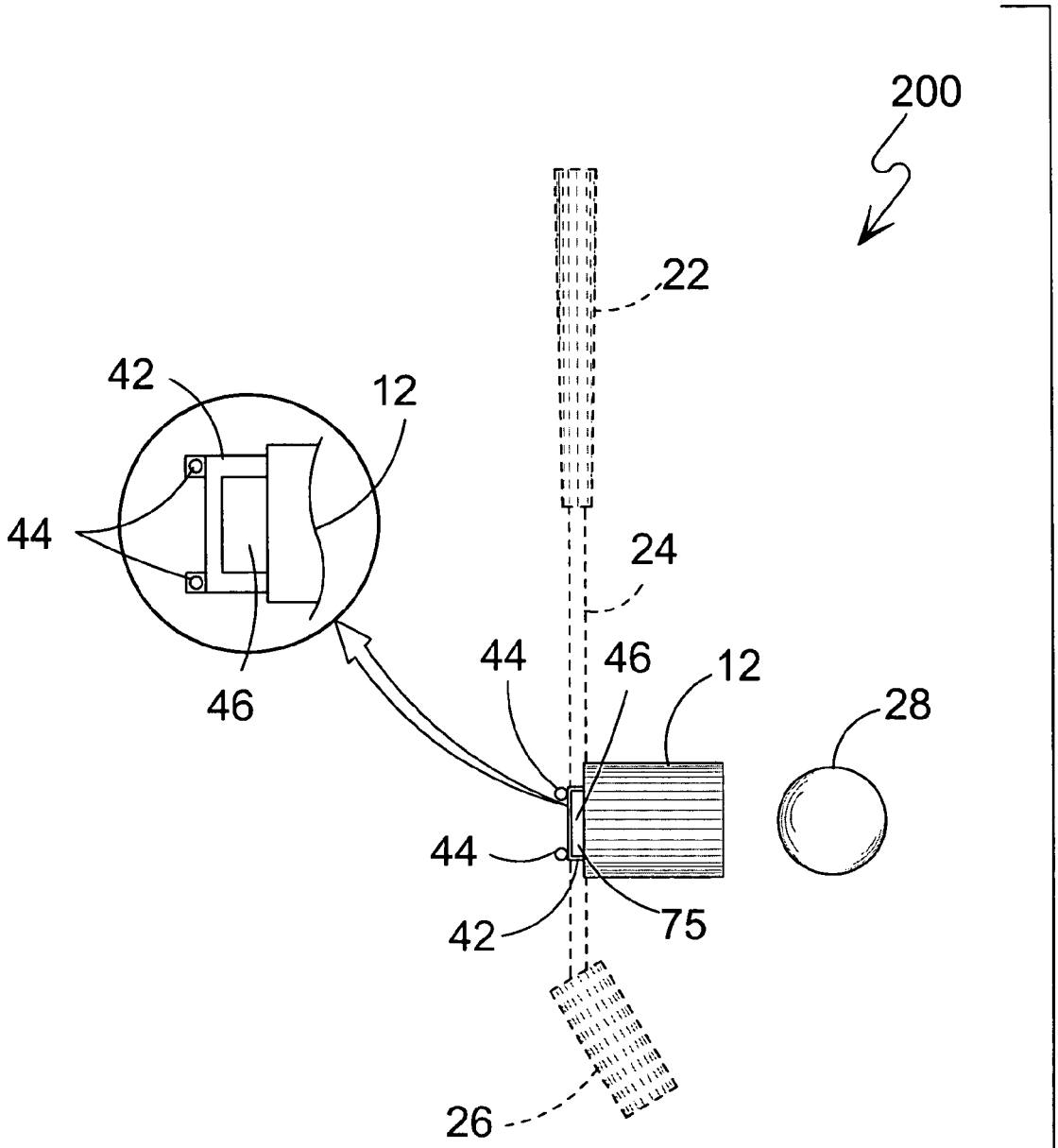
FIG. 12 is a side view of the shaft mounted version of the present invention.

Turning to FIG. 12, shown therein is a side view of an additional element of the present invention. Shown is an additional element of the present invention wherein the golf swing training device 200 incorporates means for attachment to any golf club shaft 24 by integrating receptacle 12, support 75 and clamp 42 thereby enabling the golfer to selectively attach the present invention 200 to any desired club.

Figure 13:
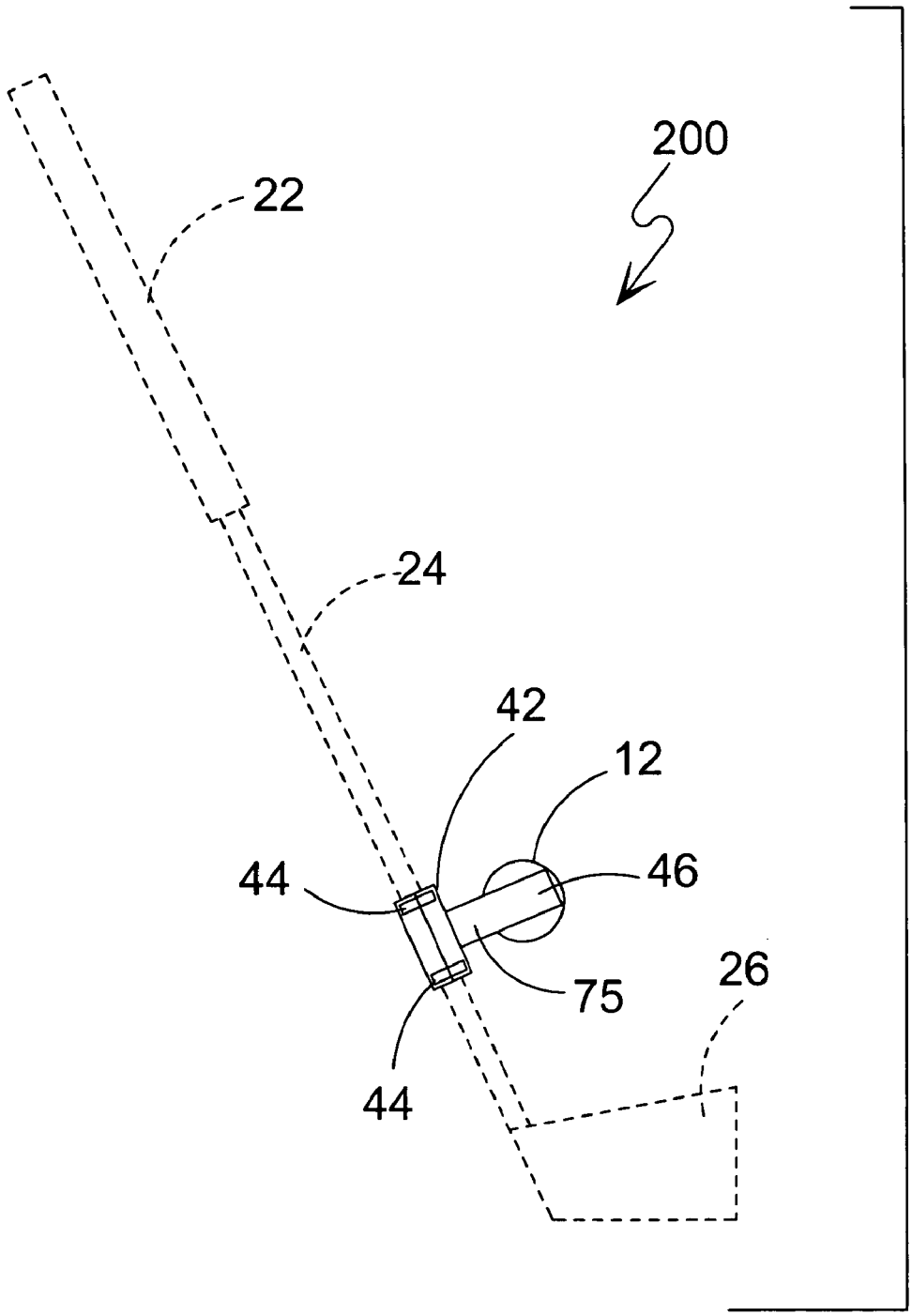
FIG. 13 is a back view of the shaft mounted version of the present invention.

Turning to FIG. 13, shown is a back view of the mountable golf swing training device. Shown is the golf swing training device 200 comprising receptacle 12 having receptacle support 75 selectively attached to golf club shaft 24 using clamp 42 comprising mating clamp members having clamp fastening apertures for the insertion therein of a fastener. Extending from one of the mating clamp members in cantilevered fashion is clamp arm 46 with receptacle 12 mounted thereon.

Figure 14:
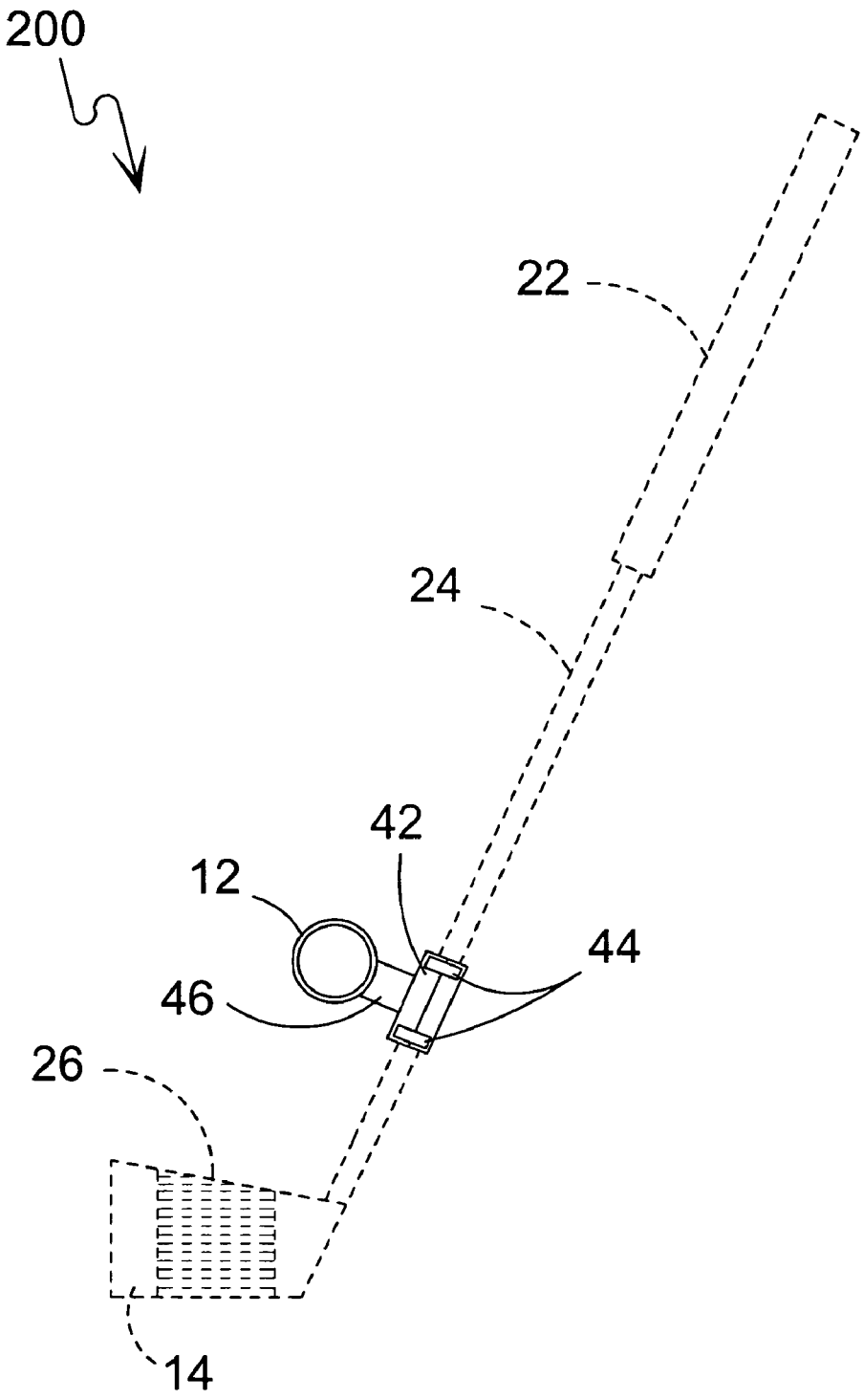
FIG. 14 is a front view of the shaft mounted version of the present invention.

Turning to FIG. 14, shown is a front view of the mountable golf swing training device. Shown is the present invention 200 mounted to a golf club having grip 22, shaft 24 and club head 26. The golf swing training device has mating members forming clamp 42 whereby said device can be selectively mounted to any desired golf club. Each of the members has a threaded throughbore for insertion therein of fasteners releasably fixing the device to a golf club shaft 24. Cantilevered from one of the clamp members is clamp arm 46 having receptacle 12 thereon.

Figure 15:
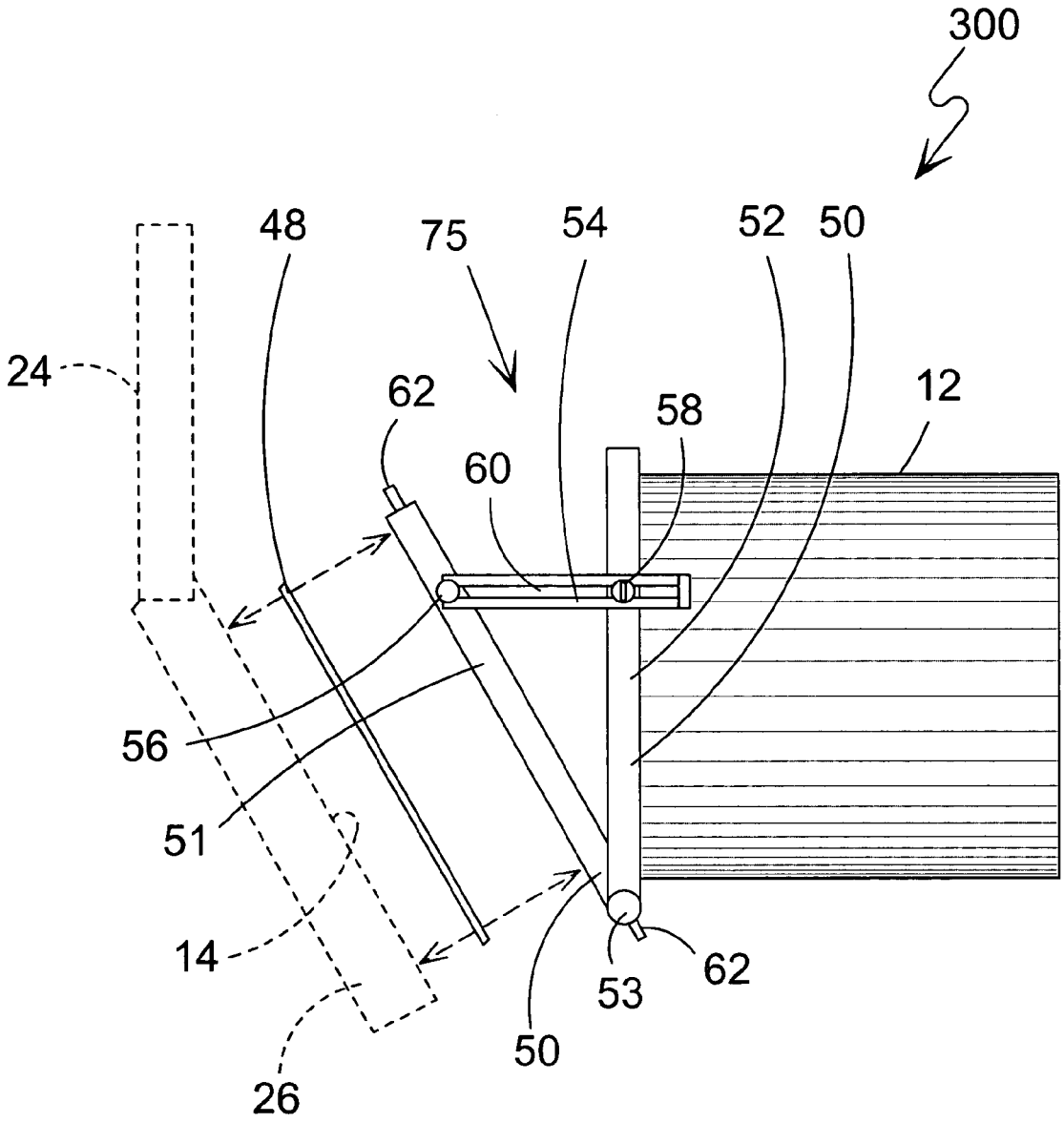
FIG. 15 is a side view of the golf club face mounted version of the present invention.

Turning to FIG. 15, shown therein is a side view of another additional element of the present invention. Shown is another additional element of the present invention wherein the golf swing training device 300 incorporates a mountable frame 50, as receptacle support 75 having pivotal members 51, 52 that provide means for adjusting the receptacle angle relative to the mounted surface, which in this case is club face 14. Once the desired angle has been determined. Set screw 58 is tightened to fix the angle between golf club head 26 and receptacle 12.

Figure 16:
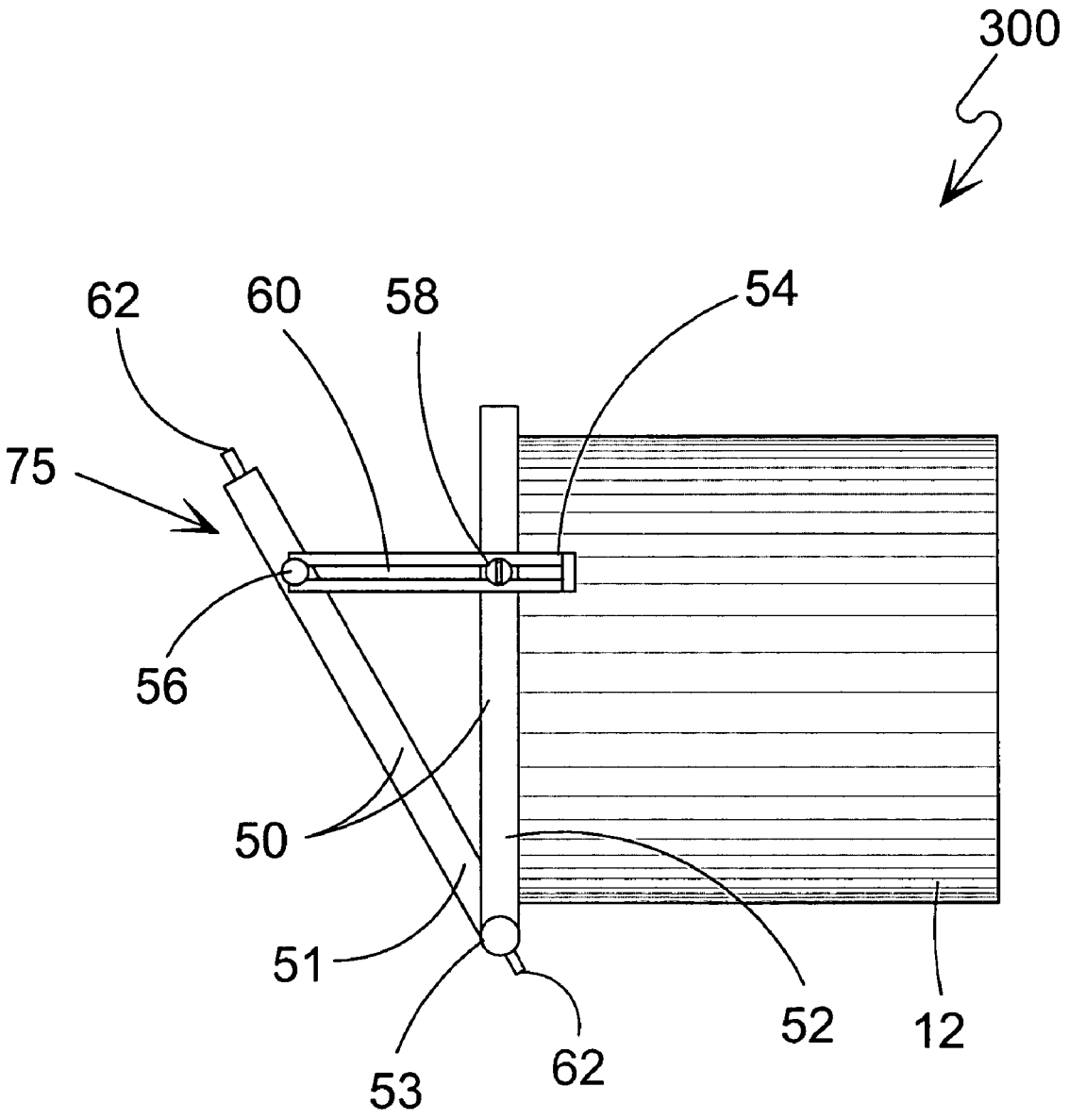
FIG. 16 is a side view of the golf club face mounted version of the present invention.

Turning to FIG. 16, shown therein is a side view of another additional element of the present invention. The present invention 300 provides for another means of attaching the present invention to a golf club head 26. The additional means incorporates a mounting frame 50, as receptacle support 75, comprising two planar members 51, 52 pivotally connected by frame hinge 53 with slide stay 54 for fixedly setting a desired angle between the pivotal members. Slide stay 54 is pivotally anchored 56 to one of the frame members with slide stay 54 having a longitudinal slot 60 with set screw 58, which is threadedly fastened to the other mounting frame member, traveling therein. In operation, the present invention 300 is fastened to a golf club face 14 whereupon the user loosens the mounting frame set screw 58, adjusts the receptacle 12 to the desired angle and tightens set screw 58.

Figure 17:
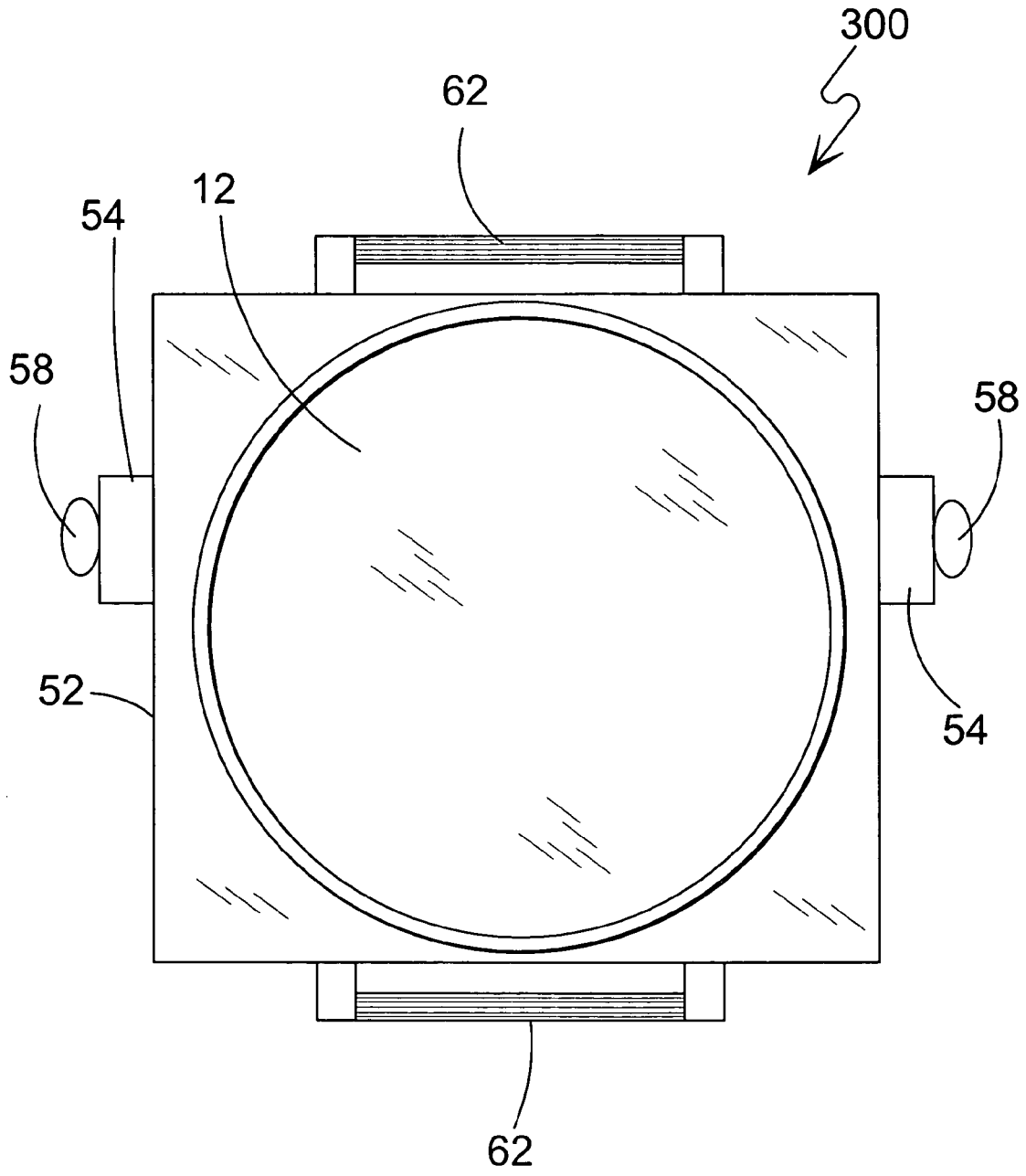
FIG. 17 is a front view of the golf club face mounted version of the present invention.

Turning to FIG. 17, shown is a front view of the mountable golf swing training device. Shown is the present invention 300 comprising mountable frame 50 having receptacle 12 mounted thereon. Angular adjustment of receptacle 12 relative to golf club head 26 is achieved by loosening set screw 58 traveling in slide aperture 60 of slide 54. When the desired angle has been determined, set screw 58 is tightened and the present invention 300 is ready for use. The present invention 300 also provides for additional means for securing the present invention 300 to golf club head 26 by incorporating strap loops 62 positioned on the top and bottom side of that portion of mounting frame 50 that fastens to golf club head 26. Strap loops 62 can have a length of hook and loop material extending from one strap loop over the back side of club head 26 and releasably fastened to the other strap loop 62 thereby providing an additional means of mounting the present invention 300 comprised of mounting frame 50.

Figure 18:
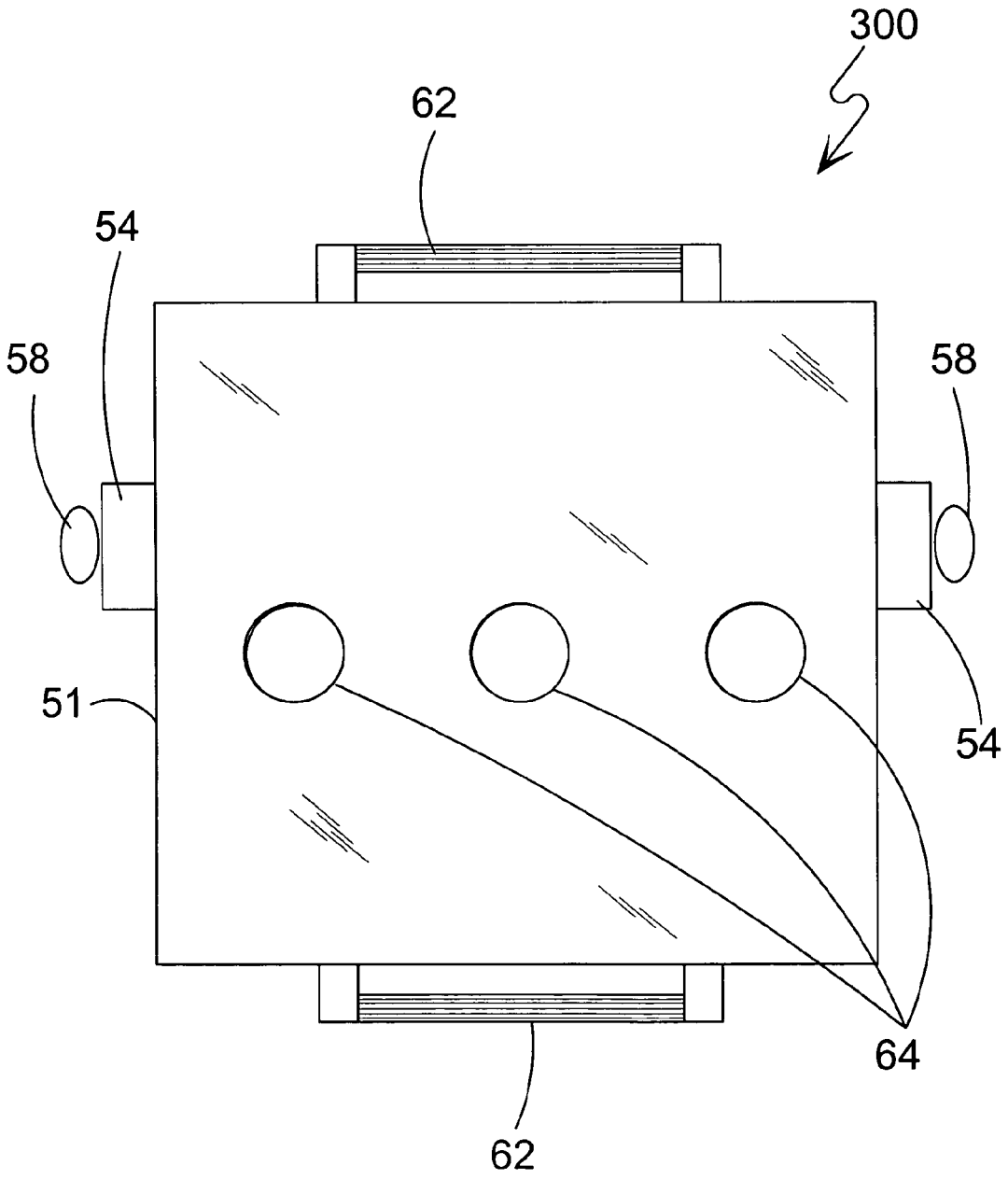
FIG. 18 is a back view of the golf club face mounted version of the present invention.

Turning to FIG. 18, shown is a back view of the golf club head mountable golf swing training device. Shown is a back view of mounting frame 50 that mounts to golf club face 14 of golf club head 26. As previously stated, angular adjustment of receptacle 12 relative to golf club head 26 is achieved by loosening set screw 58 traveling in slide aperture 60 of slide 54. When the desired angle has been determined, set screw 58 is tightened and the present invention 300 is ready for use. The present invention 300 also provides for additional means for securing the present invention 300 to golf club head 26 by incorporating strap loops 62 positioned on the top and bottom side of that portion of mounting frame 50 that fastens to golf club head 26. Strap loops 62 can have a length of hook and loop material extending from one strap loop over the back side of club head 26 and releasably fastened to the other strap loop 62 thereby providing an additional means of mounting the present invention 300 comprised of mounting frame 50. Additionally, the present invention provides frame mounting apertures 64 whereby the present invention can be releasably fixed to golf club head 26 using appropriated fasteners.

Figure 19:
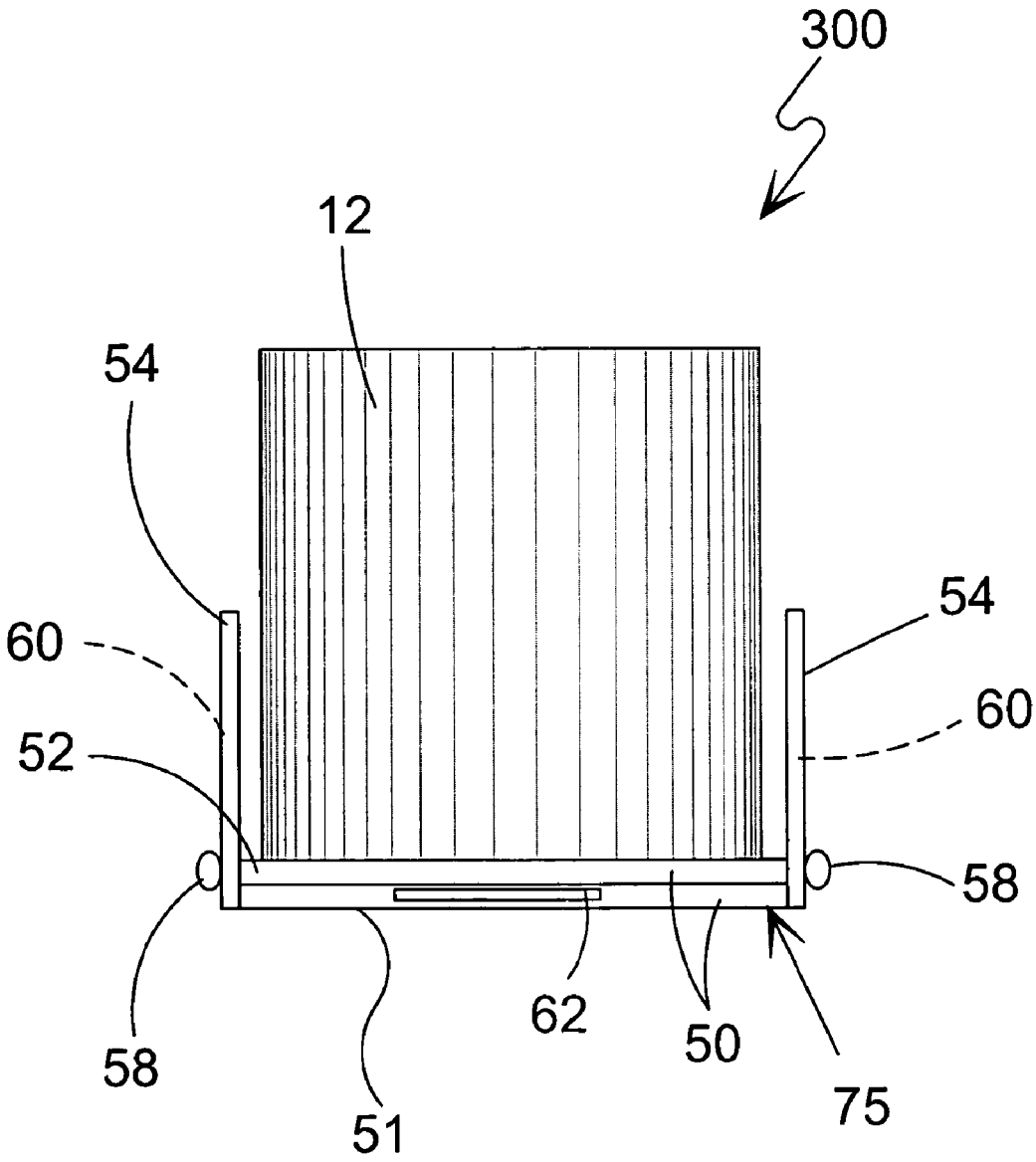
FIG. 19 is a top view of the golf club face mounted version of the present invention.

Turning to FIG. 19, shown therein is a top view of the golf club head mountable golf swing training device 300 of the present invention. Mounting frame 50 is comprised of pivotally fastened planar members, which serve as receptacle support 75. As illustrated, the front pivotal member 52 has receptacle 12 depending therefrom with set screws 58 located on opposing sides traveling in longitudinal slot 60 of slide 54. Slide 54 is pivotally fastened to the back pivotal frame member 51. Since the front and back frame members 51, 52 are hingedly fastened at the base using mounting frame hinge 53, angular divergence of the front pivotal frame member 52 relative to the back pivotal frame member 51 is therein provided with slide stay 54 and set screws 58 providing means for releasably fixing the desired angular displacement.

Figure 20:
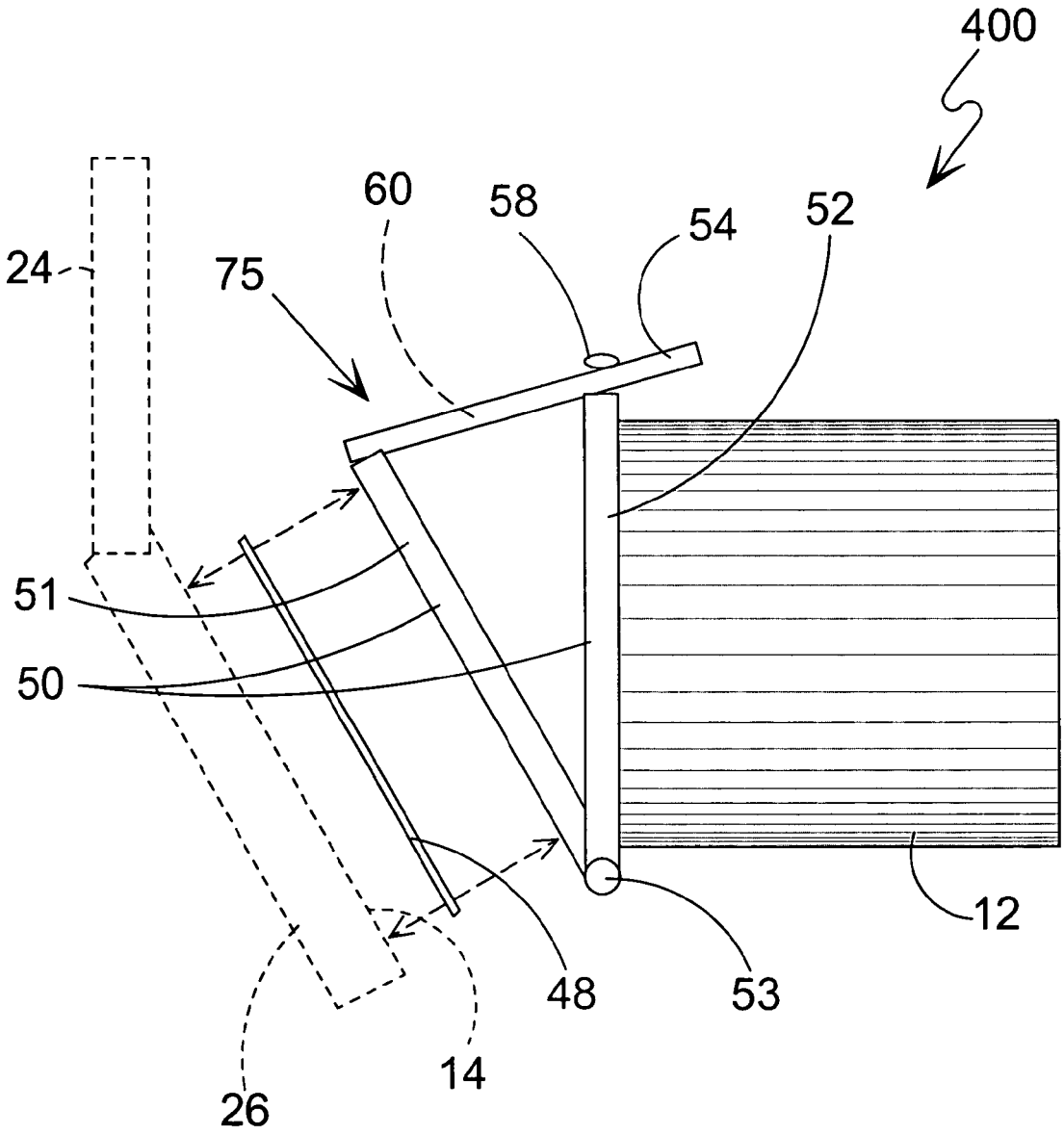
FIG. 20 is a side view of another golf club face mounted version of the present invention.

Turning to FIG. 20, shown therein is a side view of another additional element of the present invention. Shown is another additional element of the present invention wherein the golf swing training device 400 incorporates a mountable frame 50 having golf club head mountable frame member 51 and receptacle mounted frame member 52, serving as receptacle support 75, pivotally fastened together by mounting frame hinge 53 thereby providing means for adjusting the receptacle angle relative to club face 14. Also shown is one means for attaching the present invention 400 to golf club head 26 using double face tape 48. After attachment of the device 400 to club face 14, a desired angle is set by pivoting receptacle mounted frame member 52 to a desired angle. Once the desired angle has been determined. Set screw 58 is tightened to fix the angle between golf club head 26 and receptacle 12.

Figure 21:
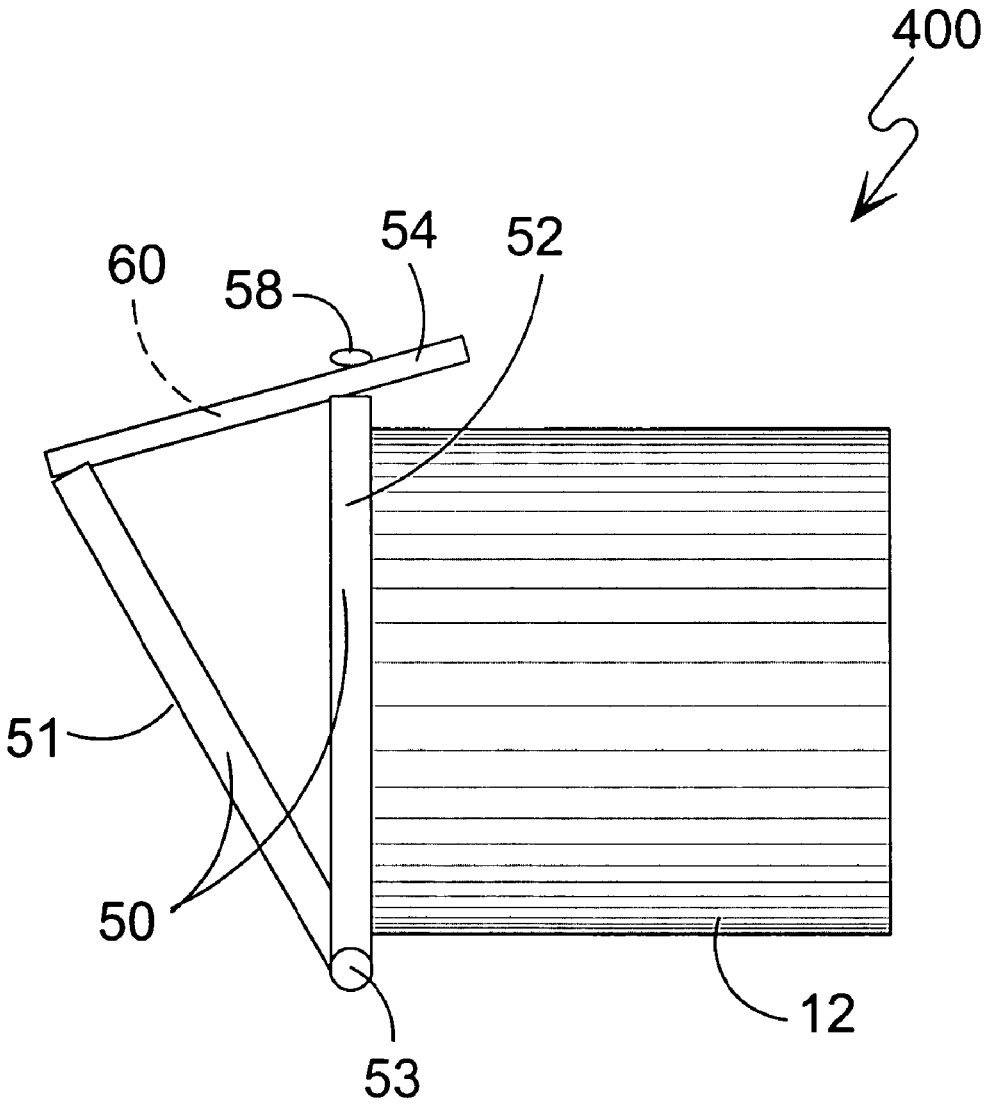
FIG. 21 is a side view of the other golf club face mounted version of the present invention.

Turning to FIG. 21, shown therein is a side view of the additional element depicted in FIG. 20. The present invention 400 provides for another means for attaching the present invention to a golf club head 26. The additional means incorporates mounting frame 50 comprising two planar members 51, 52 pivotally connected by mounting frame hinge 53 with slide stay 54 for fixedly setting a desired angle between the pivotal members. Slide stay 54 is mounted to the top side of head mounted frame member 51 with slide stay 54 having a longitudinal slot 60 with set screw 58, which is threadedly fastened to the top side of receptacle mounted frame member 52 traveling in slide aperture 60 providing means for fixedly positioning one mounting frame member relative to the other.

Figure 22:
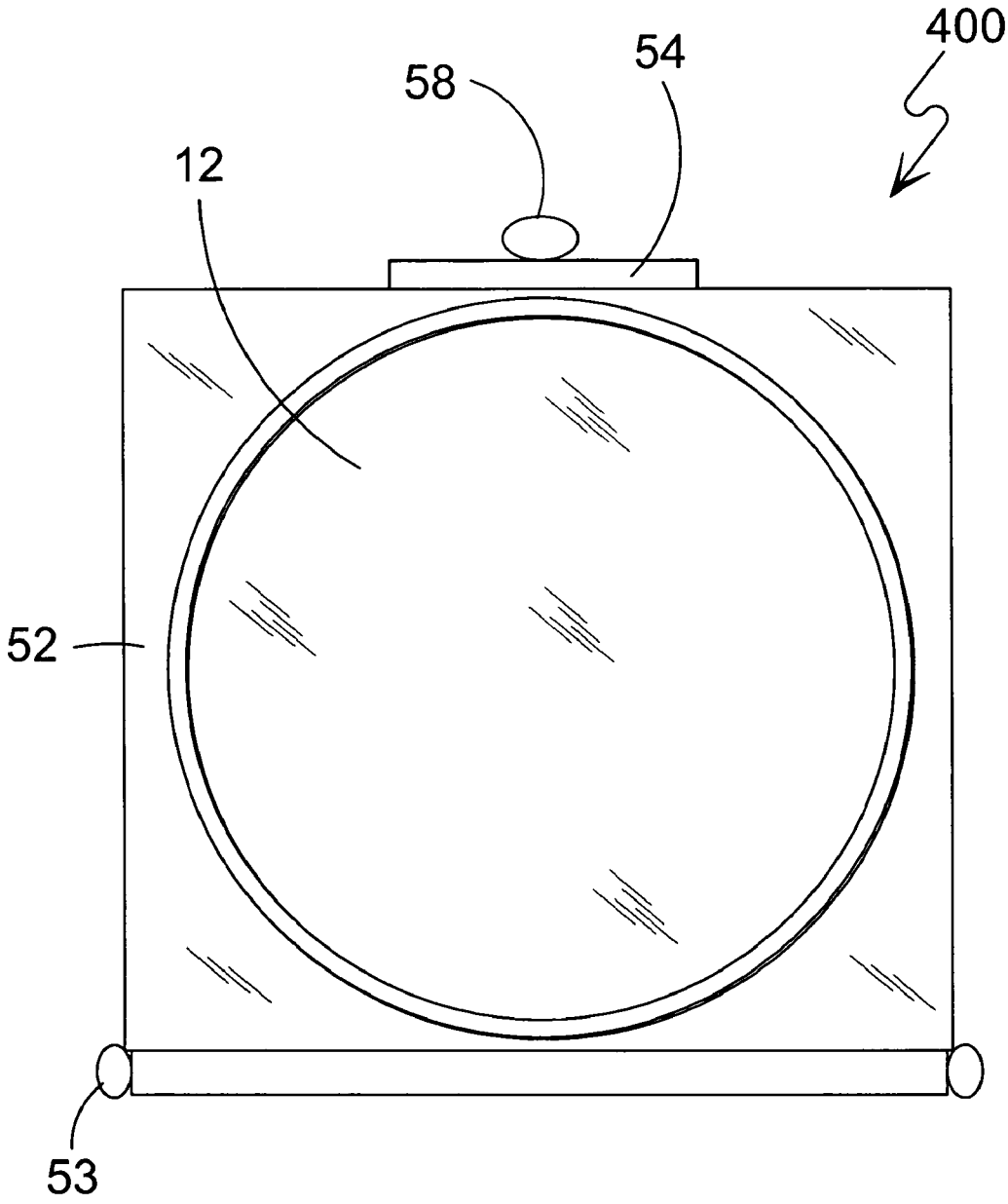
FIG. 22 is a front view of the other golf club face mounted version of the present invention.

Turning to FIG. 22, shown is a front view of the mountable golf swing training device illustrate in FIG. 20. Shown is the present invention 400 comprising mountable frame 50 having golf club head mountable member 51 and receptacle mounted member 52 having receptacle 12 mounted thereon. Angular adjustment of receptacle 12 relative to golf club head 26 is achieved by loosening set screw 58 traveling in slide aperture 60 of slide 54. When the desired angle has been determined, set screw 58 is tightened and the present invention 400 is ready for use.

Figure 23:
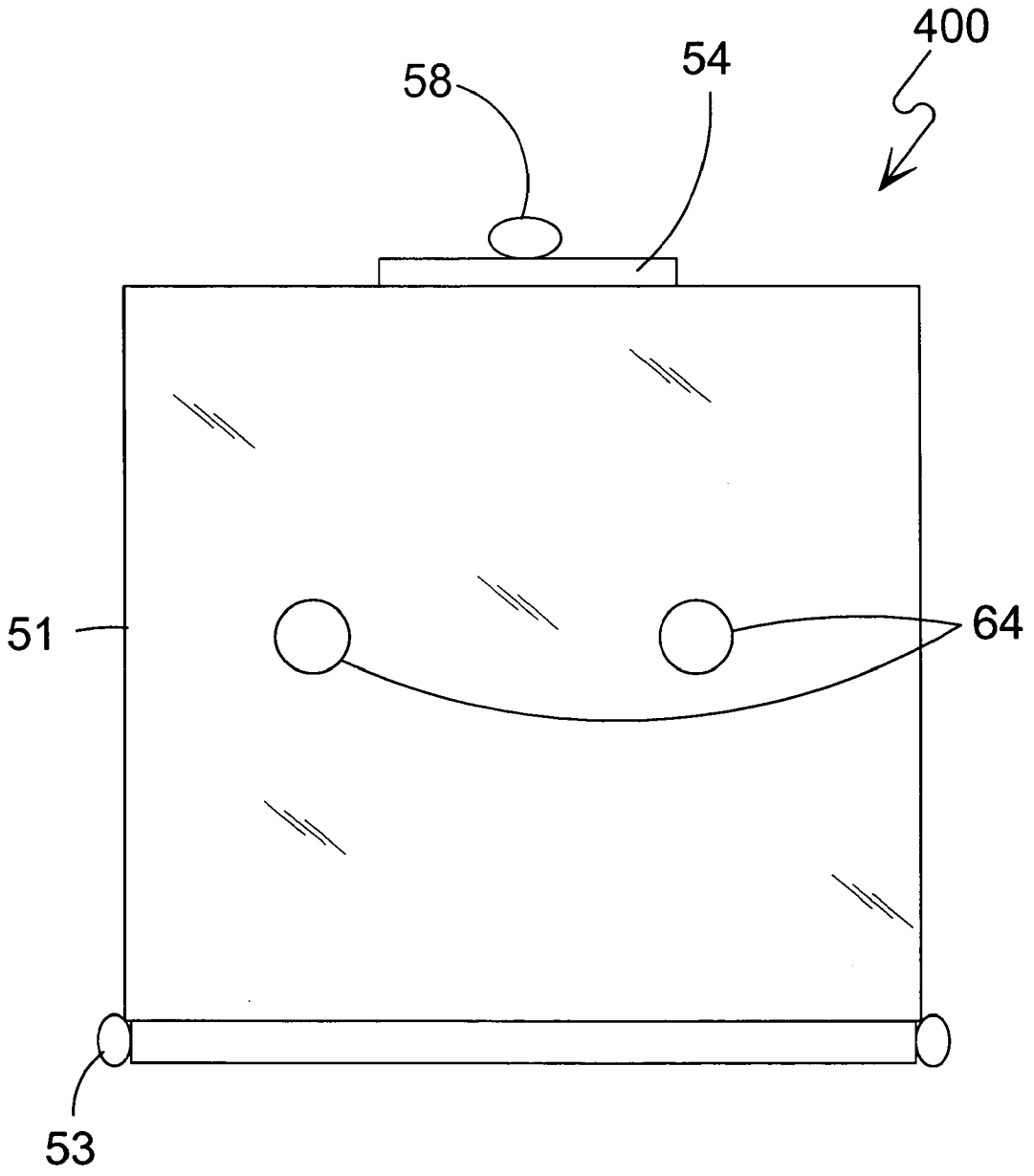
FIG. 23 is a back view of the other golf club face mounted version of the present invention.

Turning to FIG. 23, shown is a back view of the golf club head mountable golf swing training device as shown in FIG. 20. Shown is a back view of the present invention 400 having head mounted frame member 51 that mounts to golf club face 14 of golf club head 26. As previously stated, angular adjustment of receptacle 12 relative to golf club head 26 is achieved by loosening set screw 58 traveling in slide aperture 60 of slide 54. When the desired angle has been determined, set screw 58 is tightened and the present invention 400 is ready for use. The present invention 400 also provides for additional means for securing the present invention 400 to golf club head 26 by providing frame mounting apertures 64 whereby the present invention can be releasably fixed to golf club head 26 using the appropriated fasteners.

Figure 24:
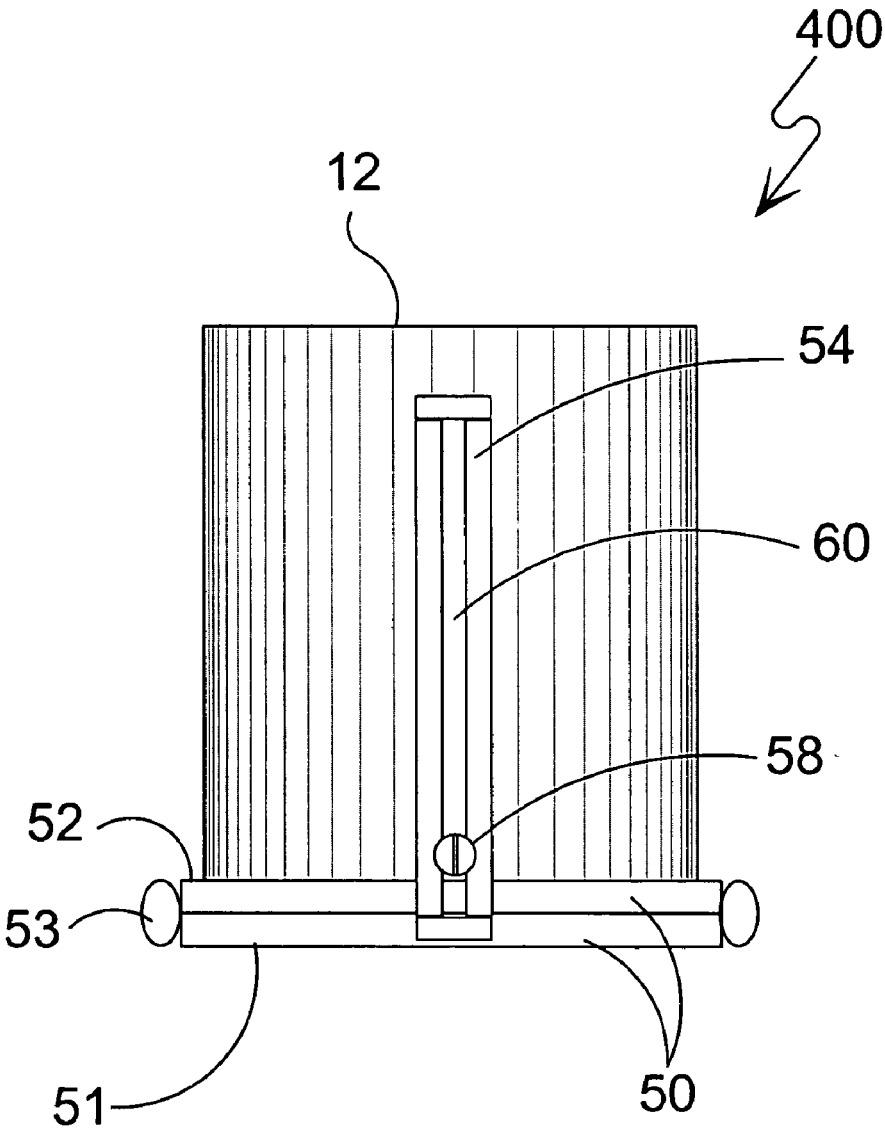
FIG. 24 is a top view of the other golf club face mounted version of the present invention.

Turning to FIG. 24, shown therein is a top view of the golf club head mountable golf swing training device 400 of the present invention. Mounting frame 50 is comprised of pivotally fastened members 51, 52 by means of mounting frame hinge 53. As illustrated, the front pivotal member 52 has receptacle 12 mounted thereon with set screw 58 located on the top edge of pivotal member 52 traveling in longitudinal slot 60 of slide stay 54. Slide 54 is fastened to the top edge of back mounted frame member 51. Since the front and back frame members 51, 52 are hingedly fastened at the base using mounting frame hinge 53, angular divergence of the front pivotal frame member 52 relative to the back pivotal frame member 51 is therein provided with slide stay 54 and set screw 58 providing means for releasably fixing the desired angular displacement.

Figure 25:
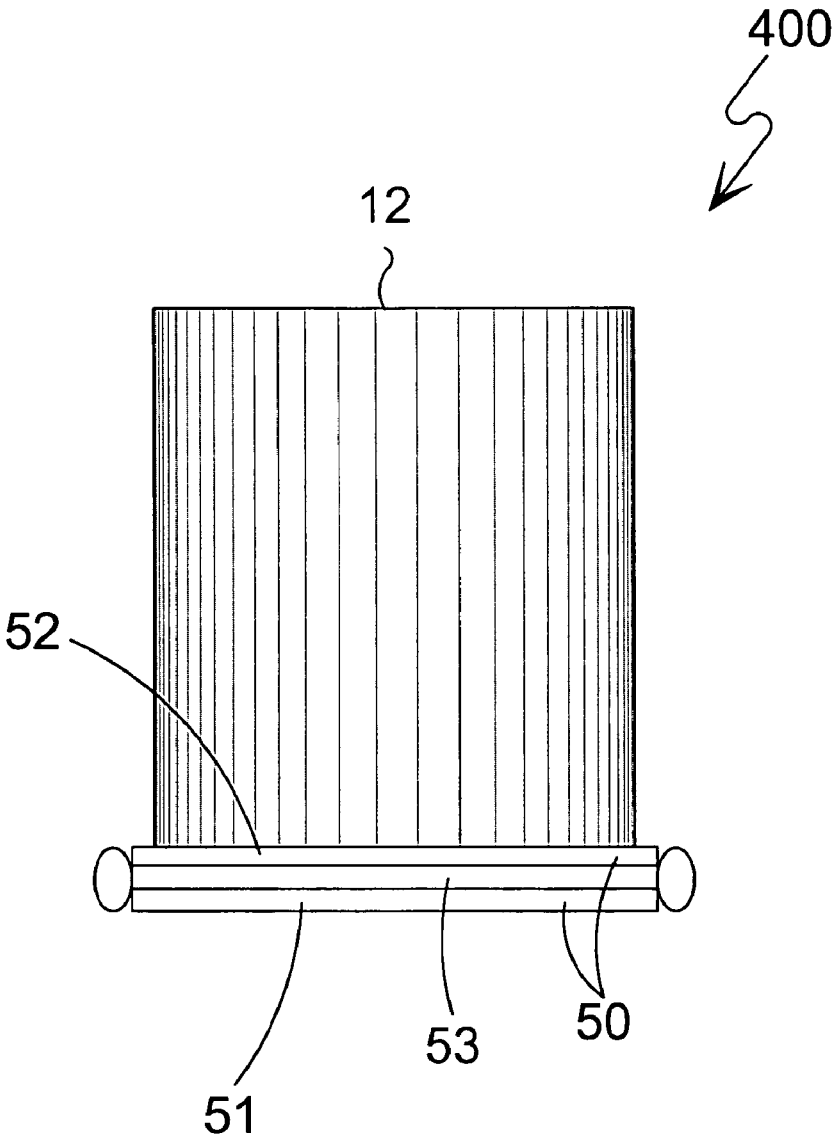
FIG. 25 is a bottom view of the other golf club face mounted version of the present invention.

Turning to FIG. 25, shown therein is a bottom view of the golf club head mountable golf swing training device 400 of the present invention. As previously described mounting frame 50 is comprised of pivotally fastened members 51, 52 by means of mounting frame hinge 53. Since the front and back frame members 51, 52 are hingedly fastened at the base using mounting frame hinge 53, angular divergence of the front pivotal frame member 52 relative to the back pivotal frame member 51 is therein provided with slide stay 54 and set screw 58 providing means for releasably fixing the desired angular displacement.

Figure 26:
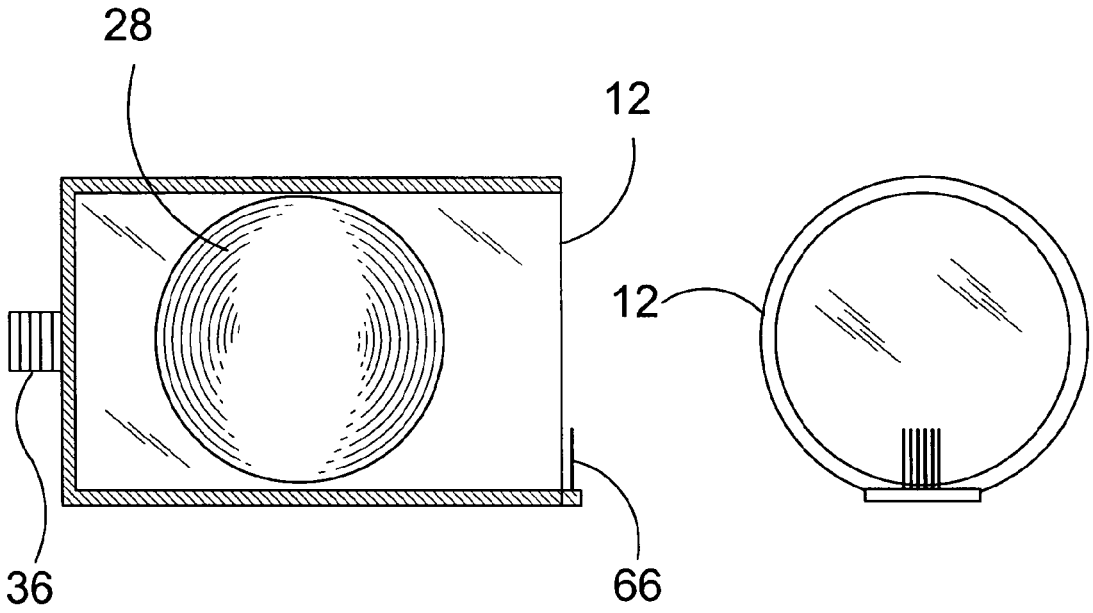
FIG. 26 is another type of restrainer comprising bristle mounted on receptacle lip.
Figure 27:
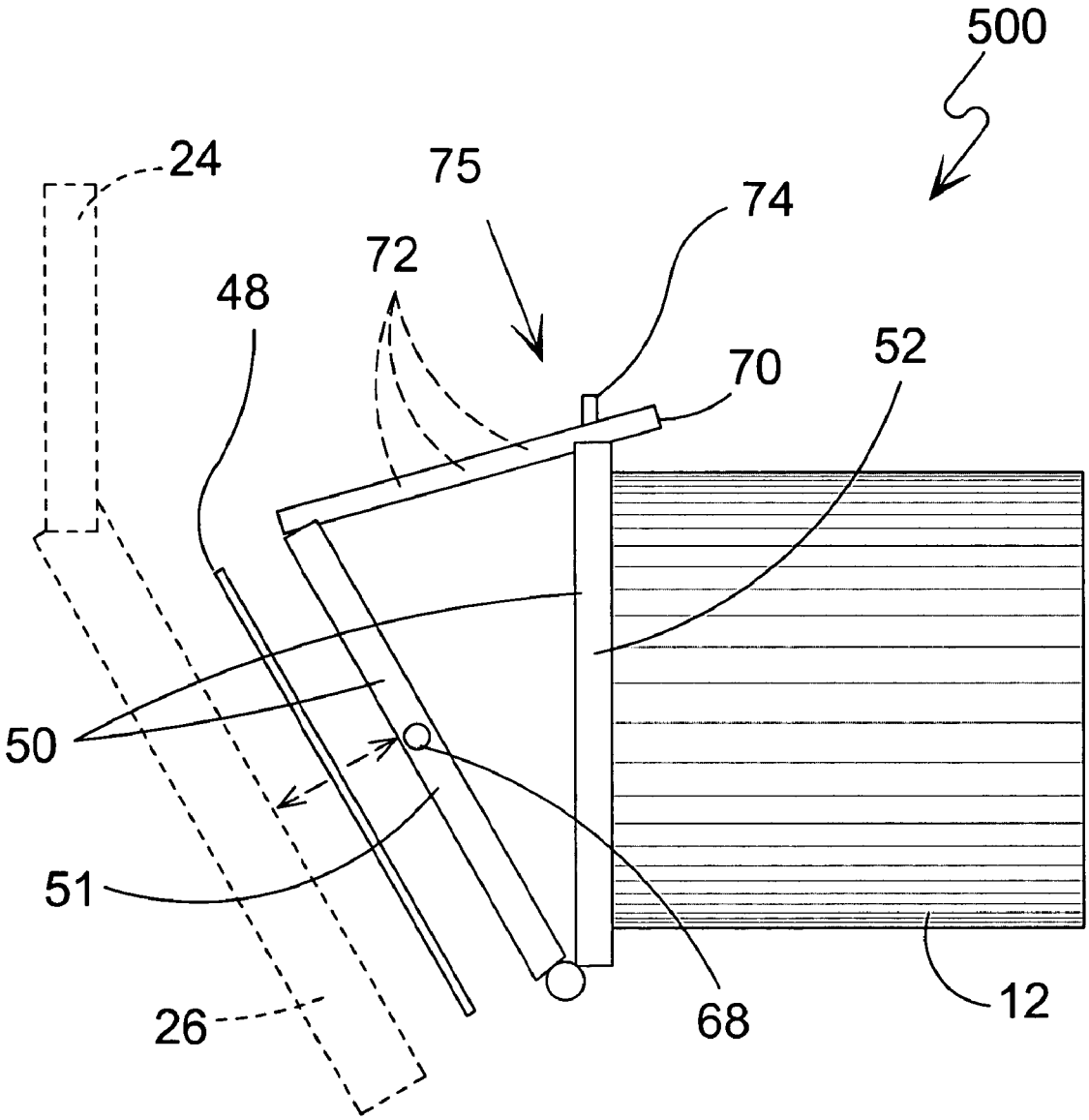
FIG. 27 is a side view of an alternate golf club face mounted version of the present invention.

Turning to FIG. 26, shown therein is a side view of an additional element of the present invention. Shown is an additional element of the present invention wherein the receptacle 12 is removably fastened to the club face 14. The receptacle 12 has a male threaded member 36 and the club head 14 has a female threaded bore 38. The receptacle 12 may incorporate a partially circumferentially positioned plurality of receptacle mounted bristles 66 to retard the ball from easily falling out of the receptacle and frustrating the novice golfer Turning to FIG. 27, shown therein is a side view of another additional element of the present invention. Shown is another additional element 500 of the present invention wherein the golf swing training device 500 incorporates a mountable frame 50, serving as receptacle support 75 having pivotal members that provide means for adjusting the receptacle angle relative to the mounted surface, which in this case is club face 14. Once the desired angle has been determined, adjuster strap 70 having a plurality of adjuster strap apertures 72 is snapped onto the adjuster strap post 74 at the appropriate aperture 72 that will maintain the desired angular displacement.

Figure 28:
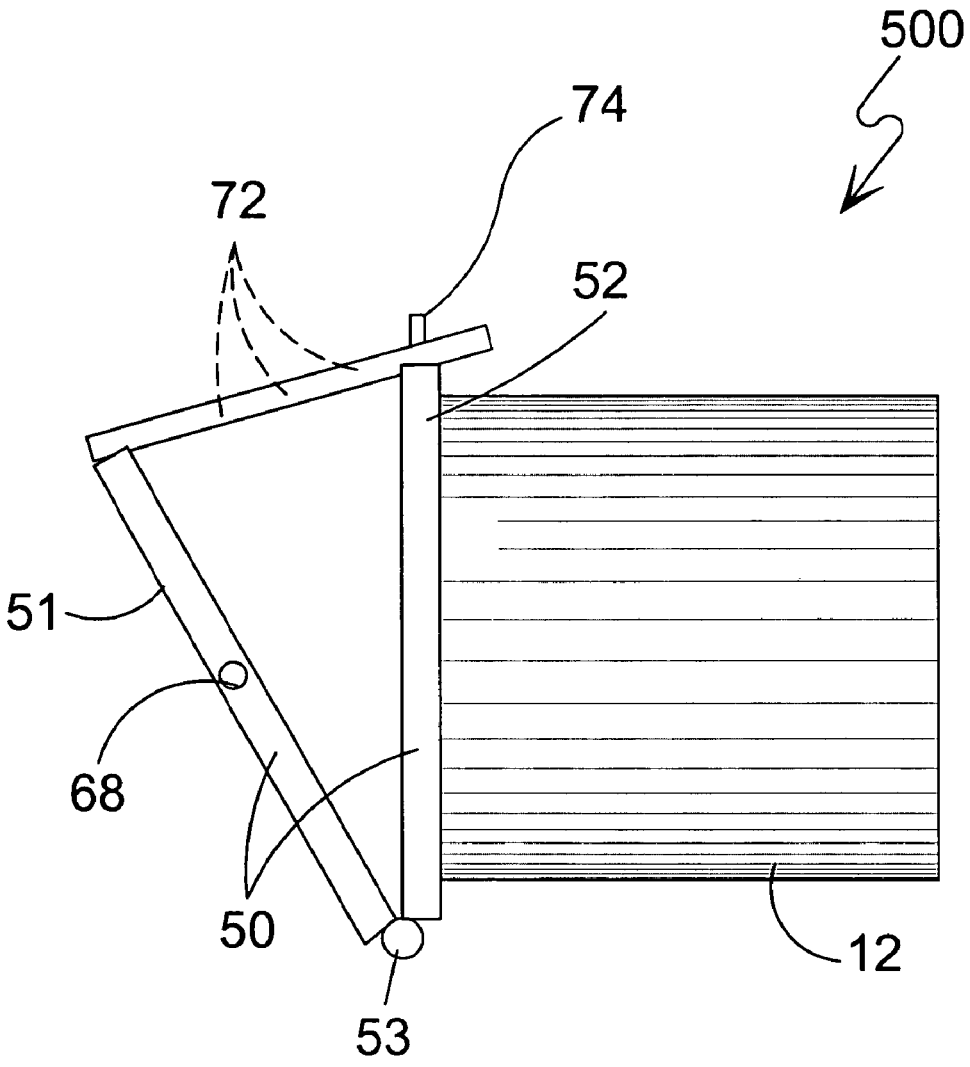
FIG. 28 is a side view of the alternate golf club face mounted version of the present invention.

Turning to FIG. 28, shown therein is a side view of the additional element as shown in FIG. 27. The present invention 500 provides for another means for attaching the present invention to a golf club head 26. The additional means incorporates a mounting frame 50 comprising head mounted frame member 51 and receptacle mounted frame member 52 connected by mounting frame hinge 53 with adjuster strap 70 providing means for fixedly setting a desired angle between the pivotal members 51, 52. Adjuster strap 70 is fastened to the top edge of frame member 51 with an adjuster strap post extending from the top edge of frame member 52. Adjuster strap 70 has a plurality of spaced apart apertures 72. In operation, the present invention 500 is fastened to a golf club face 14 of golf club head 26 whereupon the user positions receptacle mounted frame member 52 to a desired angle relative to the head mounted frame member 51. When the desired angle is determined, the selected adjuster strap aperture 72 of adjuster strap 70 is pressed onto adjuster strap post 74 fixing the desired angle until selectively changed.

Figure 29:
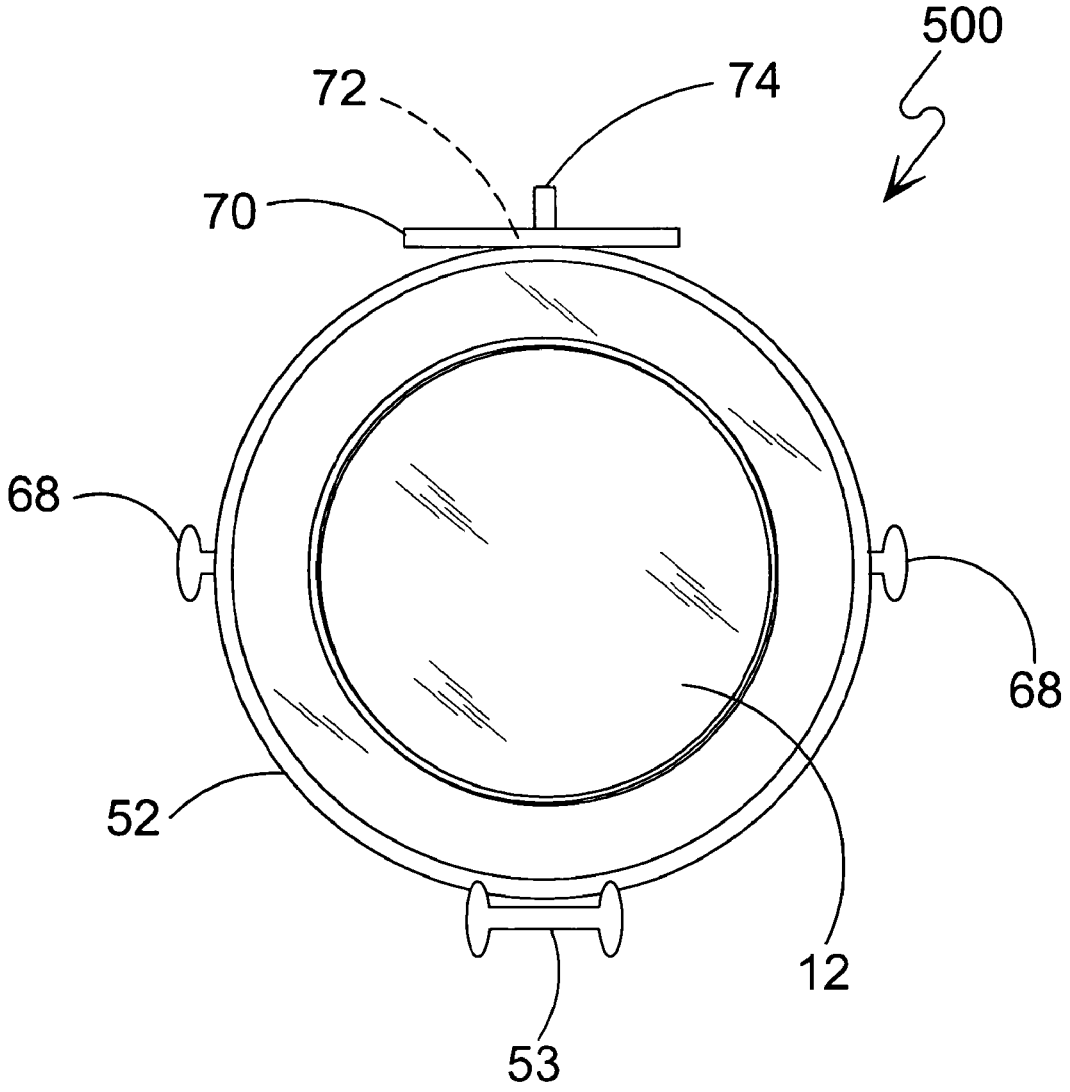
FIG. 29 is a front view of the alternate golf club face mounted version of the present invention.

Turning to FIG. 29, shown is a front view of the mountable golf swing training device as depicted in FIG. 27. Shown is the present invention 500 comprising mountable frame 50 having receptacle 12 mounted thereon. Angular adjustment of receptacle 12 relative to golf club head 26 is achieved by selecting an adjuster strap aperture 72 and pressing the aperture 72 onto adjuster strap post 74. The present invention 500 also provides for additional means for securing the present invention 500 to golf club head 26 by incorporating a safety strap (not shown) and safety strap anchors 68 positioned on opposing sides of head mounted frame member 51. The safety strap is fixed to one of the safety strap anchors 68 and extended across the back of golf club head 26 and fastened to the opposing safety strap anchor 68 thereby providing an additional means of mounting the present invention 500 to golf club head 26.

Figure 30:
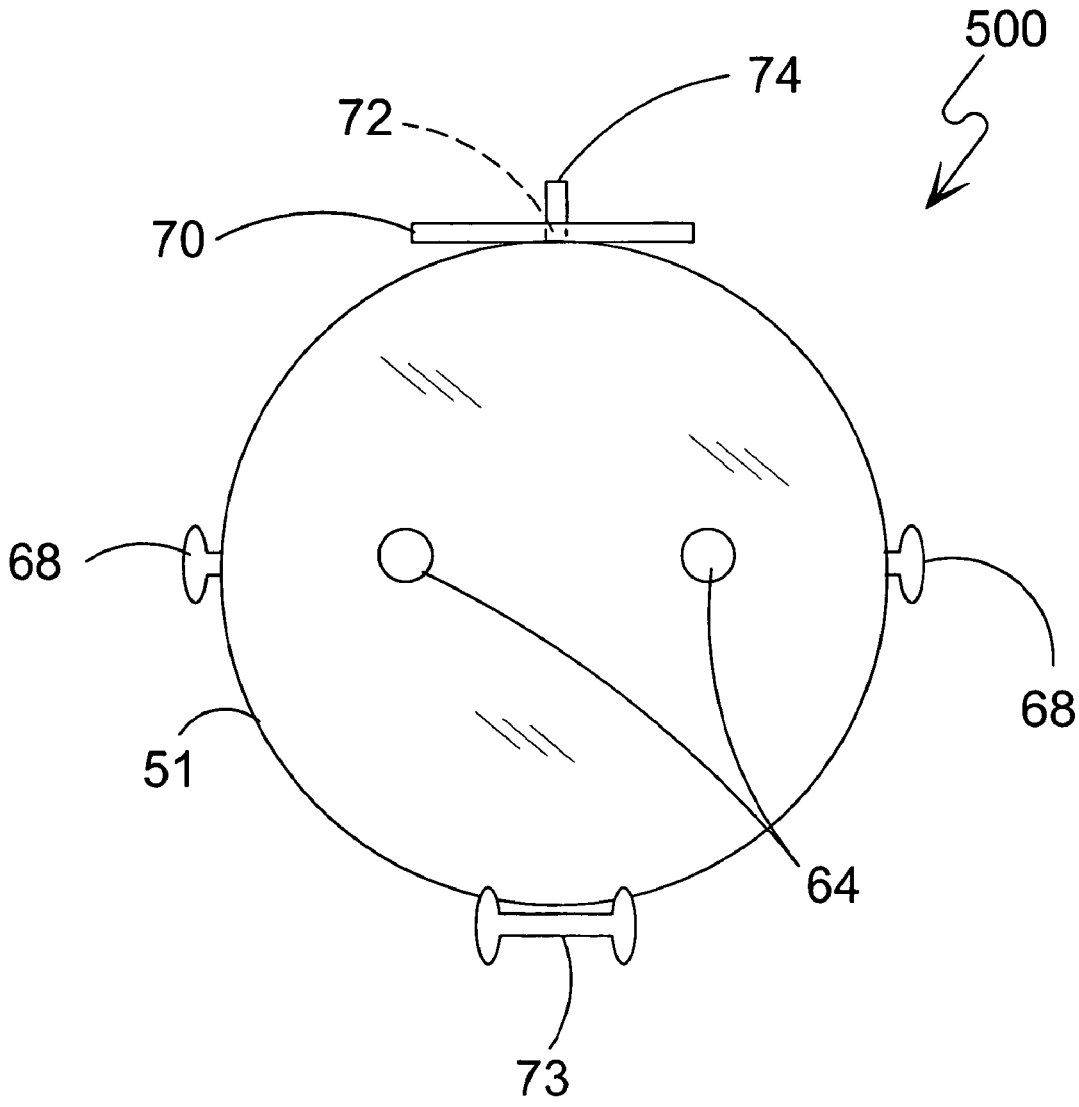
FIG. 30 is a back view of the alternate golf club face mounted version of the present invention.

Turning to FIG. 30, shown is a back view of the golf club head mountable golf swing training device illustrated in FIG. 27. Shown is a back view of the present invention 500 having head mounted frame member 51 that mounts to golf club face 14 of golf club head 26. As previously stated for this additional element, angular adjustment of receptacle 12 relative to golf club head 26 is achieved by determining a desired angular displacement, noting the appropriate adjuster strap aperture and pushing said aperture 72 onto adjuster strap post 74. The present invention 500 also provides for additional means for securing the present invention 500 to golf club head 26 by incorporating safety strap anchors 68 positioned on opposing sides of head mounted frame member 51 providing means for attachment of a safety strap (not shown). Additionally, the present invention provides frame mounting apertures 64 whereby the present invention can be releasably fixed to golf club head 26 using appropriate fasteners.

Figure 31:
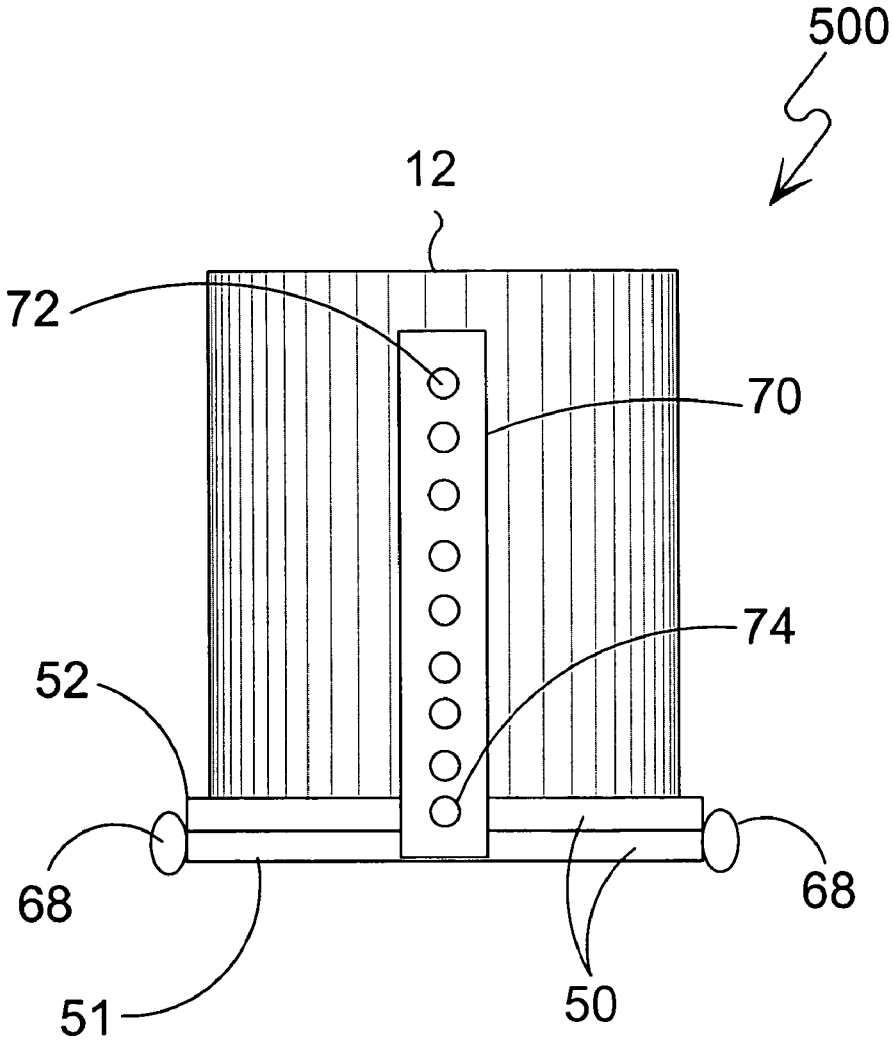
FIG. 31 is a top view of the alternate golf club face mounted version of the present invention.

Turning to FIG. 31, shown therein is a top view of the golf club head mountable golf swing training device 500 of the present invention. Mounting frame 50 is comprised of pivotally fastened frame members 51, 52. As illustrated, the front pivotal member 52 has receptacle 12 depending therefrom with adjuster strap post 74 extending from frame member 52. Adjuster strap 70 having a plurality of spaced apart apertures is fastened to the back pivotal frame member 51. Since the front and back frame members 51, 52 are hingedly fastened at the base using mounting frame hinge 53, angular divergence of the front pivotal frame member 52 relative to the back pivotal frame member 51 is therein provided with adjuster strap 70 and adjuster strap post 74 providing means for releasably fixing the desired angular displacement.

Figure 32:
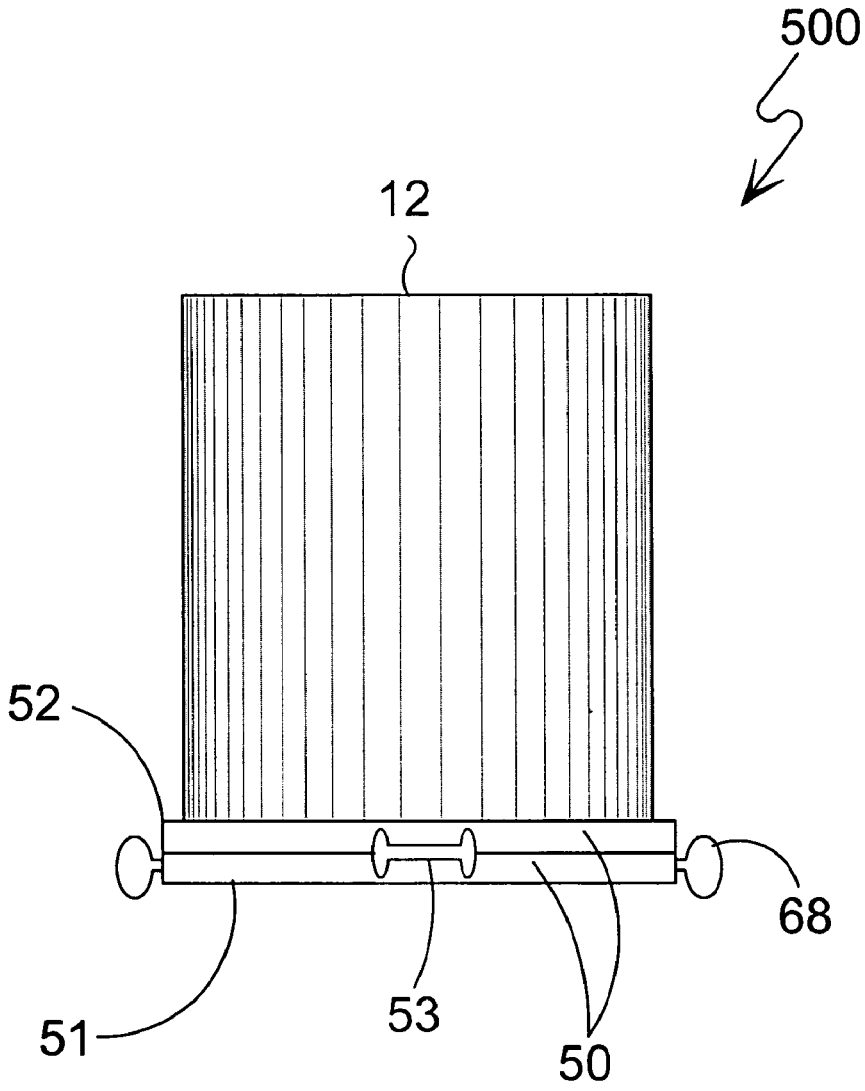
FIG. 32 is a bottom view of the alternate golf club face mounted version of the present invention.

Turning to FIG. 32, shown therein is a bottom view of the golf club head mountable golf swing training device 500 of the present invention. As previously described mounting frame 50 is comprised of pivotally fastened members 51, 52 by means of mounting frame hinge 53. Since the front and back frame members 51, 52 are hingedly fastened at the base via mounting frame hinge 53, angular divergence of the front pivotal frame member 52 relative to the back pivotal frame member 51 is therein provided with adjuster strap 70 and adjuster strap post 74 providing means for releasably fixing the desired angular displacement. Also, the present invention provides an additional means for securing the present invention 500 to golf club head 26 by incorporating safety strap anchors 68 positioned on opposing sides of head mounted frame member 51 providing means for attachment of a safety strap (not shown).

Figure 33:
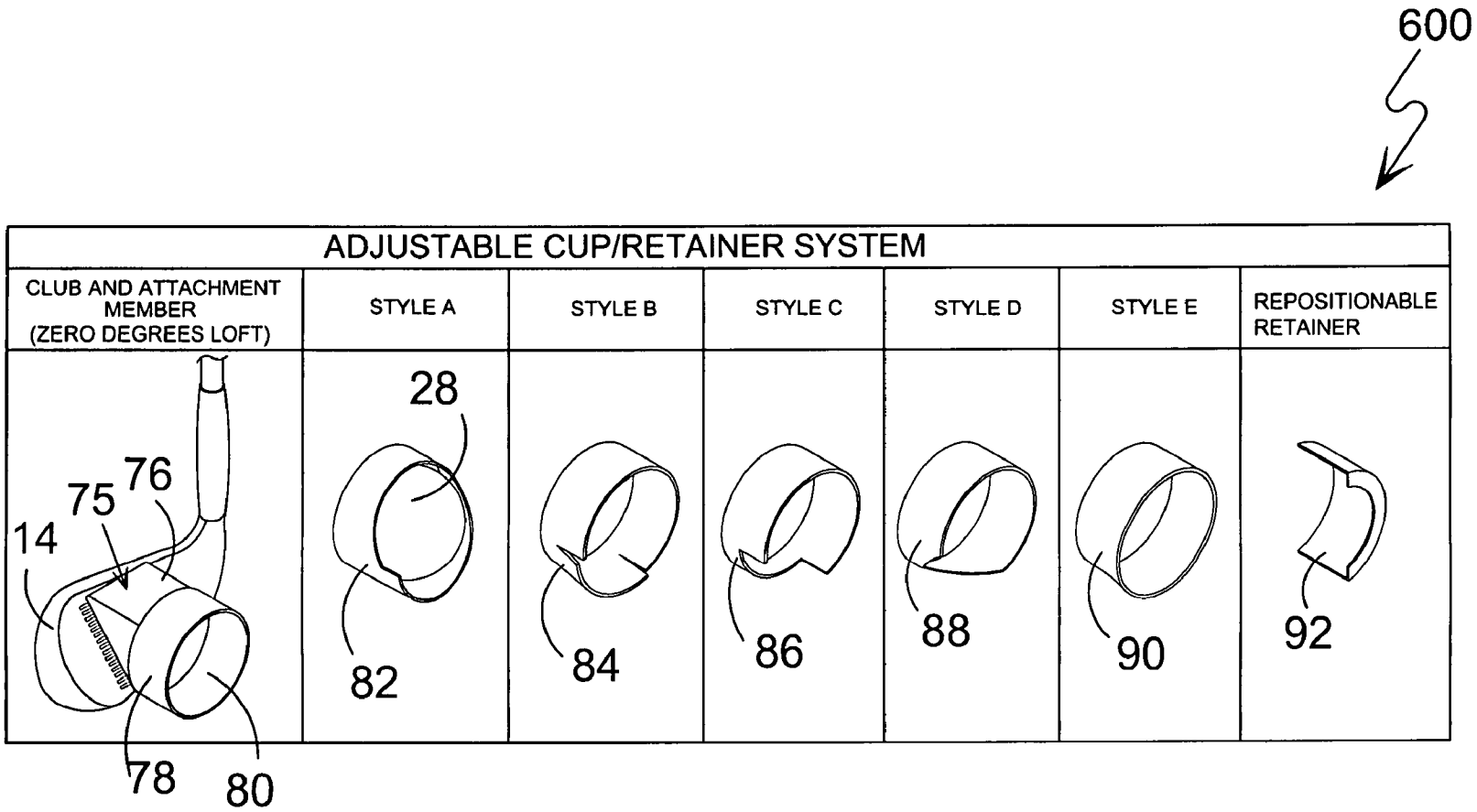
FIG. 33 is a perspective view of ball receptacles for sporting equipment of the present invention.

Turning to FIG. 33, shown therein is a perspective view of ball receptacles for sporting equipment of the present invention. As illustrated in the various styles 82, 84, 86, 88, 90 of ball receptacles 600 for a golf club, the receptacle is designed to hold the ball within until a desired point of release. The present invention provides for variously shaped receptacles including circular, oval, triangular and square or other polygonal shapes that attach to sporting equipment for the purpose of improving swing and ball release. The present invention also provides that the mountable receptacle can be comprised of one or more pieces, such as a mountable collar 78 having aperture 80 with a plurality of inserts 82, 84, 86, 88, 90 having diverse wall configurations, such as notched, spiral rims and partial receptacles. Furthermore, the present invention provides a receptacle retainer forming an integral part of the receptacle or an adjustable retainer 92. In the case of golf clubs, the present invention provides an intermediate mounting member as receptacle support 75 in the form of a wedge 76 fastened to club face 14 whereby the receptacle release aperture has substantially zero degrees vertical displacement at the aforementioned desired release point of ball 28.

Figure 34:
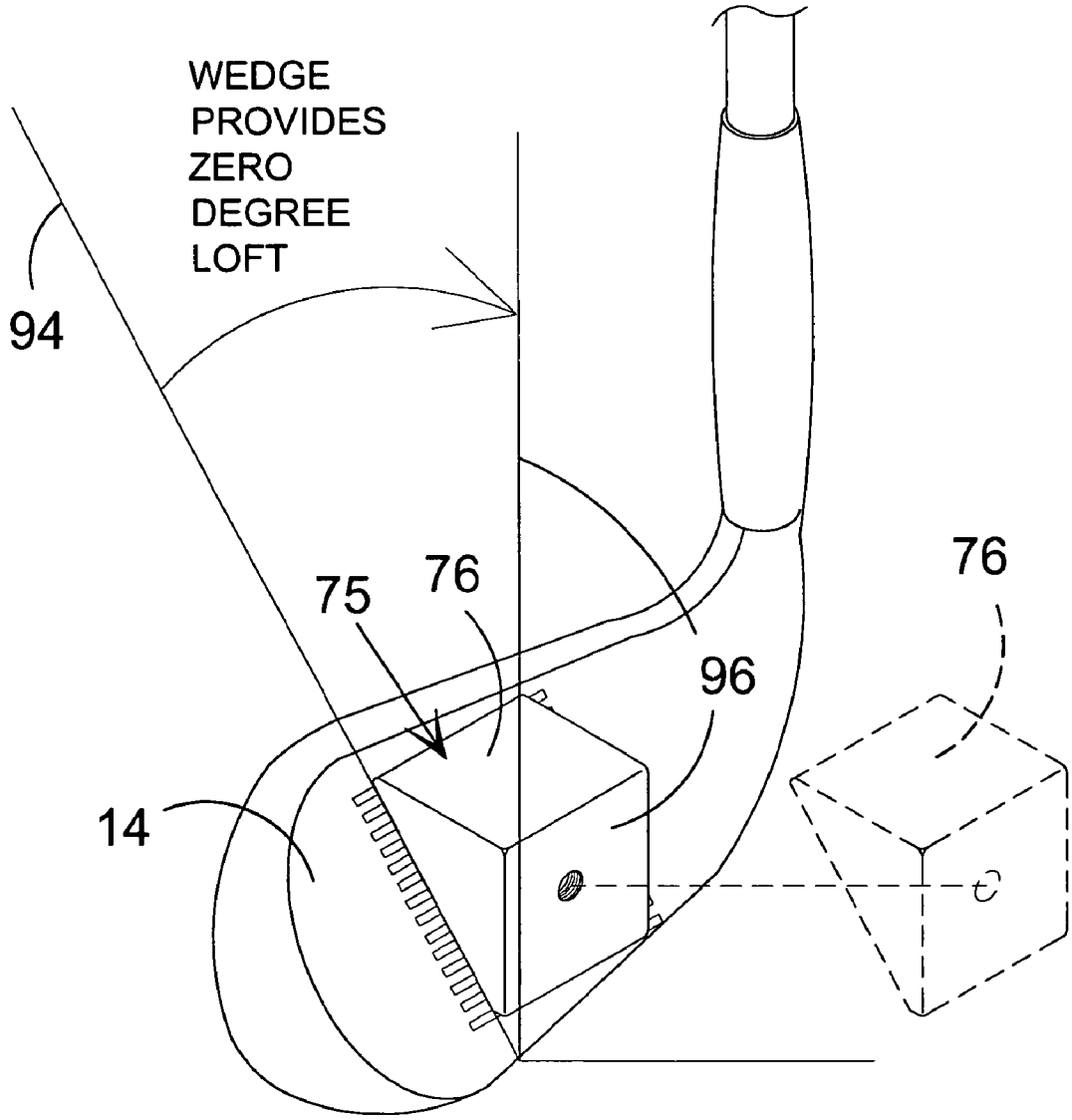
FIG. 34 is a perspective view of a wedge used for receptacle support.

Turning to FIG. 34, shown therein is a perspective view of a wedge used for receptacle support. As aforementioned, the various styles 82, 84, 86 88, 90 of ball receptacles for a golf club are designed to hold the ball until a desired point of release is achieved. The present invention provides for variously shaped receptacles including circular, oval, triangular and square or other polygon al shapes that attach to sporting equipment for the purpose of improving swing and ball release. The present invention also provides that the mountable receptacle can be comprised of one or more pieces, such as a mountable collar 78 with a plurality of inserts 82, 84, 86 88, 90 having diverse wall configurations, such as notched, spiral rims and partial receptacles. In the case of golf clubs 20 having club face angle 94, the present invention also provides an intermediate mounting member as receptacle support 75 in the form of a wedge 76 fastened to club face 14 whereby the receptacle release aperture has substantially zero degrees vertical displacement 96 at the aforementioned desired release point.

Figure 35:
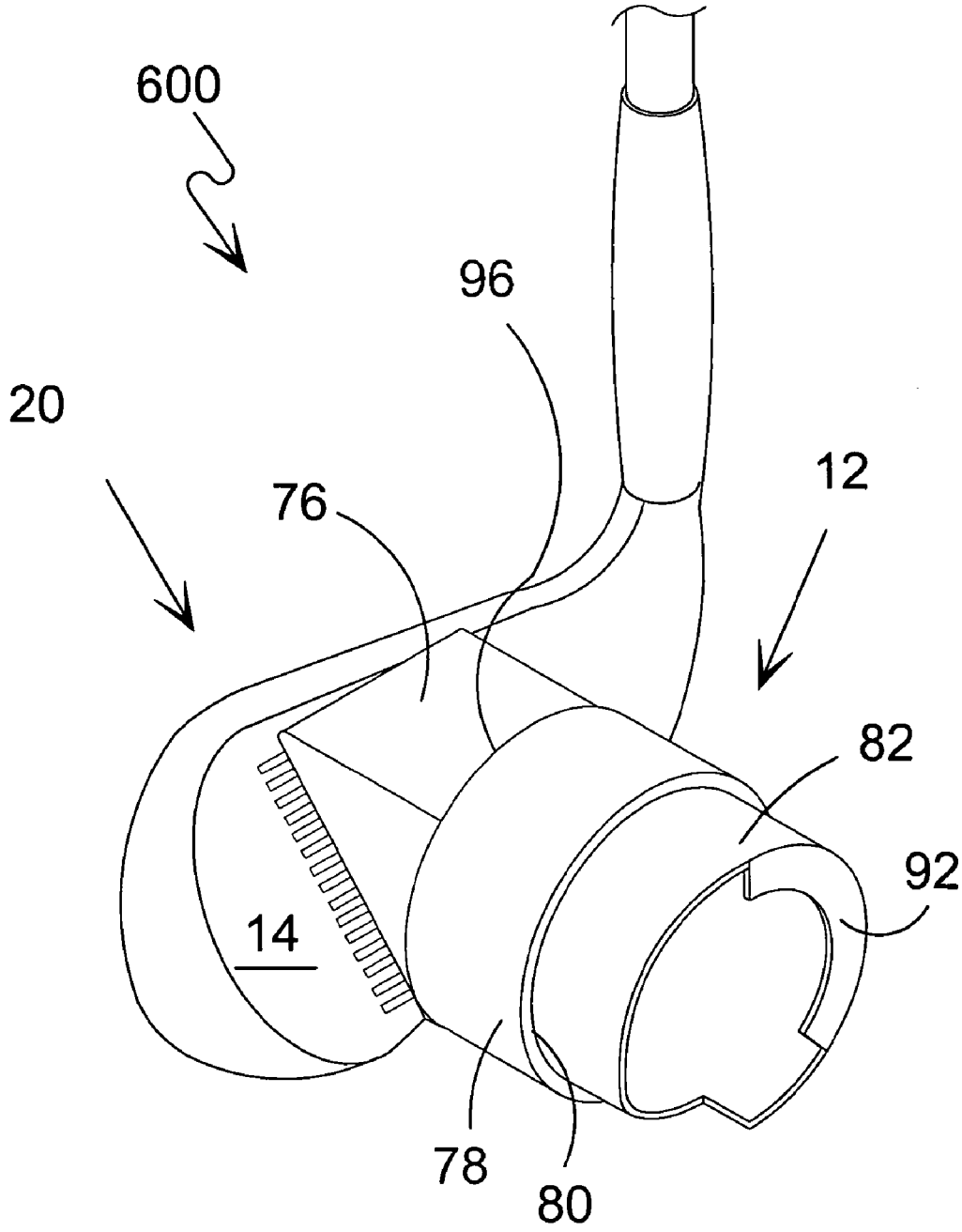
FIG. 35 is a perspective view of an adjustable receptacle/retainer system of the present invention.

Turning to FIG. 35, shown therein is a perspective view of an adjustable receptacle/retainer system 600 of the present invention. Shown is style 82 of a new receptacle 12 design that is mounted within aperture 80 of receptacle 78 fastened to club face 14 of golf club 20 using an attachment member 76 that is miter cut so that the face 14 of the receptacle 12 has zero degrees loft 96. Also provided is retainer 92 that can form an integral part of receptacle 12 or as an adjustable retainer 92.

Figure 36:
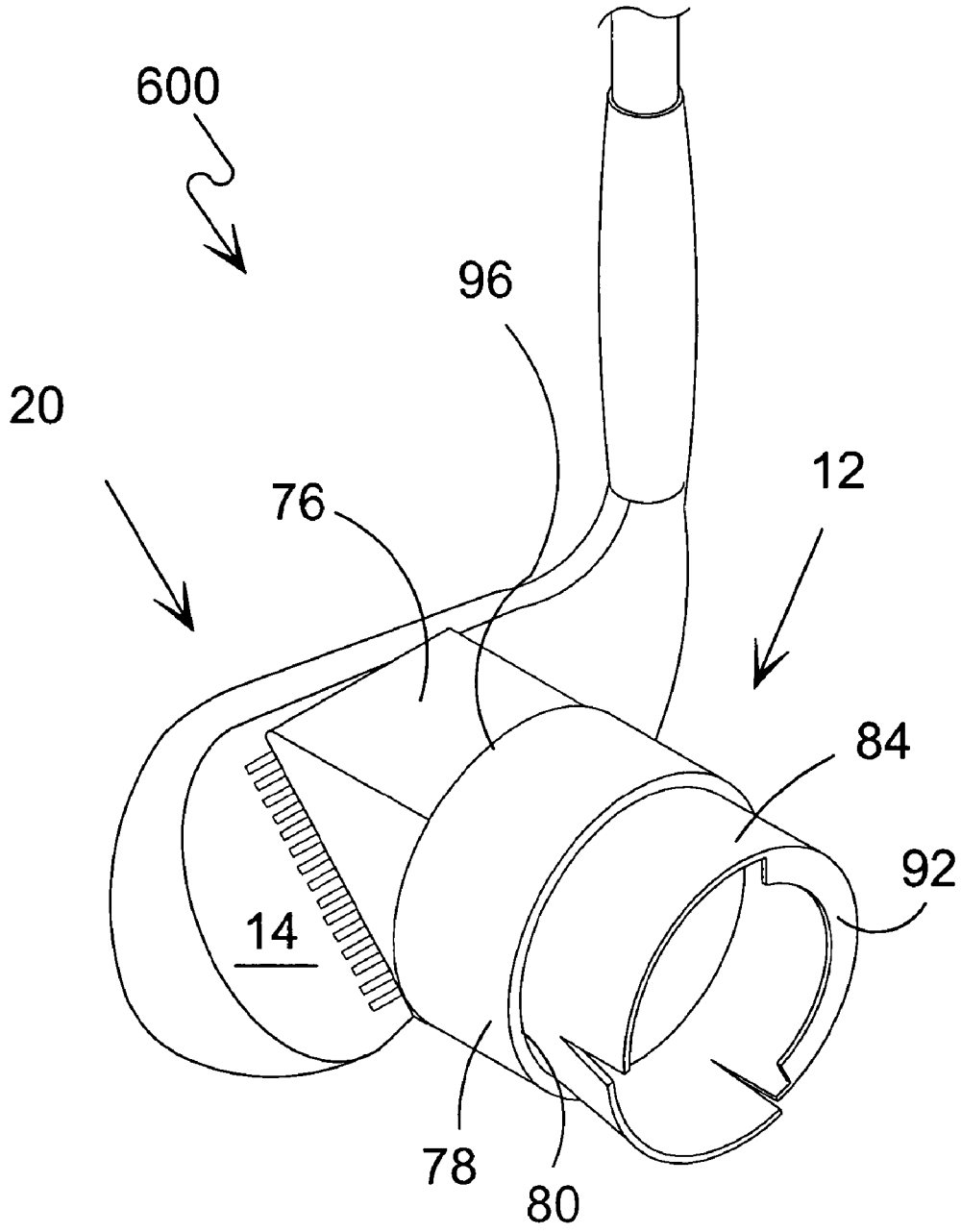
FIG. 36 is a perspective view of an adjustable receptacle/retainer system of the present invention.

Turning to FIG. 36, shown therein is a perspective view of an adjustable receptacle/retainer system 600 of the present invention. Shown is style 84 of a new receptacle 12 design that is mounted within aperture 80 of receptacle 78 fastened to club face 14 of golf club 20 using an attachment member 76 that is miter cut so that the face 14 of the receptacle 12 has zero degrees loft 96. Also provided is retainer 92 that can form an integral part of receptacle 12 or as an adjustable retainer 92.

Figure 37:
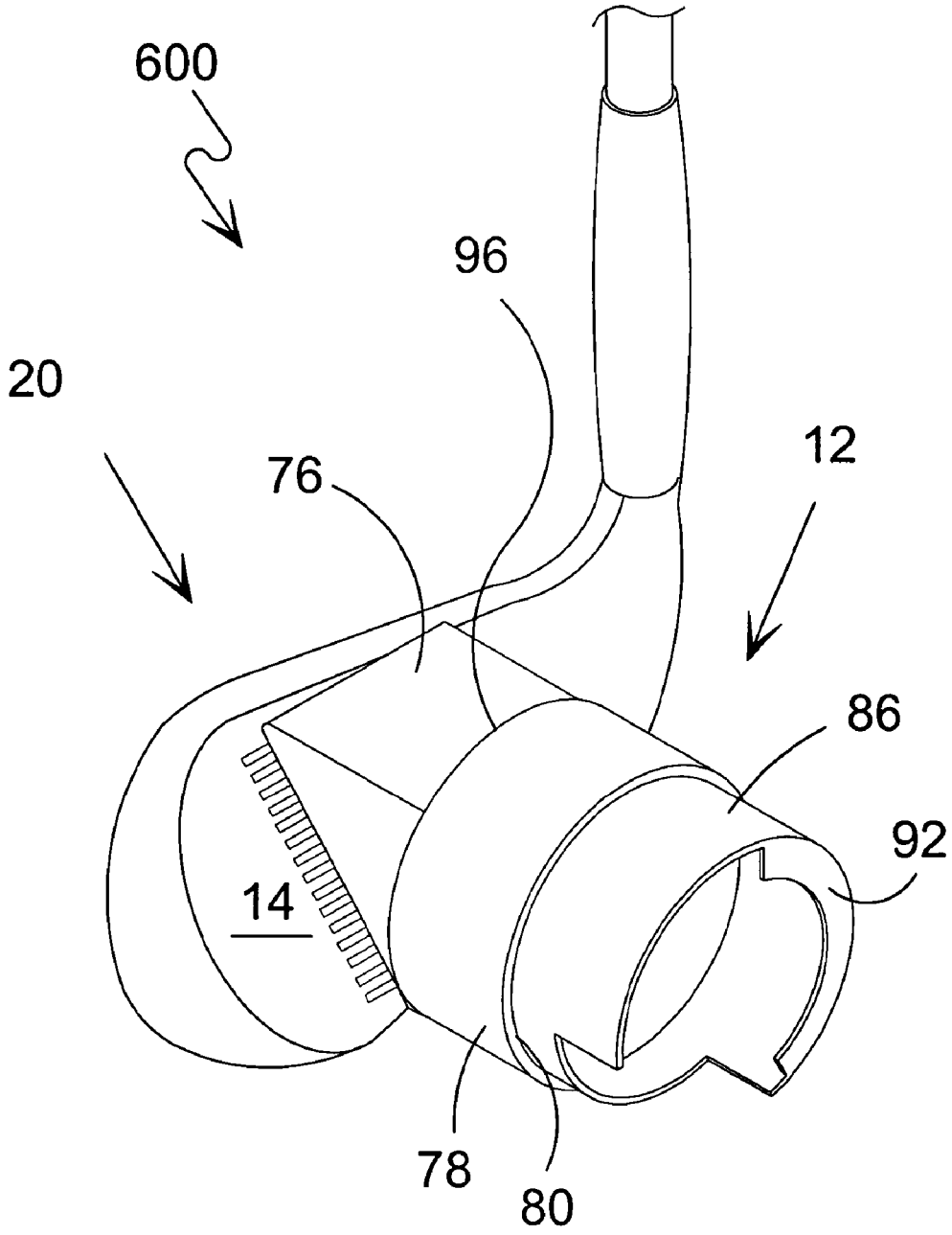
FIG. 37 is a perspective view of an adjustable receptacle/retainer system of the present invention.

Turning to FIG. 37, shown therein is a perspective view of an adjustable receptacle/retainer system 600 of the present invention. Shown is style 86 of a new receptacle 12 design that is mounted within aperture 80 of receptacle 78 fastened to club face 14 of golf club 20 using an attachment member 76 that is miter cut so that the face 14 of the receptacle 12 has zero degrees loft 96. Also provided is retainer 92 that can form an integral part of receptacle 12 or as an adjustable retainer 92.

Figure 38:
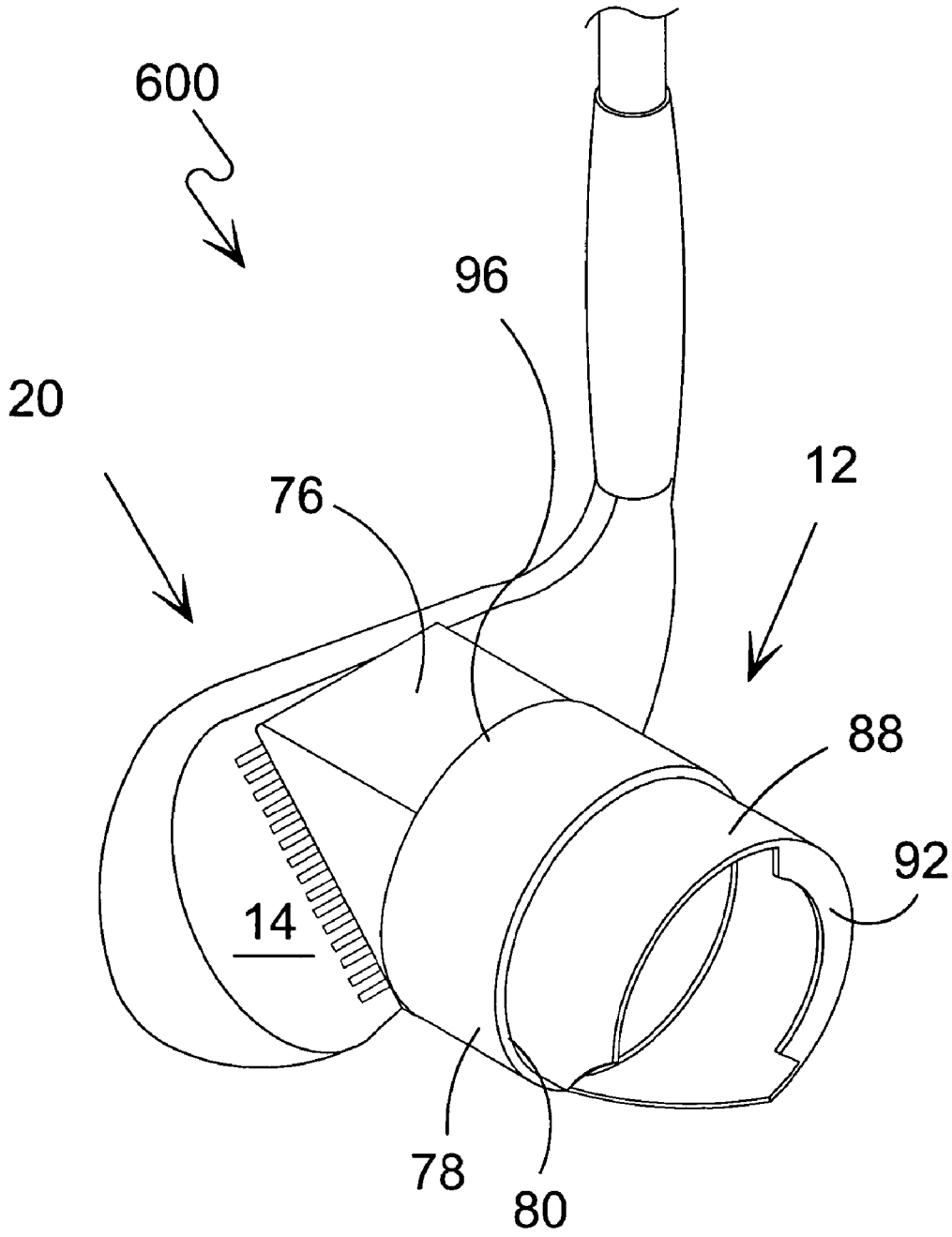
FIG. 38 is a perspective view of an adjustable receptacle/retainer system of the present invention.

Turning to FIG. 38, shown therein is a perspective view of an adjustable receptacle/retainer system 600 of the present invention. Shown is style 88 of a new receptacle 12 design that is mounted within aperture 80 of receptacle 78 fastened to club face 14 of golf club 20 using an attachment member 76 that is miter cut so that the face 14 of the receptacle 12 has zero degrees loft 96. Also provided is retainer 92 that can form an integral part of receptacle 12 or as an adjustable retainer 92.

Figure 39:
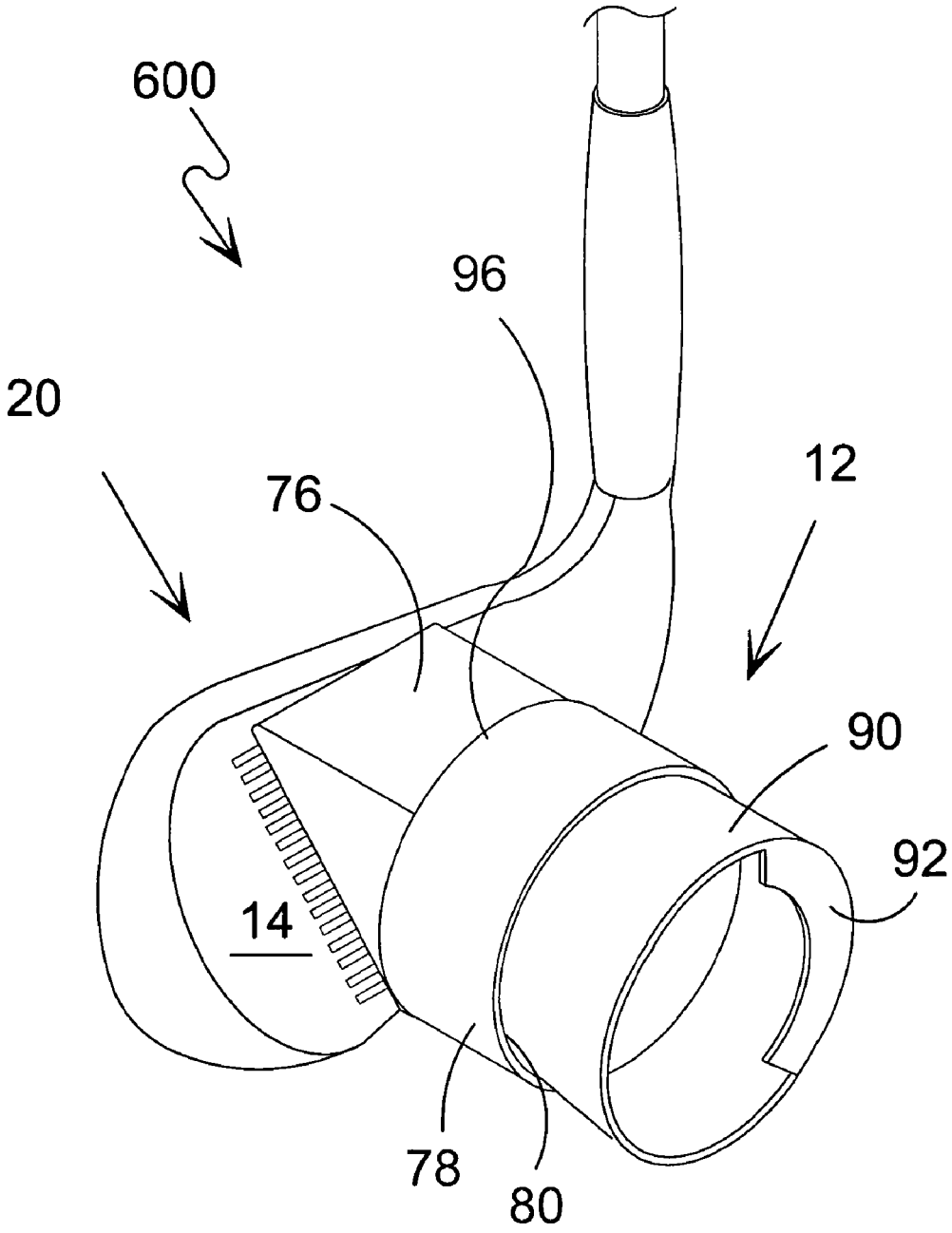
FIG. 39 is a perspective view of an adjustable receptacle/retainer system of the present invention.

Turning to FIG. 39, shown therein is a perspective view of an adjustable receptacle/retainer system 600 of the present invention. Shown is style 90 of a new receptacle 12 design that is mounted within aperture 80 of receptacle 78 fastened to club face 14 of golf club 20 using an attachment member 76 that is miter cut so that the face 14 of the receptacle 12 has zero degrees loft 96. Also provided is retainer 92 that can form an integral part of receptacle 12 or as an adjustable retainer 92.

Figure 40:
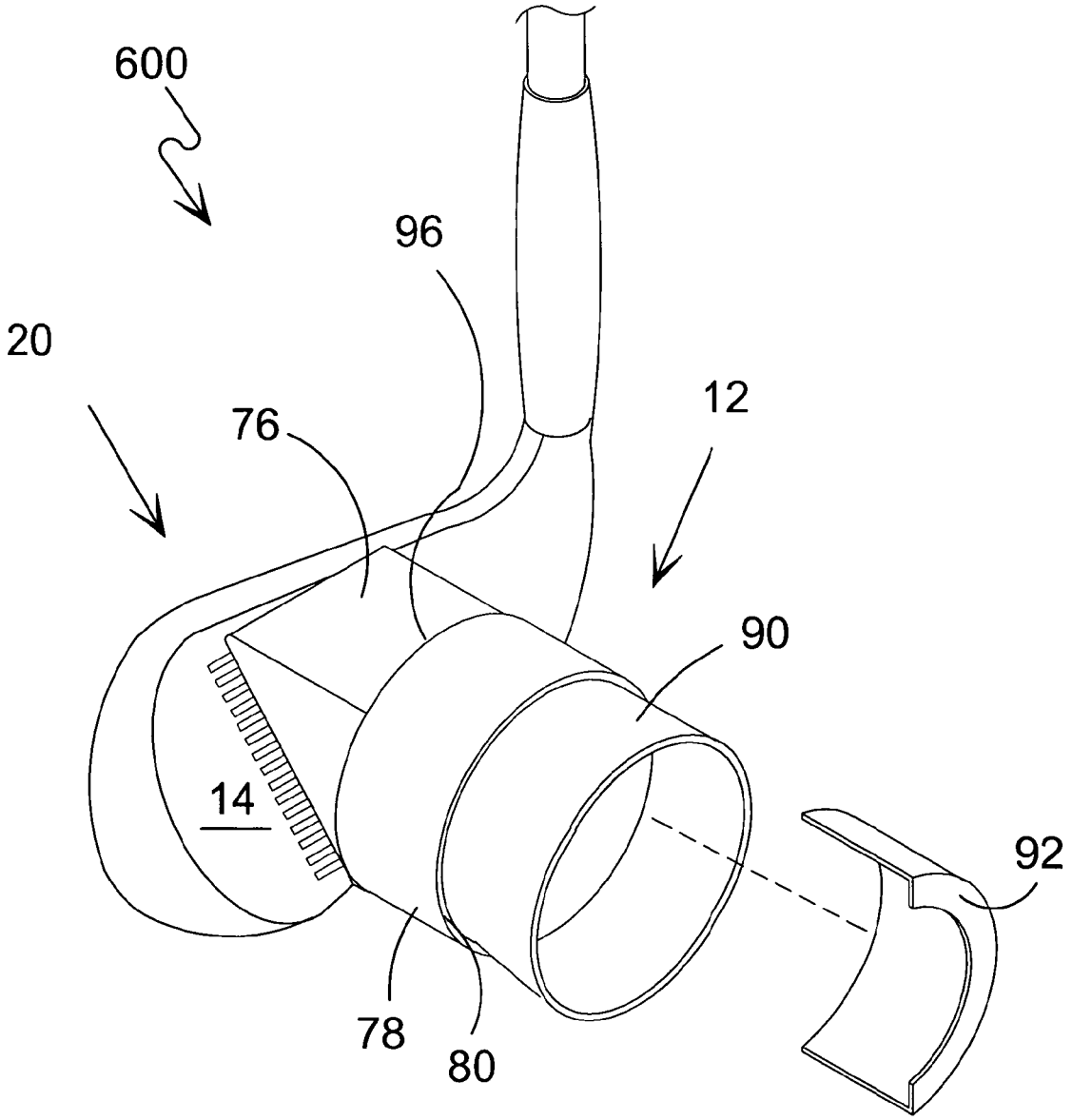
FIG. 40 is a perspective view of an adjustable receptacle/retainer system of the present invention.

Turning to FIG. 40, shown therein is a perspective view of an adjustable receptacle/retainer system 600 of the present invention. Shown is style 90 of a new receptacle 12 design that is mounted within aperture 80 of receptacle 78 fastened to club face 14 of golf club 20 using an attachment member 76 that is miter cut so that the face 14 of the receptacle 12 has zero degrees loft 96. Also provided is retainer 92 that can form an integral part of receptacle 12 or as a user selectively adjustable retainer 92.

Figure 41:
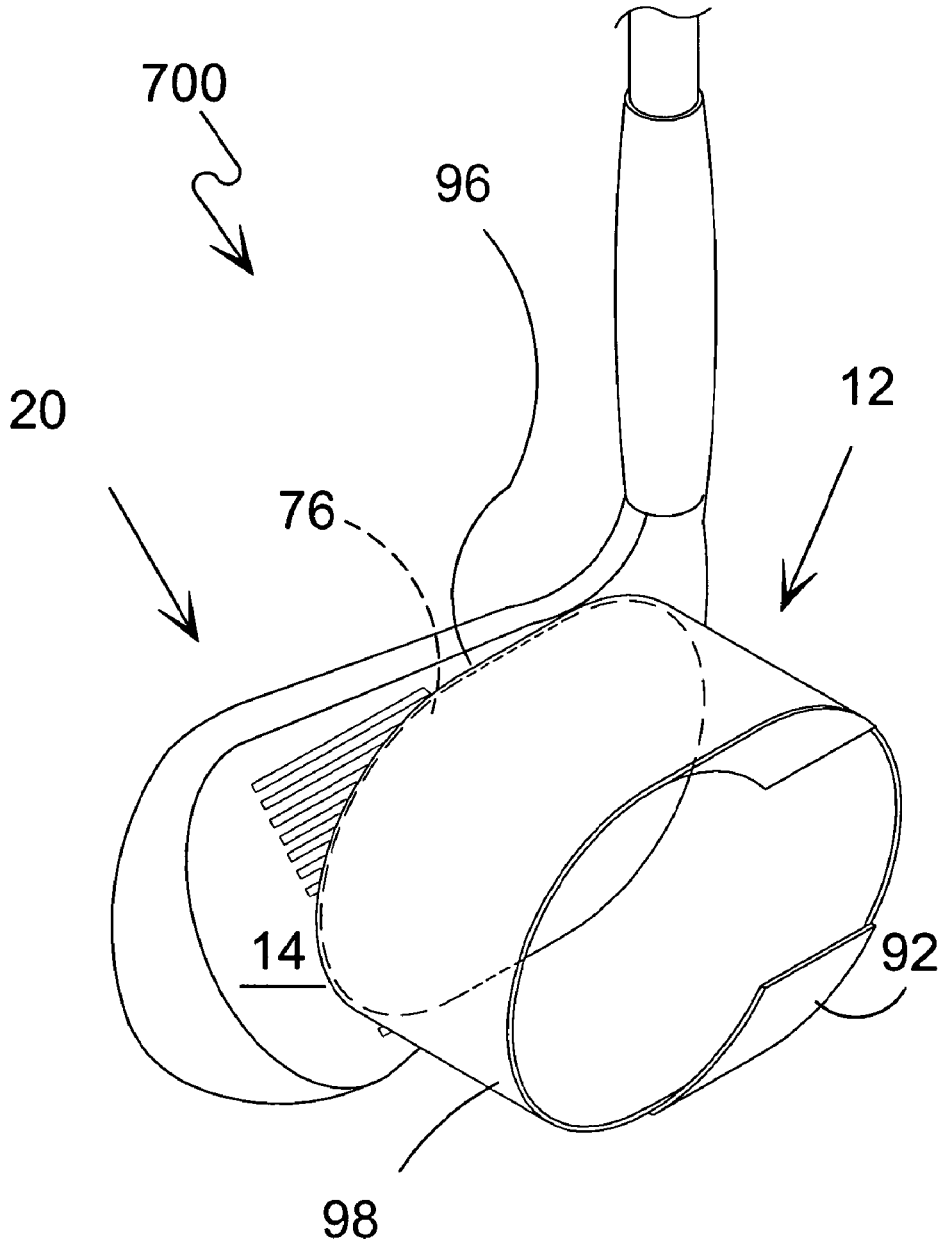
FIG. 41 is a perspective view of a receptacle variation of the present invention.

Turning to FIG. 41, shown therein is a perspective view of an adjustable receptacle/retainer system 700 of the present invention. Shown is a new design 98 of an elongated receptacle 12 design that is mounted to club face 14 of golf club 20 using wedge 76 so that the face of the receptacle has zero degrees loft 96. Also shown is retainer 92 that can form an integral part of receptacle 12 or as a user repositionable retainer 92.

Figure 42:
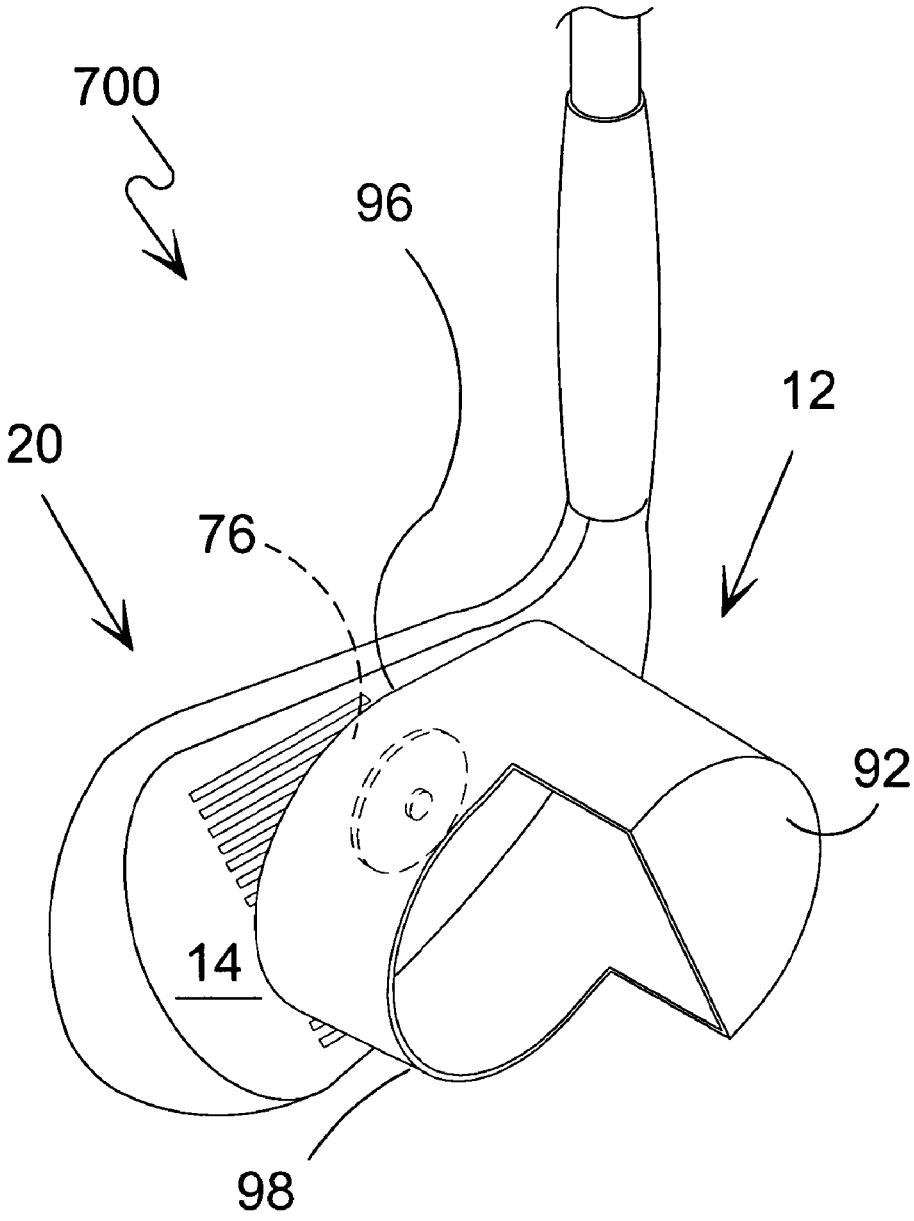
FIG. 42 is a perspective view of a receptacle variation of the present invention.

Turning to FIG. 42, shown therein is a perspective view of a receptacle variation of the present invention 700. Shown is another new design 98 having another type of retainer 92 for elongated receptacle 12 that is mounted to club face 14 of golf club 20 using wedge 76 so that the face of the receptacle has zero degrees loft 96.

Figure 43:
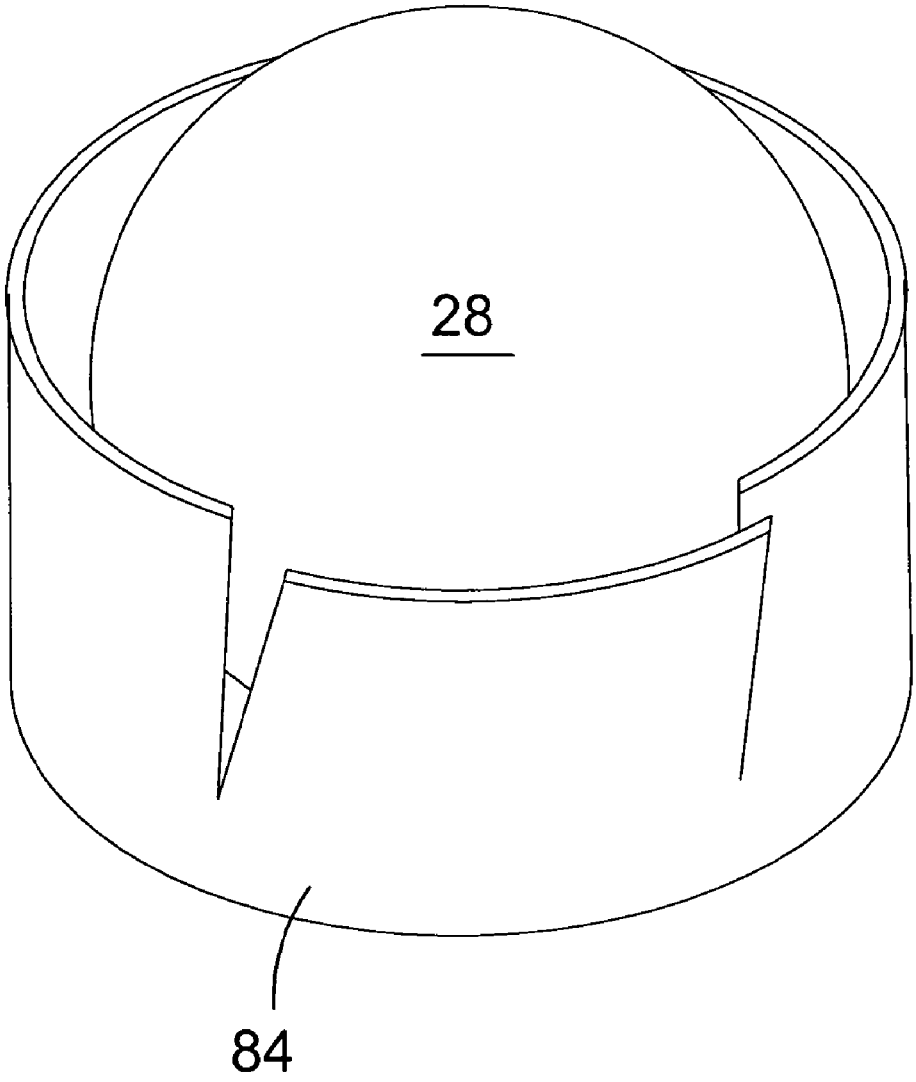
FIG. 43 is a perspective view of a receptacle variation of the present invention.

Turning to FIG. 43, shown therein is a perspective view of a receptacle variation of the present invention. Shown is a design of a receptacle 84 providing a different release point for ball 28.

Figure 44:
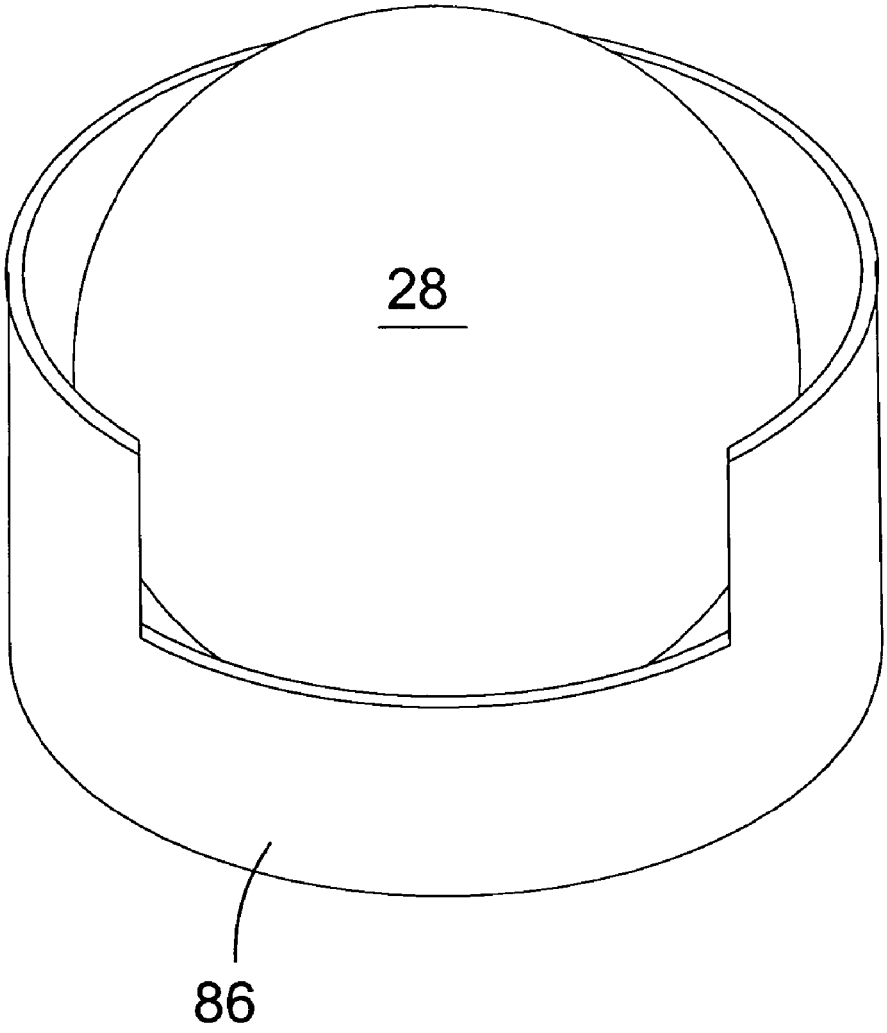
FIG. 44 is a perspective view of a receptacle variation of the present invention.

Turning to FIG. 44, shown therein is a perspective view of a receptacle variation of the present invention. Shown is a design of a receptacle 86 providing a different release point for ball 28.

Figure 45:
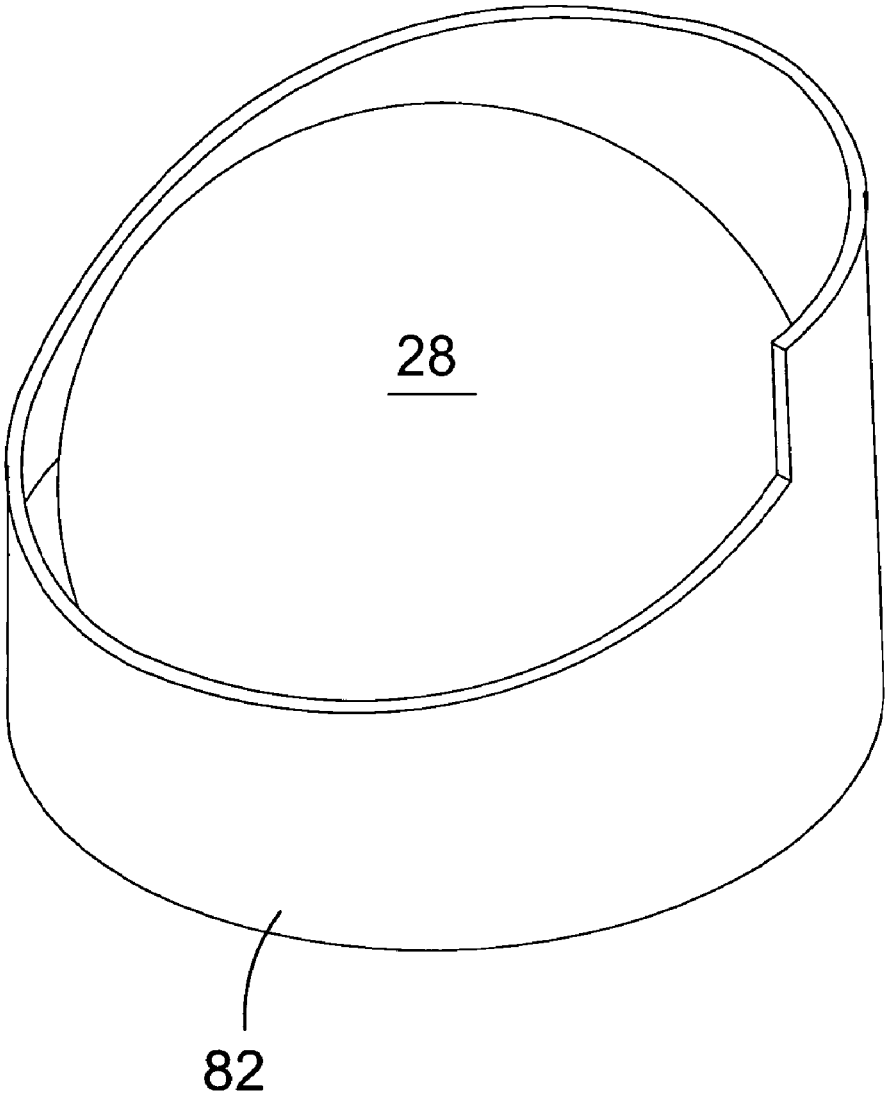
FIG. 45 is a perspective view of a receptacle variation of the present invention.

Turning to FIG. 45, shown therein is a perspective view of a receptacle variation of the present invention. Shown is a design of a receptacle 82 providing a different release point for ball 28.

Figure 46:
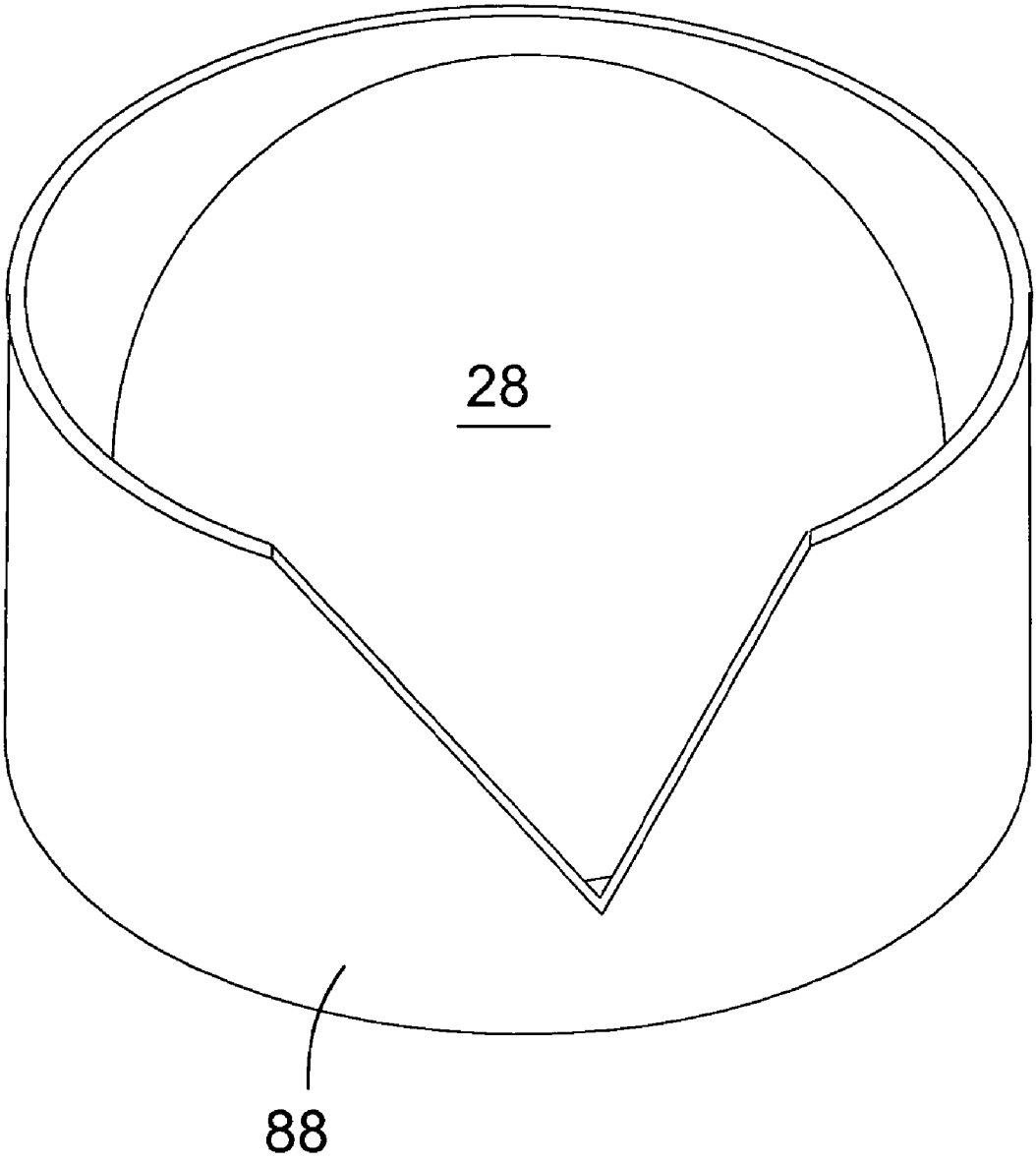
FIG. 46 is a perspective view of a receptacle variation of the present invention.

Turning to FIG. 46, shown therein is a perspective view of a receptacle variation of the present invention. Shown is a design of a receptacle 88 providing a different release point for ball 28.

Figure 47:
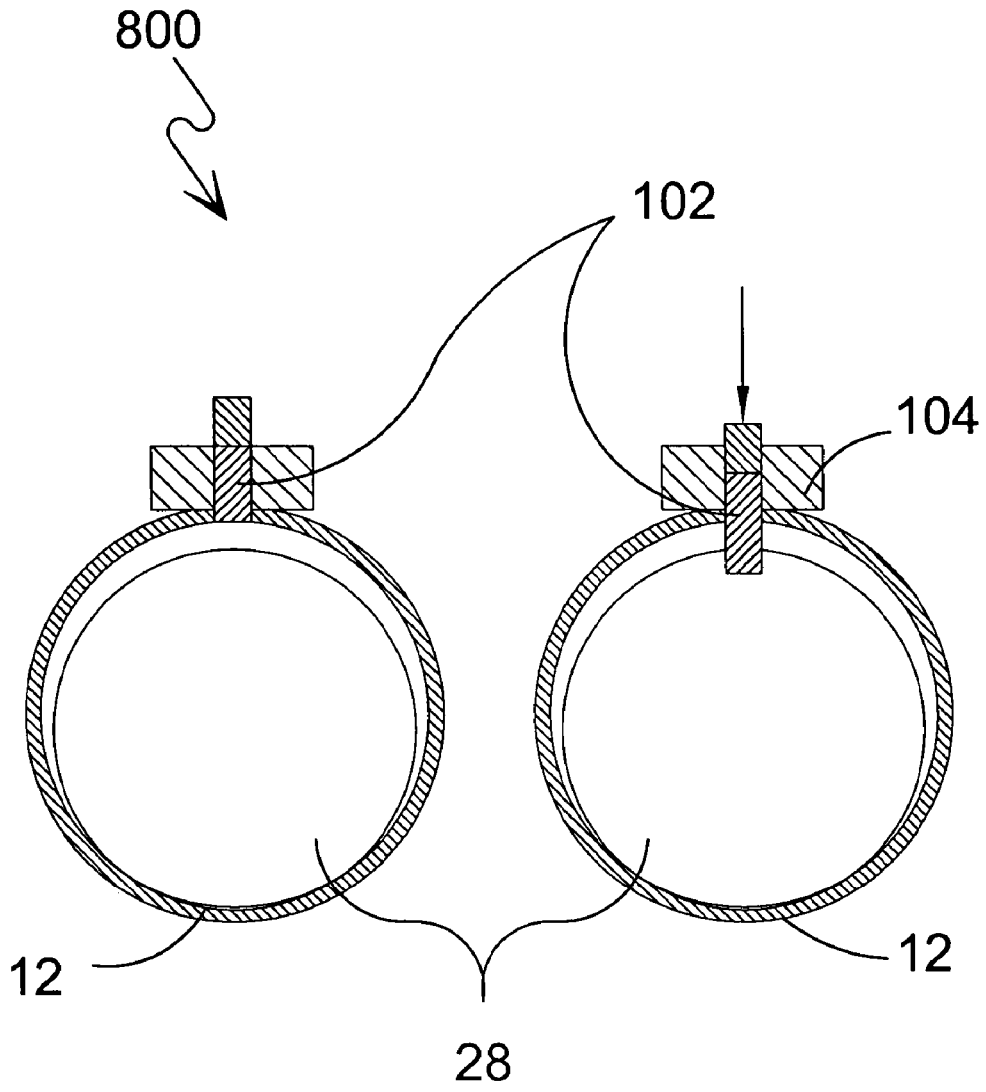
FIG. 47 is a front view of an additional element of the present invention.

Turning to FIG. 47, shown therein is a front view of an additional element of the present invention. Illustrated is another golf-club-head mounted golf swing training device 800 comprising an electromechanical release mechanism mounted within actuator 104 comprising an electrically operated restrainer 102 that is utilized to hold the ball 28 within receptacle 12 until sufficient downforce or manual release is initiated for its egress therefrom.

Figure 48:
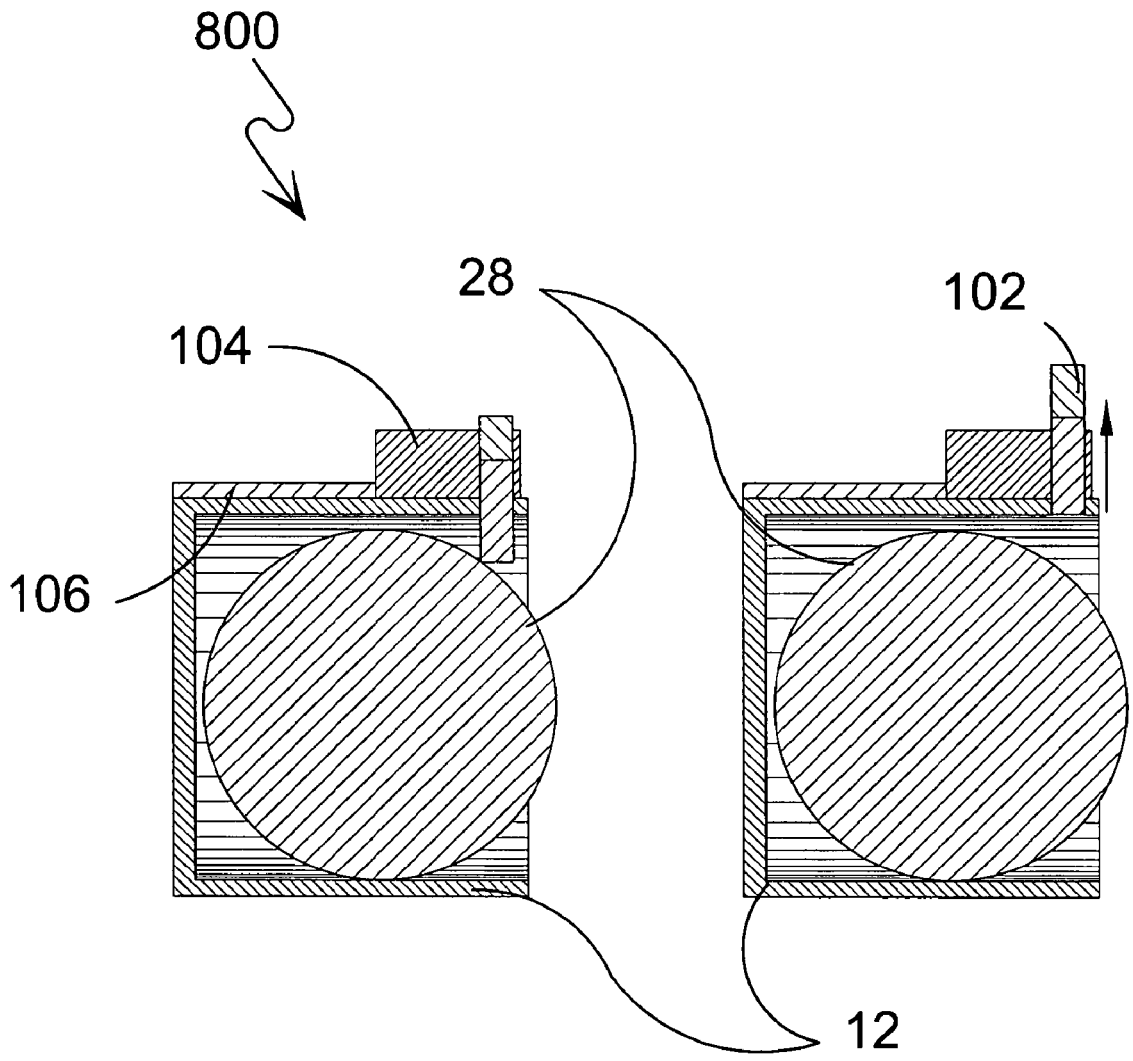
FIG. 48 is a side view of an additional element of the present invention.

Turning to FIG. 48, shown therein is a side view of an additional element of the present invention. Illustrated is another golf-club-head mounted golf swing training device 800 comprising an electromechanical release mechanism mounted within actuator 104 comprising an electrically operated restrainer 102 and wiring chase 106 that is utilized to hold the ball 28 within receptacle 12 until sufficient downforce or manual release is initiated for its egress therefrom.

Figure 49:
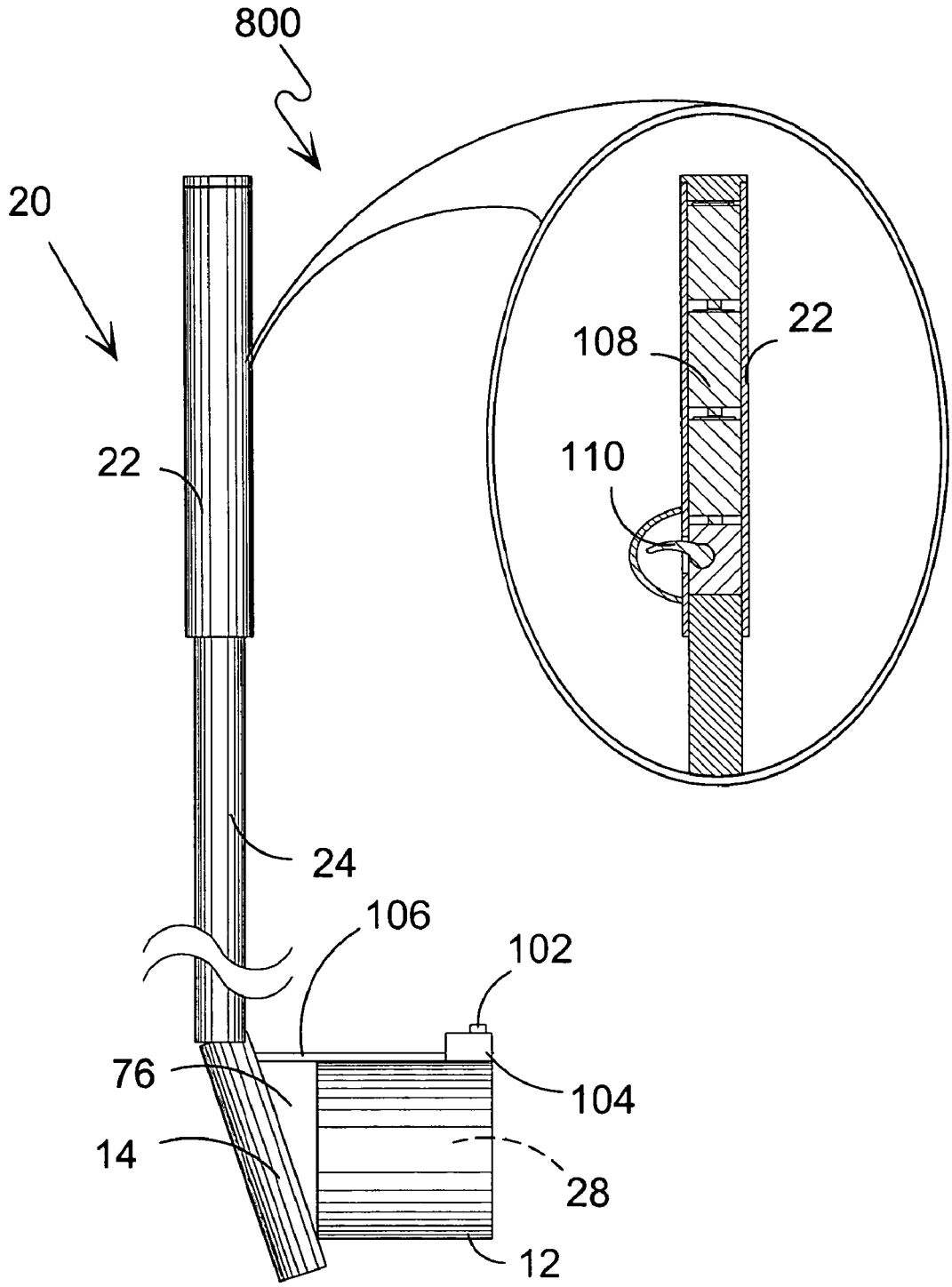
FIG. 49 is a side view of an additional element of the present invention.

Turning to FIG. 49, shown therein is a side view of an additional element of the present invention. Shown is an additional element 800 of the present invention having restrainer 102 mounted within actuator 104 in electrical communication with trigger 110 via wiring chase 106 whereby ball 28 is held within receptacle 12 until sufficient downforce or manual release is initiated for its egress therefrom. Additionally shown is one possible power source within handle 22 of shaft 24 of club 20 housing batteries 108 and trigger 110 for releasing the ball selectively. Also shown is club face 14 having wedge 76 attached thereto.

Figure 50:
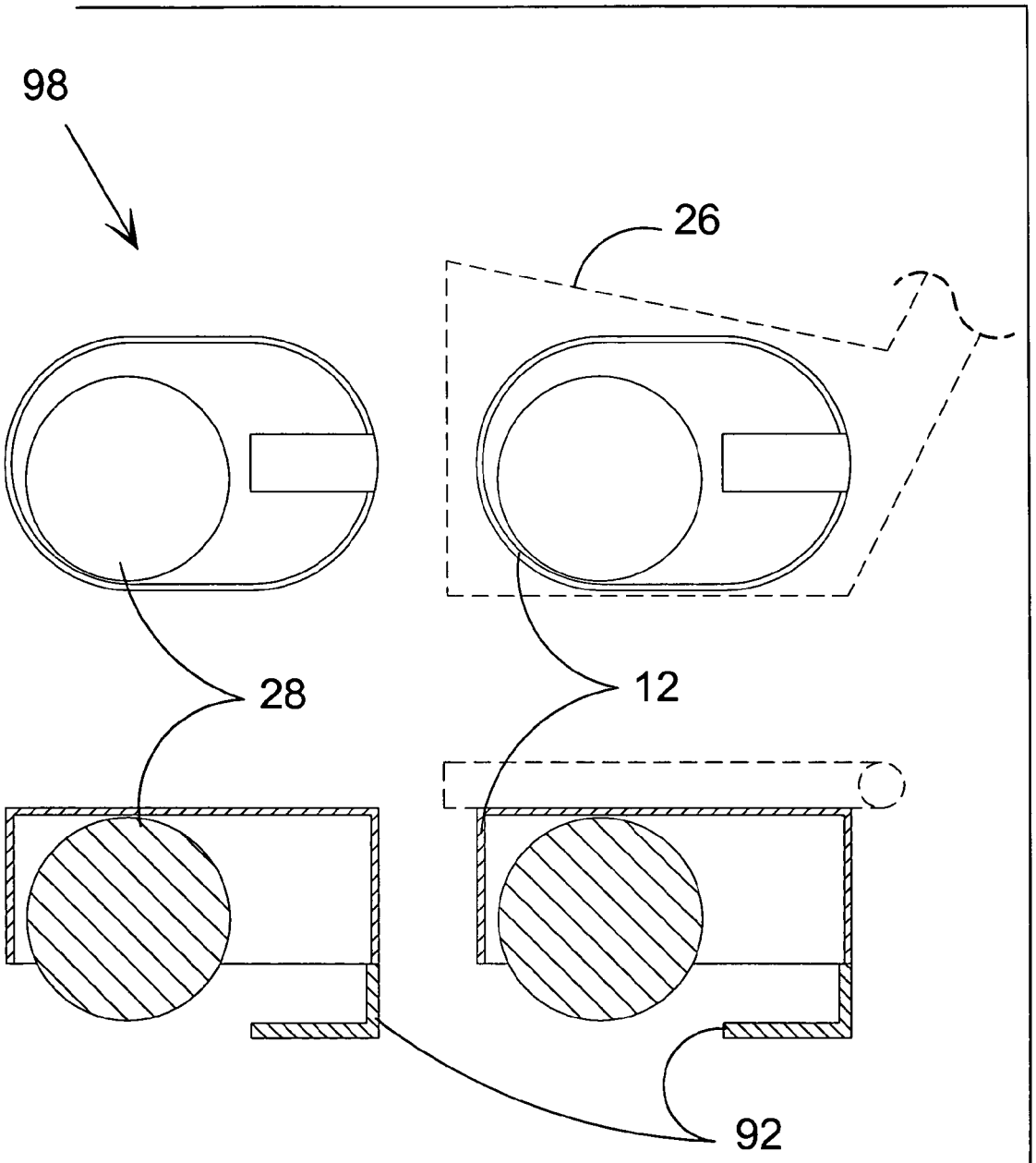
FIG. 50 is an illustrative view of an additional element of the present invention.

Turning to FIG. 50, shown therein is an illustrative view of an additional element of the present invention. Shown is an additional element of the present invention having an elongated receptacle 98 for club head 26 with a plurality of restrainer 92 elements located on the upper and lower region of the receptacle 12 to retain the ball's 28 displacement until its release.

Figure 51:
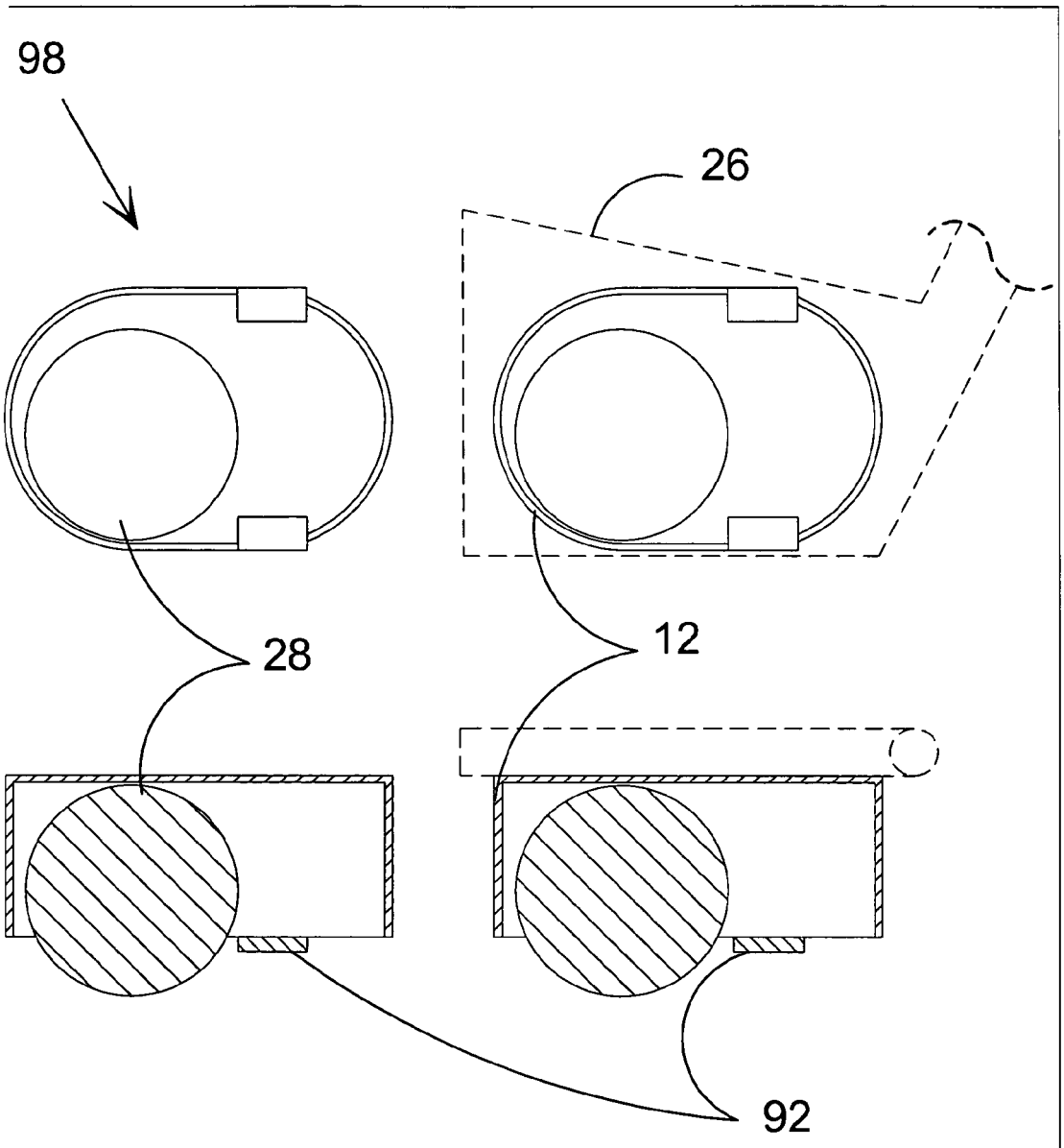
FIG. 51 is an illustrative view of an additional element of the present invention.

Turning to FIG. 51, shown therein is an illustrative view of an additional element of the present invention. Shown is an additional element of the present invention having an elongated receptacle 98 for club head 26 with a plurality of restrainer 92 elements located on the upper and lower region of the receptacle 12 to retain the ball's 28 displacement until its released.

I claim:

1. An apparatus for a swing training device, comprising:

(a) a club having a shaft, a grip, a club head and a club face;

(b) a doorless receptacle being disposed on said face of said club, wherein said receptacle has a front and rear end and wherein said front end is open to permit a ball to be placed in the receptacle to train a user how to properly swing the club; and (c) wherein the receptacle includes a retainer so as to retain a ball inside said receptacle and release the ball during a swing of the club.

2. The apparatus of claim 1, further comprising a wedge disposed on said face of said club.

3. The apparatus of claim 2, wherein said wedge has a front side and a back side with said back side having a complementary club face angle so that the wedge front side has a true vertical surface.

4. The apparatus of claim 3, wherein said wedge front side has said receptacle back end attached thereto.

5. The apparatus of claim 4, wherein said receptacle is fastened to said wedge with a fastener whereby said receptacle is removable.

6. The apparatus of claim 4, wherein said receptacle is fixed to said wedge so that it is not removable.

7. The apparatus of claim 3, wherein said wedge is a support having a fixed displacement between the front side and rear side.

8. The apparatus of claim 3, wherein said wedge has a pivotal connection whereby the angular displacement between the wedge front side and wedge back side can be selectively altered.

9. The apparatus of claim 1, wherein said receptacle front and rear end has a wall depending therebetween and wherein said receptacle shape is cylindrical, square, round, elongated, or triangular.

10. The apparatus of claim 1, wherein said retainer is at least one flange on the front end serving to restrain the ball from casually falling out of the receptacle during use.

11. The apparatus of claim 10, wherein said retainer is manufactured as an integral part of the receptacle.

12. The apparatus of claim 10, wherein said receptacle restrainer is removable from said receptacle and therefore user selectively adjustable.

13. The apparatus of claim 12, wherein said retainer is a receptacle insert having a flange whereby the insert can be selectively positioned within said receptacle.

14. The apparatus of claim 1, wherein said retainer includes a selective releasing mechanism.

15. A method, comprising:

inserting a ball into a doorless receptacle of an apparatus for a swing training device, comprising:

(a) a club having a shaft, a grip, a club head and a club face;

(b) the receptacle being disposed on said face of said club, wherein said receptacle has a front and rear end and wherein said front end is open to permit a ball to be placed in the receptacle to train a user how to properly swing the club; and (c) wherein the receptacle includes a retainer so as to retain a ball inside said receptacle and release the ball during a swing of the club; and swinging the apparatus.

16. The apparatus of claim 1, wherein the club includes a golf club and the ball includes a golf ball.

17. The apparatus of claim 1, wherein the retainer is located at a rim of the receptacle.

* * * * *